US011500311B2

(12) United States Patent
Sasame et al.

(10) Patent No.: US 11,500,311 B2
(45) Date of Patent: Nov. 15, 2022

(54) IMAGE FORMING APPARATUS INCLUDING TECHNIQUES AND MECHANISMS TO SUPPRESS OCCURRENCE OF AN IMAGE DEFECT CAUSED BY A TRANSFER STEP

(71) Applicant: CANON KABUSHIKI KAISHA, Tokyo (JP)

(72) Inventors: Hiroki Sasame, Tokyo (JP); Junichi Kubota, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/551,026

(22) Filed: Dec. 14, 2021

(65) Prior Publication Data

US 2022/0197193 A1 Jun. 23, 2022

(30) Foreign Application Priority Data

Dec. 17, 2020 (JP) ..... JP2020-209700
Dec. 17, 2020 (JP) ..... JP2020-209702

(51) Int. Cl.
*G03G 15/16* (2006.01)

(52) U.S. Cl.
CPC ..... *G03G 15/1665* (2013.01); *G03G 15/1675* (2013.01)

(58) Field of Classification Search
CPC ..... G03G 15/1645; G03G 15/1665; G03G 15/1675
USPC ..... 399/66, 88, 314
See application file for complete search history.

(56) References Cited

U.S. PATENT DOCUMENTS 7,020,407 B2 * 3/2006 Nakata et al. ..... G03G 15/1675 399/66
10,503,108 B2 * 12/2019 Kubota ..... G03G 15/1675

FOREIGN PATENT DOCUMENTS

| | | | |
|---|---|---|---|
| JP | H0482617 | A | 3/1992 |
| JP | 2001083812 | A | 3/2001 |
| JP | 2011139618 | A | 7/2011 |
| JP | 2016126213 | A | 7/2016 |
| JP | 2016161770 | A | 9/2016 |
| JP | 2020096487 | A | 6/2020 |

* cited by examiner

*Primary Examiner* — William J Royer
(74) *Attorney, Agent, or Firm* — Canon U.S.A., Inc. I.P. Division

(57) ABSTRACT

An image forming apparatus includes a controller and a transfer power supply portion configured to output a transfer voltage to a transfer portion so as to transfer a toner image onto a recording material. The transfer power supply portion superimposes a voltage output from a first power supply portion and a voltage output from a second power supply portion to output a superimposed voltage to the transfer portion. The first power supply portion includes a transformer including a primary coil and a secondary coil, and a rectifier circuit portion. The rectifier circuit portion includes a plurality of diodes and a plurality of capacitors. A capacitance of a predetermined capacitor to be charged by a half-wave rectified voltage of an AC voltage generated in the secondary coil is larger than a capacitance of a capacitor to be charged by a voltage higher than the half-wave rectified voltage.

32 Claims, 19 Drawing Sheets

SECOND EMBODIMENT

FIRST EMBODIMENT

FIRST COMPARATIVE EXAMPLE

THIRD EMBODIMENT

THIRD COMPARATIVE EXAMPLE

FOURTH COMPARATIVE EXAMPLE

IMAGE FORMING APPARATUS INCLUDING TECHNIQUES AND MECHANISMS TO SUPPRESS OCCURRENCE OF AN IMAGE DEFECT CAUSED BY A TRANSFER STEP

BACKGROUND

Field

The present disclosure relates to an image forming apparatus using an electrophotographic method.

Description of the Related Art

In an electrophotographic image forming apparatus, an electrostatic latent image is formed by using a contrast between a dark section potential (charging potential) VD on a photosensitive drum, which is formed by subjecting the photosensitive drum to charging processing by a charging unit, and a light section potential VL on the photosensitive drum, which is formed by subjecting a portion of the photosensitive drum having the dark section potential VD to exposure by an exposure unit. Then, toner moves from a developing roller for carrying developer (toner) to a portion of the photosensitive drum having the light section potential VL due to developing contrast being a potential difference between the light section potential VL formed on the photosensitive drum and a developing voltage applied to the developing roller. As a result, the toner adheres to the electrostatic latent image formed on the photosensitive drum so that a toner image is formed. The toner image formed on the photosensitive drum is transferred onto a recording material by a transfer unit. As a transfer member to be used in the transfer unit, in general, a transfer roller is used. The transfer roller is brought into abutment against the photosensitive drum so as to form a nip portion (hereinafter referred to as "transfer nip portion"). The transfer roller nips and conveys the recording material while being rotated in abutment against the photosensitive drum, and transfers the toner image formed on the photosensitive drum onto the recording material. At this time, the transfer roller is applied with a transfer voltage having a positive polarity opposite to a negative polarity that is the polarity of the toner forming the toner image.

In the electrophotographic image forming apparatus, in some cases, an image defect called "memory" may be caused, in which charging unevenness (charging history or potential unevenness) of the photosensitive drum due to a transfer step of transferring the toner image from the photosensitive drum onto the recording material, appears as density unevenness on an image formed on the recording material. As described above, in the electrophotographic image forming apparatus, the surface of the photosensitive drum has a negative polarity due to the charging processing, and toner having the same polarity as the polarity of the surface of the photosensitive drum adheres to the portion of the photosensitive drum having the light section potential VL so that the toner image is formed. This toner image is directly transferred onto the recording material. In such a configuration, for example, when the recording material is separated away from the photosensitive drum at the transfer nip portion, in some cases, separation electric-discharge may be caused between the photosensitive drum and a trailing edge of the recording material in a conveyance direction, and thus positive charges having the same polarity as the polarity of the transfer voltage may move onto the photosensitive drum. When an amount of positive charges that have moved onto the photosensitive drum exceeds a certain amount, the charges cannot be removed by the charging unit, which may result in causing charging unevenness in which an absolute value of the dark section potential VD in a region on the photosensitive drum in which the separation electric-discharge has been caused is reduced. As a result, the developing contrast in this region becomes larger than those in other regions, and the amount of toner adhering at the time of development is increased, which may result in darkening of the image. As described above, the charging unevenness due to the transfer step may cause a "memory" in a state of a lateral black streak (high density part extending along a rotation axis direction of the photosensitive drum) on an image formed thereafter.

For example, in Japanese Patent Application Laid-Open No. 2001-83812, as a unit for suppressing the occurrence of the "memory," a method of switching a transfer voltage is described, specifically, a method for setting the transfer voltage to a voltage lower than that at the time of transfer, in a non-image portion in which no image formation is performed at a recording material trailing end. When the transfer voltage is set to a voltage value lower than that at the time of transfer, the separation electric-discharge to be caused between the photosensitive drum and the trailing edge of the recording material can be suppressed, and the occurrence of the "memory" can be suppressed.

However, in recent years, along with an increase in printing speed due to improvements in the productivity of image forming apparatuses, a conveyance speed of the recording material inside of the image forming apparatus has also been increased. As a result, a time period in which the non-image portion at the recording material trailing end is conveyed through the transfer nip portion has been reduced. Accordingly, even when the transfer voltage is switched in the non-image portion at the recording material trailing end, in some cases, the transfer voltage may not sufficiently fall (decrease) while the recording material trailing end is conveyed through the transfer nip portion. As a result, in some cases, the occurrence of the separation electric-discharge may not be able to be suppressed, and the "memory" described above may arise. A power supply device for supplying the transfer voltage includes, for example, a transformer, a drive circuit for driving the transformer, and a rectifier circuit. The power supply device rectifies and smooths a voltage boosted by the transformer, to thereby generate a transfer voltage being a DC high voltage. Further, in order to suppress the occurrence of the "memory," hitherto, causing the transfer voltage to fall fast has been achieved by decreasing an electrostatic capacitance of a capacitor used in the rectifier circuit.

However, although a fast reduction in the transfer voltage can be caused by decreasing the electrostatic capacitance of the capacitor used in the rectifier circuit, an undershoot may be caused, or a ripple voltage of the transfer voltage may be increased. Such phenomena may lead to image defects of the toner image to be formed on the recording material.

SUMMARY

Various embodiments of the present disclosure provide techniques and mechanisms to suppress occurrence of an image defect caused by a transfer step.

According to a first embodiment, there is provided an image forming apparatus, comprising: an image bearing member; a transfer portion which forms a nip portion together with the image bearing member, and is configured to transfer a toner image formed on the image bearing member onto a recording material; a transfer power supply portion configured to output a transfer voltage to the transfer portion so as to transfer the toner image onto the recording material, the transfer power supply portion including: a first power supply portion configured to output a voltage having a positive polarity, the first power supply portion including: a first transformer including a primary coil and a secondary coil; a first switching portion configured to perform a switching operation of a current flowing through the primary coil based on a drive signal; and a first rectifier circuit portion configured to rectify and amplify an AC voltage generated in the secondary coil of the first transformer by the switching operation of the first switching portion, and to output an amplified voltage; and a second power supply portion configured to output a voltage having a negative polarity, wherein the transfer power supply portion is configured to superimpose the voltage output from the first power supply portion and the voltage output from the second power supply portion so as to output a superimposed voltage to the transfer portion as the transfer voltage; and a controller configured to control the transfer power supply portion by outputting the drive signal to the first switching portion, wherein the first rectifier circuit portion includes a plurality of diodes and a plurality of capacitors, wherein the plurality of capacitors include a predetermined capacitor to be charged by a half-wave rectified voltage of the AC voltage generated in the secondary coil of the first transformer and a capacitor to be charged by a voltage higher than the half-wave rectified voltage, and wherein a capacitance of the predetermined capacitor is larger than a capacitance of the capacitor to be charged by the voltage higher than the half-wave rectified voltage.

According to a second embodiment, there is provided an image forming apparatus comprising: an image bearing member; a transfer portion which forms a nip portion together with the image bearing member, and is configured to transfer a toner image formed on the image bearing member onto a recording material; a transfer power supply portion configured to output a transfer voltage to the transfer portion so as to transfer the toner image onto the recording material, the transfer power supply portion including: a first power supply portion configured to output a voltage having a positive polarity, the first power supply portion including: a first transformer including a primary coil and a secondary coil; a first switching portion configured to perform a switching operation of a current flowing through the primary coil based on a drive signal; and a first rectifier circuit portion configured to rectify and amplify an AC voltage generated in the secondary coil of the first transformer by the switching operation of the first switching portion, and to output an amplified voltage; and a second power supply portion configured to output a voltage having a negative polarity, wherein the transfer power supply portion is configured to superimpose the voltage output from the first power supply portion and the voltage output from the second power supply portion so as to output a superimposed voltage to the transfer portion as the transfer voltage; and a controller configured to control the transfer power supply portion by outputting the drive signal to the first switching portion, wherein the first rectifier circuit portion includes a plurality of diodes and a plurality of capacitors, wherein the plurality of capacitors include a first capacitor group establishing series connection without interposing the plurality of diodes between the first transformer and an output terminal of the first rectifier circuit portion and a second capacitor group excluding the first capacitor group among the plurality of capacitors, and wherein a capacitance of a predetermined capacitor to be charged by a half-wave rectified voltage of the AC voltage generated in the secondary coil of the first transformer is larger than a capacitance of a capacitor included in the second capacitor group, which is different from the predetermined capacitor.

According to a third embodiment, there is provided an image forming apparatus comprising: an image bearing member; a transfer portion which forms a nip portion together with the image bearing member, and is configured to transfer a toner image formed on the image bearing member onto a recording material; a power supply portion configured to output a transfer voltage to the transfer portion so as to transfer the toner image onto the recording material, the power supply portion including: a transformer including a primary coil and a secondary coil; a switching portion configured to perform a switching operation of a current flowing through the primary coil based on a drive signal; and a rectifier circuit portion configured to rectify and amplify an AC voltage generated in the secondary coil of the transformer by the switching operation of the switching portion, and to output an amplified voltage to the transfer portion; and a controller configured to control the power supply portion by outputting the drive signal to the switching portion, wherein the rectifier circuit portion includes a plurality of diodes and a plurality of capacitors, wherein the plurality of capacitors include a first capacitor group establishing series connection without interposing the plurality of diodes between the transformer and an output terminal configured to output the voltage to the transfer portion and a second capacitor group excluding the first capacitor group among the plurality of capacitors, and wherein a capacitance of a capacitor included in the second capacitor group is smaller than a capacitance of a capacitor included in the first capacitor group.

Further features of the present disclosure will become apparent from the following description of example embodiments with reference to the attached drawings.

DESCRIPTION OF THE EMBODIMENTS

Next, various example embodiments of the present disclosure are described in detail with reference to the drawings.

First Embodiment

In a first embodiment, a circuit configuration is described for preventing an undershoot from being caused when rapid reduction of a transfer voltage is performed. The undershoot refers to a case in which the transfer voltage is excessively decreased to be lower than a desired transfer voltage. In a case in which occurrence of a "memory" is to be suppressed by a method of applying a transfer roller with a transfer voltage having a negative polarity opposite to a polarity at the time of transfer, when the transfer voltage is excessively decreased due to the undershoot, charges having a negative polarity are excessively applied from the transfer roller to a photosensitive drum. As a result, when the charging processing is next performed by a charging unit, in some cases, charging unevenness may be caused on the surface of the photosensitive drum, and thereafter density unevenness, that is, a "memory" may be caused in an image formed on the photosensitive drum. As described above, the "memory" includes two types of "memories." In order to distinguish the two types of "memories," in the following, a memory to be caused when separation electric-discharge causes charging of the same polarity (positive polarity) as the polarity of the transfer voltage to be performed on the photosensitive drum is referred to as "positive memory," and a memory to be caused when a transfer voltage having a negative polarity is applied to the transfer roller is referred to as "negative memory."

[Configuration of Image Forming Apparatus]

Figure 1:
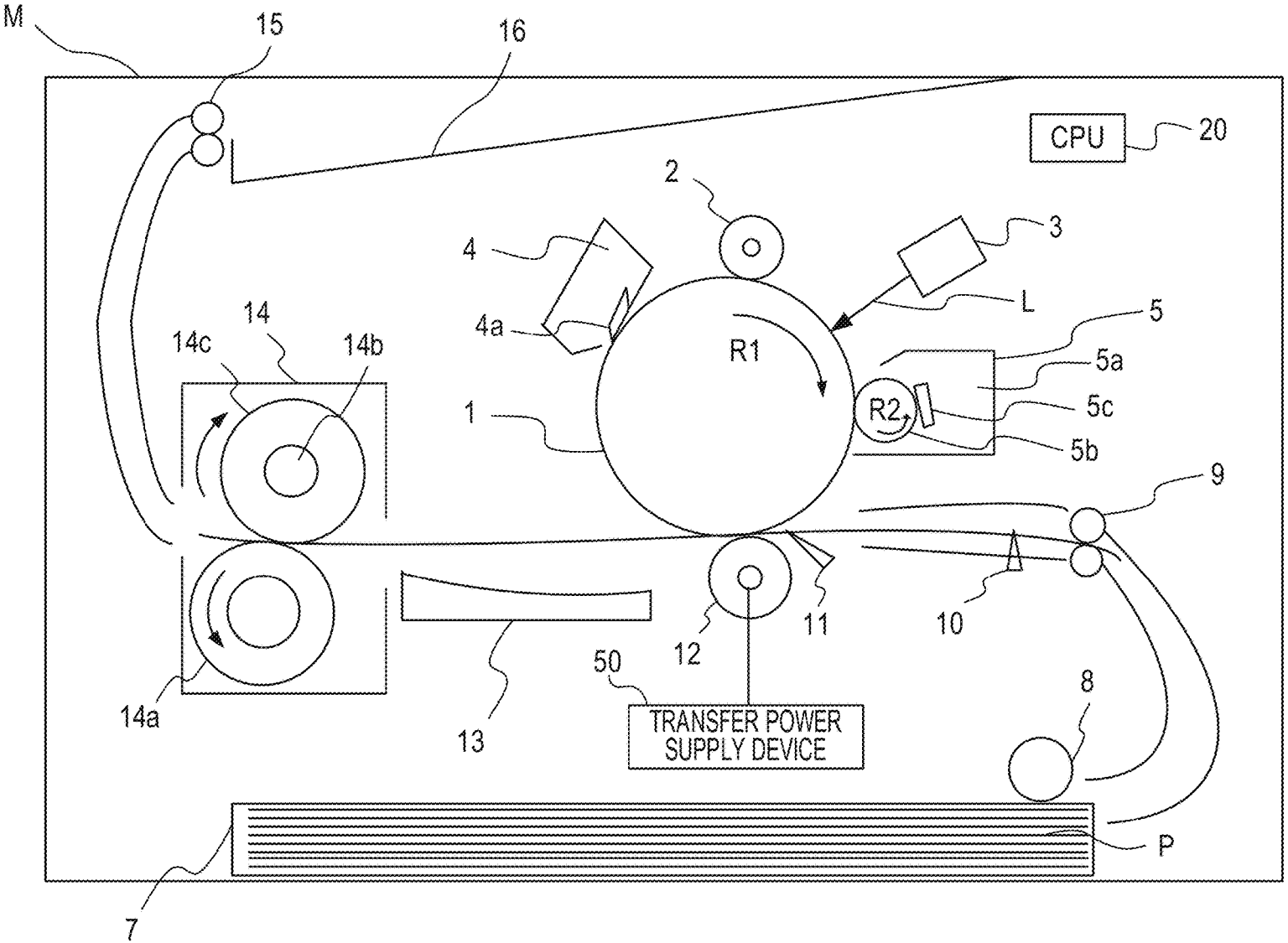
FIG. 1 is a schematic view for illustrating a schematic configuration of an image forming apparatus according to a first embodiment and a second embodiment.

FIG. 1 is a sectional view for illustrating a schematic configuration of an electrophotographic image forming apparatus M to which the present disclosure is applied. The image forming apparatus M includes a photosensitive drum 1, a charging roller 2, and an exposure device 3. The photosensitive drum 1 corresponds to a photosensitive member. The charging roller 2 corresponds to a charger configured to charge a surface of the photosensitive drum 1 to a uniform polarity and a uniform potential. The exposure device 3 corresponds to an exposure portion configured to expose the surface of the photosensitive drum 1 with a light beam corresponding to image information, to thereby form an electrostatic latent image. Further, the image forming apparatus M includes a developing device 5 configured to develop the electrostatic latent image formed on the photosensitive drum 1 (on the photosensitive drum). The developing device 5 corresponding to a developing portion includes a developing toner storage portion 5*a*, a developing roller 5*b*, and a developing blade 5*c*. The developing device 5 causes toner to adhere to the electrostatic latent image formed on the photosensitive drum 1, to thereby form a toner image. Further, the image forming apparatus M includes a transfer roller 12, a waste toner container 4, and a cleaning member 4*a*. The transfer roller 12 is for use in transferring the toner image formed on the photosensitive drum 1 onto a recording material P. The waste toner container 4 and the cleaning member 4*a* are for use in collecting the toner that remains on the surface of the photosensitive drum 1 without being transferred onto the recording material P. The photosensitive drum 1, the charging roller 2, the developing device 5, and the waste toner container 4 form an image forming portion. Further, the image forming portion is integrated as a process cartridge, and is removably mounted to the image forming apparatus M. Further, in the process cartridge, the photosensitive drum 1 is rotatably supported by the image forming apparatus M, and is driven by a drive source (not shown) to rotate at a circumferential speed of 250 mm/sec as a process speed in an arrow R1 direction (clockwise direction) of FIG. 1.

At a lower portion of the image forming apparatus M, a feed cassette 7 for storing paper or other recording materials P is arranged. The image forming apparatus M includes, along a conveyance path of the recording material P, a feed roller 8, a conveyance roller pair 9, and a top sensor 10. The feed roller 8 feeds the recording material P from the feed cassette 7. The conveyance roller pair 9 conveys the recording material P fed by the feed roller 8. The top sensor 10 corresponds to a detector configured to detect the recording material P conveyed through the conveyance path. Further, the image forming apparatus M includes a pre-transfer guide 11, a conveyance guide 13, and a fixing device 14. The pre-transfer guide 11 guides the conveyed recording material P to the transfer roller 12 corresponding to the transfer portion. The conveyance guide 13 guides the recording material P that has passed over the transfer roller 12 to the fixing device 14. The fixing device 14 fixes the toner image formed on the recording material P to the recording material P.

Further, the image forming apparatus M includes delivery rollers 15 configured to deliver the recording material P that has passed through the fixing device 14 to a delivery tray 16. A CPU 20 corresponding to a controller performs various types of control including an image forming operation of the image forming apparatus M.

[Image Forming Operation of Image Forming Apparatus]

Next, the image forming operation of the image forming apparatus M is described. When the CPU 20 receives, from an external apparatus (not shown), a print job of instructing the image forming apparatus M to form an image onto the recording material P, the CPU 20 starts control of the image forming operation described below. The drive source (not shown) is driven by the CPU 20, and the surface of the photosensitive drum 1 driven by the drive source to rotate in the arrow R1 direction is uniformly charged to a predetermined polarity and a predetermined potential by the charging roller 2. The photosensitive drum 1 subjected to the charging processing is irradiated with a laser light L corresponding to the image information included in the print job by the exposure device 3, for example, a laser optical system. Thus, charges in an exposed part irradiated with the laser light L are removed so that an electrostatic latent image is formed. The electrostatic latent image formed on the photosensitive drum 1 is developed by the developing device 5. The developing device 5 coats the developing roller 5*b* with toner stored in the developing toner storage portion 5*a*, rotates the developing roller 5*b* in an R2 direction (counterclockwise direction) of FIG. 1, and also forms, by the developing blade 5*c*, a toner layer applied with triboelectric charges on the surface of the developing roller 5*b*. Then, a developing voltage is applied to the developing roller 5*b*. In this manner, the toner adheres to the electrostatic latent image formed on the photosensitive drum 1 so that the electrostatic latent image is developed, and thus the toner image is formed.

Meanwhile, the recording materials P are stored in the feed cassette 7, and are fed from the feed cassette 7 one by one by the feed roller 8. The fed recording material P is conveyed through the conveyance path by the conveyance roller pair 9. The recording material P conveyed through the conveyance path has its leading edge in the conveyance direction detected by the top sensor 10, and the top sensor 10 notifies the CPU 20 of the detection. The CPU 20 performs conveyance control of the recording material P so that the timing at which the toner image formed on the photosensitive drum 1 moves to a transfer nip portion formed by bringing the photosensitive drum 1 and the transfer roller 12 into abutment against each other and the timing at which the recording material P is conveyed to the transfer nip portion are synchronized with each other. Then, the recording material P conveyed through the conveyance path is conveyed to the transfer nip portion by the pre-transfer guide 11.

At the transfer nip portion, the transfer roller 12 is applied with a transfer voltage having a polarity (positive polarity) opposite to a charging polarity (negative polarity) of toner from a transfer power supply device 50 corresponding to a transfer power supply portion. In this manner, the toner image formed on the photosensitive drum 1 is transferred onto the recording material P. The recording material P having the toner image transferred thereon is conveyed to the fixing device 14 along the conveyance guide 13. The fixing device 14 includes a fixing roller 14*c* and a pressure roller 14*a*. The fixing roller 14*c* incorporates a heater 14*b*, and heats the toner image formed on the recording material P. The pressure roller 14*a* is brought into abutment against the fixing roller 14*c* to form a nip portion, and applies pressure to the toner image formed on the recording material P. The fixing device 14 applies heat and pressure to an unfixed toner image of the recording material P nipped and conveyed through the nip portion, to thereby fix the toner image to the recording material P. The recording material P having the toner image fixed thereto in the fixing device 14 is thereafter delivered by the delivery rollers 15 onto the delivery tray 16 formed on an upper surface of the image forming apparatus M.

Meanwhile, toner (transfer residue toner) that remains on the surface of the photosensitive drum 1 without being transferred onto the recording material P at the transfer nip portion is removed by the cleaning member 4*a* so as to be collected into the waste toner container 4. The above-mentioned image forming operation is repeated so that image formation onto the recording material P is performed.

In general, the photosensitive drum 1 has a configuration in which a photosensitive material such as an organic photo-conductor (OPC), amorphous selenium, or amorphous silicon is provided on a drum-shaped (cylinder-shaped) base member (conductive base member) made of aluminum, nickel, or the like. The photosensitive drum 1 to be used in the first embodiment is a negatively-chargeable OPC photosensitive member having an outside diameter of 24 mm, and includes, on the surface of the conductive base member formed of an aluminum cylinder, a photosensitive layer in which a charge generating layer and a charge transporting layer are laminated in the stated order from the conductive base member side.

The charging roller 2 includes, for example, a conductive base shaft also serving as an electrode to be applied with a charging voltage, and an elastic layer surrounding, in a cylindrical shape, an outer peripheral surface of the conductive base shaft. The charging roller 2 to be used in the first embodiment has a roller outside diameter of 10 mm, a core metal diameter of 5 mm, and an elastic layer thickness of 2.5 mm. For the core metal, a stainless steel is used. For the elastic layer, a rubber mixture of NBR and epichlorohydrin is used.

The transfer roller 12 includes, for example, a conductive base shaft also serving as an electrode to be applied with a transfer voltage, and an elastic layer surrounding, in a cylindrical shape, an outer peripheral surface of the conductive base shaft. For the elastic layer, in general, a semi-conductive rubber material such as EPDM, NBR, urethane rubber, epichlorohydrin, or silicone rubber is used. The transfer roller 12 to be used in the first embodiment has a roller outside diameter of 14 mm, a core metal diameter of 5 mm, an elastic layer thickness of 4.5 mm, and a hardness (Asker C hardness) of 30°. For the core metal, a stainless steel is used. For the elastic layer, a rubber mixture of NBR and epichlorohydrin is used. Further, a press-contact force of the transfer roller 12 to the photosensitive drum 1 is 9.8 N (1 kgf).

In the first embodiment, the surface of the photosensitive drum 1 is charged by the charging roller 2 to have a dark section potential VD of −500 V, and has a light section potential VL of roughly −100 V after the exposure by the exposure device 3. Further, the charging roller 2 is applied with a voltage of −1,000 V from a negative polarity power supply circuit (FIG. 3A) of the transfer power supply device 50 configured to generate the charging voltage. Further, the toner is negatively charged by the developing device 5, and the developing roller 5*b* is applied with −350 V as the developing voltage. Then, when the transfer roller 12 is applied with a voltage having a positive polarity from the transfer power supply device 50, the toner image formed on the photosensitive drum 1 is transferred onto the recording material P.

In the first embodiment, the negatively charged toner is used, but the present disclosure is not limited thereto. Even when positively charged toner is used, the present disclosure is similarly applicable. When the positively charged toner is used, the photosensitive drum 1 is positively charged by the charging roller 2, and the transfer roller 12 is applied with a transfer voltage having a negative polarity. In this manner, the toner image formed on the photosensitive drum 1 is transferred onto the recording material P.

[Measurement of Volume Resistance Value of Transfer Roller]

Figure 2:
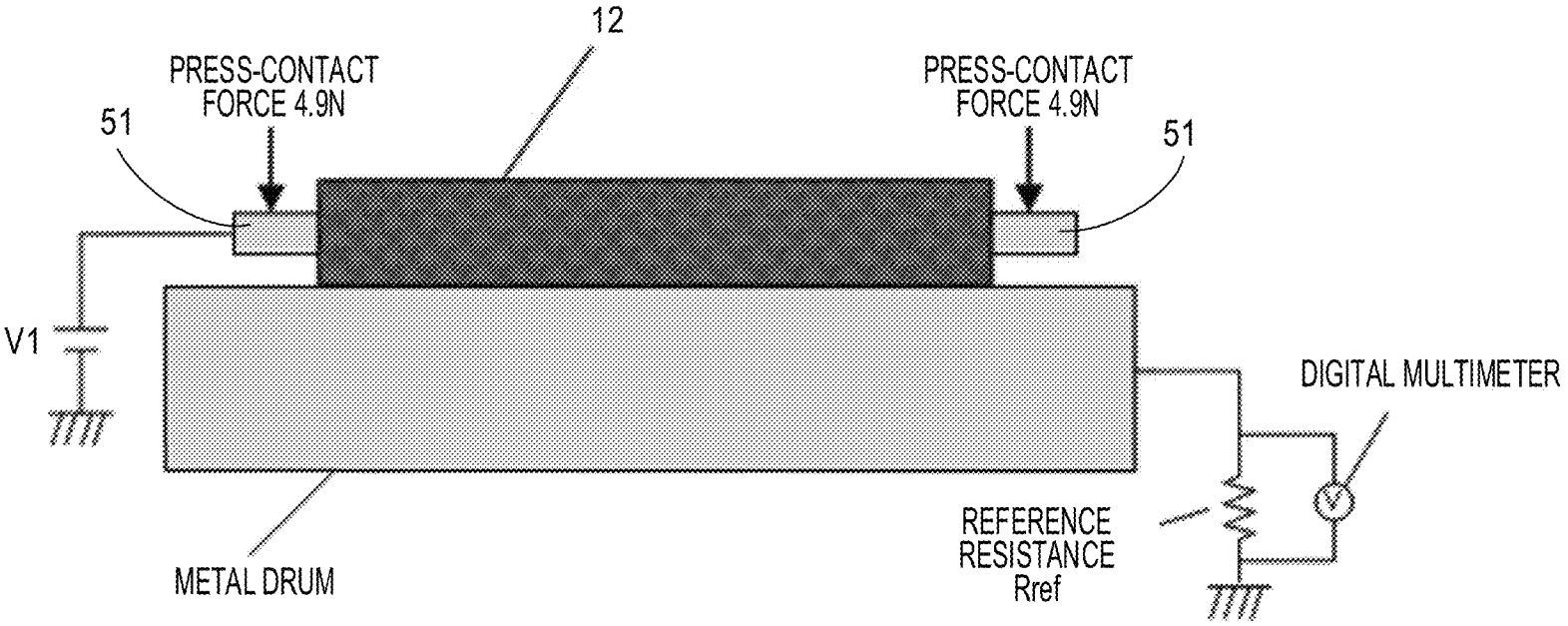
FIG. 2 is a view for illustrating a method of measuring a volume resistance value of a transfer roller in the first embodiment and the second embodiment.

Next, a measurement method for a volume resistance value of the transfer roller 12 is described. FIG. 2 is a schematic view for illustrating an outline of the measurement method for the volume resistance value of the transfer roller 12. The measurement of the volume resistance value of the transfer roller 12 is performed under an environment having a temperature of 23° C. and a humidity of 50%. As illustrated in FIG. 2, a press-contact force of 4.9 N is applied at each of both ends of a core metal 51 of the transfer roller 12 so that the transfer roller 12 is pressed against a metal drum at a press-contact force of 9.8 N. Then, a voltage Vref generated across both ends of a reference resistance Rref when a voltage V1 is applied to the core metal 51 of the transfer roller 12 is measured by a digital multimeter (manufactured by Fluke Corporation). In the first embodiment, the voltage V1 applied to the core metal 51 is set to 2,000 V, and a resistance value of the reference resistance Rref is set to 1,000Ω. A voltage generated across both ends of the reference resistance Rref after an elapse of 10 seconds from when the voltage is applied to the core metal 51 is measured. Here, an average value of voltages generated across both ends of the reference resistance Rref during a measurement time period of 10 seconds is represented by Vref, a value of a current flowing through the reference resistance Rref is represented by Tref, a voltage applied to the transfer roller 12 is represented by Vrol, and a current flowing through the transfer roller 12 is represented by Irol. In this case, a volume resistance Rm of the transfer roller 12 can be obtained by the following (Expression 1).

$$\text{Volume resistance } Rm = \text{voltage } Vrol / \text{current } Irol \quad \text{(Expression 1)}$$

In this case, the voltage Vrol and the current Irol can be obtained by the following (Expression 2) and (Expression 3).

$$\text{Voltage } Vrol = \text{voltage } V1 - \text{voltage } Vref \quad \text{(Expression 2)}$$

$$\text{Current } Irol = \text{voltage } Vref / \text{reference resistance } Rref \quad \text{(Expression 3)}$$

Then, when (Expression 2) and (Expression 3) are substituted into (Expression 1), the following (Expression 4) is obtained.

$$\text{Volume resistance } Rm = (\text{voltage } V1 - \text{voltage } Vref) \times \text{reference resistance } Rref / \text{voltage } Vref \quad \text{(Expression 4)}$$

From (Expression 4), the volume resistance Rm of the transfer roller 12 can be obtained based on the voltage Vref measured by the above-mentioned measurement method.

The volume resistance Rm of the transfer roller 12 in the first embodiment is suitable when falling within a range of from $1.0\times10^{6}\Omega$ to $5.0\times10^{9}\Omega$. For example, when the volume resistance of the transfer roller 12 is smaller than $1.0\times10^{6}\Omega$, in some cases, the toner image formed on the photosensitive drum 1 cannot be sufficiently transferred when being transferred onto the recording material P. The reason is as follows. The volume resistivity of general paper to be used as the recording material P is from $1.0\times10^{4}\Omega\cdot m$ to $1.0\times10^{13}\Omega\cdot m$. Accordingly, when the volume resistance Rm of the transfer roller 12 is smaller than $1.0\times10^{6}\Omega$, a transfer current is less likely to flow from the transfer roller 12 to the recording material P at the time of transfer. Meanwhile, when the volume resistance Rm is larger than $5.0\times10^{9}\Omega$, a transfer voltage required for causing a desired transfer current to flow becomes excessively large, and hence the cost of the transfer power supply device 50 configured to supply the transfer voltage is increased. In view of the above, in the first embodiment, the transfer roller 12 having the volume resistance Rm of $1.0\times10^{8}\Omega$ is used.

[Configuration of Transfer Power Supply Device]

Figure 3A:
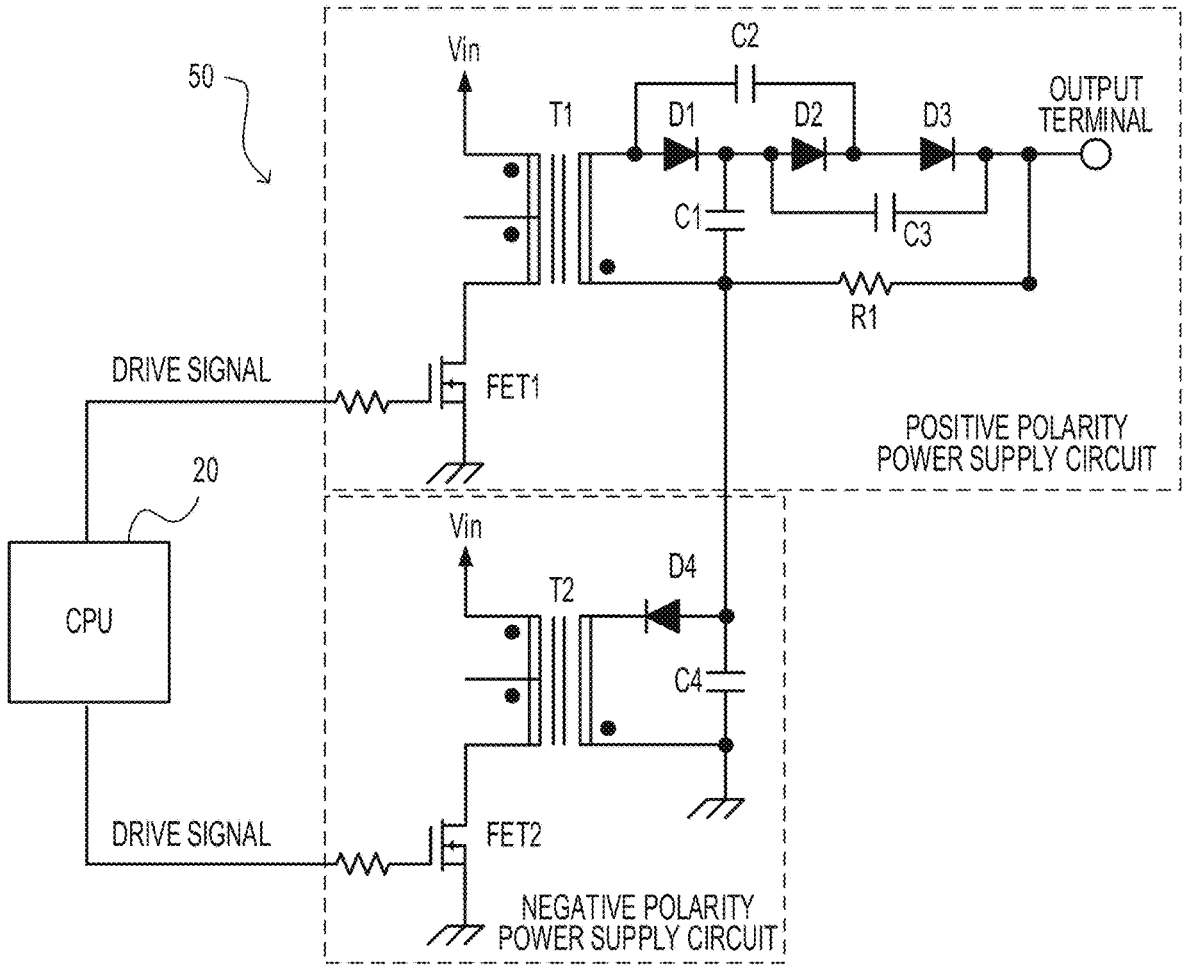
FIG. 3A is a schematic circuit diagram for illustrating a circuit configuration of a transfer power supply device in the first embodiment and the second embodiment.

Next, the transfer power supply device 50 configured to supply the transfer voltage to the transfer roller 12 is described. FIG. 3A is a circuit diagram for illustrating a main circuit configuration of the transfer power supply device 50 in the first embodiment. The transfer power supply device 50 illustrated in FIG. 3A includes a positive polarity power supply circuit configured to generate a voltage having a positive polarity, and a negative polarity power supply circuit configured to generate a voltage having a negative polarity. In the transfer power supply device 50, the positive voltage output from the positive polarity power supply circuit and the negative voltage output from the negative polarity power supply circuit are superimposed with each other, and superimposed voltages are output from an output terminal as the transfer voltage. The transfer voltage is applied to the transfer roller 12, and the negative voltage output from the negative polarity power supply circuit is applied to the charging roller 2.

The positive polarity power supply circuit (first power supply portion) includes a transformer T1 (first transformer) and a field effect transistor 1 (hereinafter referred to as "FET 1"). The transformer T1 includes a primary coil and a secondary coil. The FET 1 corresponds to a first switching portion to be switched in response to a drive signal output from the CPU 20. Further, the positive polarity power supply circuit includes, on a secondary side of the transformer T1, a rectifier circuit (first rectifier circuit portion) configured to rectify a voltage induced on the secondary side of the transformer T1. The rectifier circuit includes a plurality of diodes D1, D2, and D3, a plurality of capacitors C1, C2, and C3, and a resistor R1. One end of the secondary coil of the transformer T1 is connected to an anode terminal of the diode D1 (first diode) and one end of the capacitor C2 (second capacitor). A cathode terminal of the diode D1 is connected to an anode terminal of the diode D2 (second diode) and one end of each of the capacitors C1 and C3. A cathode terminal of the diode D2 is connected to an anode terminal of the diode D3 (third diode) and another end of the capacitor C2. A cathode terminal of the diode D3 is connected to another end of the capacitor C3 (third capacitor), one end of the resistor R1, and the output terminal. Further, another end of the secondary coil of the transformer T1 is connected to another end of the capacitor C1 (first capacitor) and another end of the resistor R1. In the positive polarity power supply circuit, the FET 1 repeats a switching operation in response to the drive signal output from the CPU 20 so that the transformer T1 is driven. Thus, a DC voltage having a positive polarity is generated by the rectifier circuit provided on the secondary side of the transformer T1.

Meanwhile, the negative polarity power supply circuit (second power supply portion) includes a transformer T2 and a field effect transistor 2 (hereinafter referred to as "FET 2"). The transformer T2 includes a primary coil and a secondary coil. The FET 2 corresponds to a second switching portion to be switched in response to a drive signal output from the CPU 20. Further, the negative polarity power supply circuit includes, on a secondary side of the transformer T2 (second transformer), a rectifier circuit (second rectifier circuit portion) configured to rectify a voltage induced on the secondary side of the transformer T2. The rectifier circuit includes a diode D4 and a capacitor C4. One end of the secondary coil of the transformer T2 is connected to a cathode terminal of the diode D4 (seventh diode), and another end of the secondary coil of the transformer T2 is connected to one end of the capacitor C4 (seventh capacitor) and the ground. An anode terminal of the diode D4 is connected to another end of the capacitor C4, the another end of the capacitor C1 of the rectifier circuit (first rectifier circuit portion) of the positive polarity power supply circuit, and the another end of the resistor R1. In the negative polarity power supply circuit, the FET 2 repeats a switching operation in response to the drive signal output from the CPU 20 so that the transformer T2 is driven. Thus, a DC voltage having a negative polarity is generated by the rectifier circuit provided on the secondary side of the transformer T2.

In this case, the rectifier circuit of the negative polarity power supply circuit is a half-wave rectifier circuit, whereas the rectifier circuit of the positive polarity power supply circuit is a voltage tripler rectifier circuit configured to multiply (amplify) the voltage induced on the secondary side. The reason therefor is because it is required that the positive polarity power supply circuit to be used at the time of transfer output a voltage higher than that of the negative polarity power supply circuit. Further, in general, when a high voltage is attempted to be output through use of one rectifier circuit, in order to prevent discharge and leakage inside of the transformer, covering the transformer and its surrounding with a resin having a high withstanding voltage or other measures are required to be performed, which may greatly increase the cost. Accordingly, using a voltage multiplier rectifier circuit as in the first embodiment provides more advantages in terms of cost.

[Operation at Time of Output of Transfer Voltage]

Figure 3B:
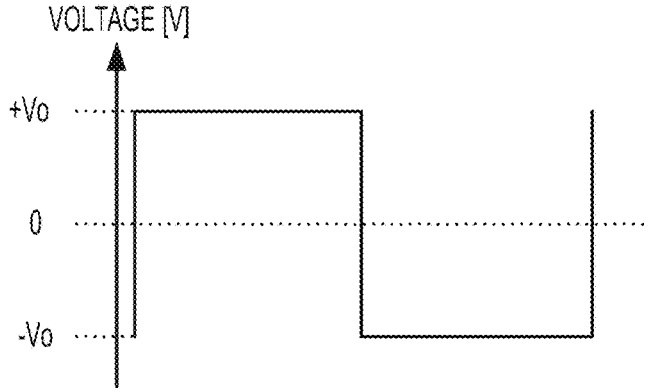
FIG. 3B is a chart for illustrating an output voltage waveform of a transformer in the first embodiment and the second embodiment.

Next, an operation of the transfer power supply device 50 when the transfer voltage is applied to the transfer roller 12 at the time of image formation is described. FIG. 3B is a chart for illustrating a voltage waveform of an AC voltage induced on the secondary side of the transformer T1 and the transformer T2 when, in the transfer power supply device 50, the FET 1 and the FET 2 are repeatedly turned on and off in response to the drive signal output from the CPU 20 so that the transformer T1 and the transformer T2 are driven. FIG. 3B shows a voltage waveform of one period caused on a secondary coil side of the transformer T1 and the transformer T2 of FIG. 3A on which no black dot indicating the start of winding is marked, and shows a square wave voltage waveform of voltages +Vo and −Vo. In FIG. 3B, the vertical axis represents voltage (unit: V), and the horizontal axis represents time.

First, in the positive polarity power supply circuit, when the voltage shown in FIG. 3B is +Vo, the diodes D1 and D3 are in a conductive state, and the diode D2 is in a non-conductive state. Thus, the capacitors C1 and C3 are charged. At this time, the capacitor C1 is charged by +Vo being a half-wave rectified voltage corresponding to an output voltage of the transformer T1, and the capacitor C3 is charged by +2Vo being a double rectified voltage of the output voltage of the transformer T1. In this manner, a voltage of +3Vo is output from the positive polarity power supply circuit. Meanwhile, when the output voltage of the transformer T2 of the negative polarity power supply circuit is as that of FIG. 3B, the capacitor C4 is charged by a voltage of +Vo, and the output voltage of the negative polarity power supply circuit is −Vo. Then, when the voltage of +3Vo is output from the positive polarity power supply circuit, and the voltage of −Vo is output from the negative polarity power supply circuit, the transfer power supply device 50 outputs, as the transfer voltage, +2Vo being a sum of the output voltages of the positive polarity power supply circuit and the negative polarity power supply circuit.

Further, in the positive polarity power supply circuit, when the voltage shown in FIG. 3B is −Vo, the diode D2 is in the conductive state, and the diodes D1 and D3 are in the non-conductive state. At this time, the capacitor C2 is charged by +2Vo being a double rectified voltage of the transformer output.

The operation of the positive polarity power supply circuit illustrated in FIG. 3A is summarized. As described above, an AC voltage shown in FIG. 3B is induced on the secondary side of the transformer T1. Thus, voltages of +Vo, +2Vo, and +2Vo are applied to the capacitor C1, the capacitor C2, and the capacitor C3, respectively, so that the capacitors C1 to C3 are charged. Under this state, when a voltage of +Vo is generated on the secondary coil side of the transformer T1 on which no black dot is marked, the output voltage +Vo of the transformer T1 and the voltage of +2Vo caused by the charges charged in the capacitor C2 are added so that +3Vo is output to the output terminal. Meanwhile, when a voltage of −Vo is generated on the secondary coil side of the transformer T1 on which no black dot is marked, +3Vo is maintained at the output terminal due to the voltage of +Vo caused by the charges charged in the capacitor C1 and the voltage corresponding to +2Vo caused by the charges charged in the capacitor C3.

[Operation at Time of Stop of Output of Transfer Voltage]

Next, a behavior of the transfer power supply device 50 at the time when application of the transfer voltage to the transfer roller 12 is stopped so that the transfer voltage is caused to fall is described. In the transfer power supply device 50 in the first embodiment, in order to cause the transfer voltage to fall fast, only the drive signal to the FET 1 of the positive polarity power supply circuit is stopped while the drive signal to the FET 2 of the negative polarity power supply circuit is continuously output. First, when the drive signal output from the CPU 20 to the FET 1 is stopped so that the FET 1 is turned off, no voltage is induced on the secondary side of the transformer T1, and discharge of charges charged in the capacitors C1, C2, and C3 starts. Immediately after the discharge starts, a charged voltage of the capacitor C2 is smaller than a sum of the charged voltages of the capacitor C1 and the capacitor C3, and hence the diode D3 is not brought into a conductive state. Accordingly, the capacitor C2 is hardly discharged, and a discharge speed of the transfer voltage being the output voltage of the transfer power supply device 50 is determined based on capacitances of the capacitors C1 and C3 connected in series to each other, and on a resistance value of the resistor R1.

As the discharge proceeds and the sum of the charged voltages of the capacitor C1 and the capacitor C3 becomes smaller than the charged voltage of the capacitor C2, the diode D3 is brought into the conductive state, and the capacitor C2 starts to discharge. Accordingly, a capacitance of a capacitor related to the discharge speed of the output voltage is increased by an amount of the capacitance of the capacitor C2 in addition to the capacitances of the capacitors C1 and C3. Thus, the discharge speed is decreased as compared to that before the discharge of the capacitor C2 is started, and the speed of lowering the transfer voltage is decreased.

As the discharge further proceeds and the charged voltage of the capacitor C2 becomes the same as the sum of the charged voltages of the capacitor C1 and the capacitor C3, the discharge speed of the capacitor C2 becomes equal to the discharge speed of the capacitors C1 and C3, and hence the discharge of the capacitor C1 or the capacitor C3 is completed earlier. After the discharge of the capacitor C1 or the capacitor C3 is completed, the capacitance of the capacitor related to the discharge speed of the transfer voltage is changed from the capacitance obtained when the capacitor C1 and the capacitor C3 are connected in series to each other to a capacitance obtained when the capacitance of the capacitor C2 is added to the capacitance of the capacitor C1 or the capacitor C3. As a result, the capacitance value of the capacitor related to the discharge speed of the transfer voltage is increased. Accordingly, the discharge speed of the capacitor is further decreased, and the speed of lowering the transfer voltage is also further decreased. Which of the capacitor C1 and the capacitor C3 completes the discharge earlier is determined based on the capacitance of each capacitor.

As described above, in the transfer power supply device 50 in the first embodiment, when the transfer voltage is caused to fall after the application of the transfer voltage to the transfer roller 12 is ended, the discharge speed of the capacitor is changed two times due to the charged voltages of the capacitors C1, C2, and C3 of the rectifier circuit of the positive polarity power supply circuit. A length of time before the discharge speed of the capacitor is changed and a voltage at the time when the discharge speed of the capacitor is changed can be changed by means of the capacitance value of each capacitor and the resistance value of the resistor R1.

Further, as described above, the negative polarity power supply circuit in the transfer power supply device 50 in the first embodiment also has a role as a charging power supply circuit for applying a voltage having a negative polarity to the charging roller 2. Through use of a shared power supply circuit as described above, the cost can be decreased, and the image forming apparatus M can be downsized. The negative polarity power supply circuit to be shared is not limited to the charging power supply circuit, and may be other power supply circuits to be used in the image forming apparatus M, for example, the developing device.

[Control of Transfer Voltage]

Next, control of the transfer voltage in the transfer power supply device 50 in the first embodiment is described. The CPU 20 calculates the timing at which a leading edge and a trailing edge of the recording material P in the conveyance direction reach the transfer nip portion, based on the conveyance speed of the recording material P and on the timing at which the top sensor 10 arranged on the upstream of the transfer nip portion detects the leading edge and the trailing edge of the conveyed recording material P. In the first embodiment, the photosensitive drum 1 is driven to rotate at a circumferential speed of 250 mm/sec, and the recording material P is conveyed at roughly the same conveyance speed. In view of the above, the CPU 20 calculates a time period required until the leading edge of the recording material P reaches the transfer nip portion, based on the timing at which the top sensor 10 detects the leading edge of the recording material P, on the conveyance speed of the recording material P, and on a distance from the top sensor 10 to the transfer nip portion. Similarly, the CPU 20 calculates a time period required until the trailing edge of the recording material P reaches the transfer nip portion from the timing at which the top sensor 10 detects the trailing edge of the recording material P. The CPU 20 drives the transfer power supply device 50 based on the thus-calculated timing at which the leading edge and the trailing edge of the recording material P reach the transfer nip portion, to thereby control the transfer voltage.

Figures 4A, 4B, 4C:
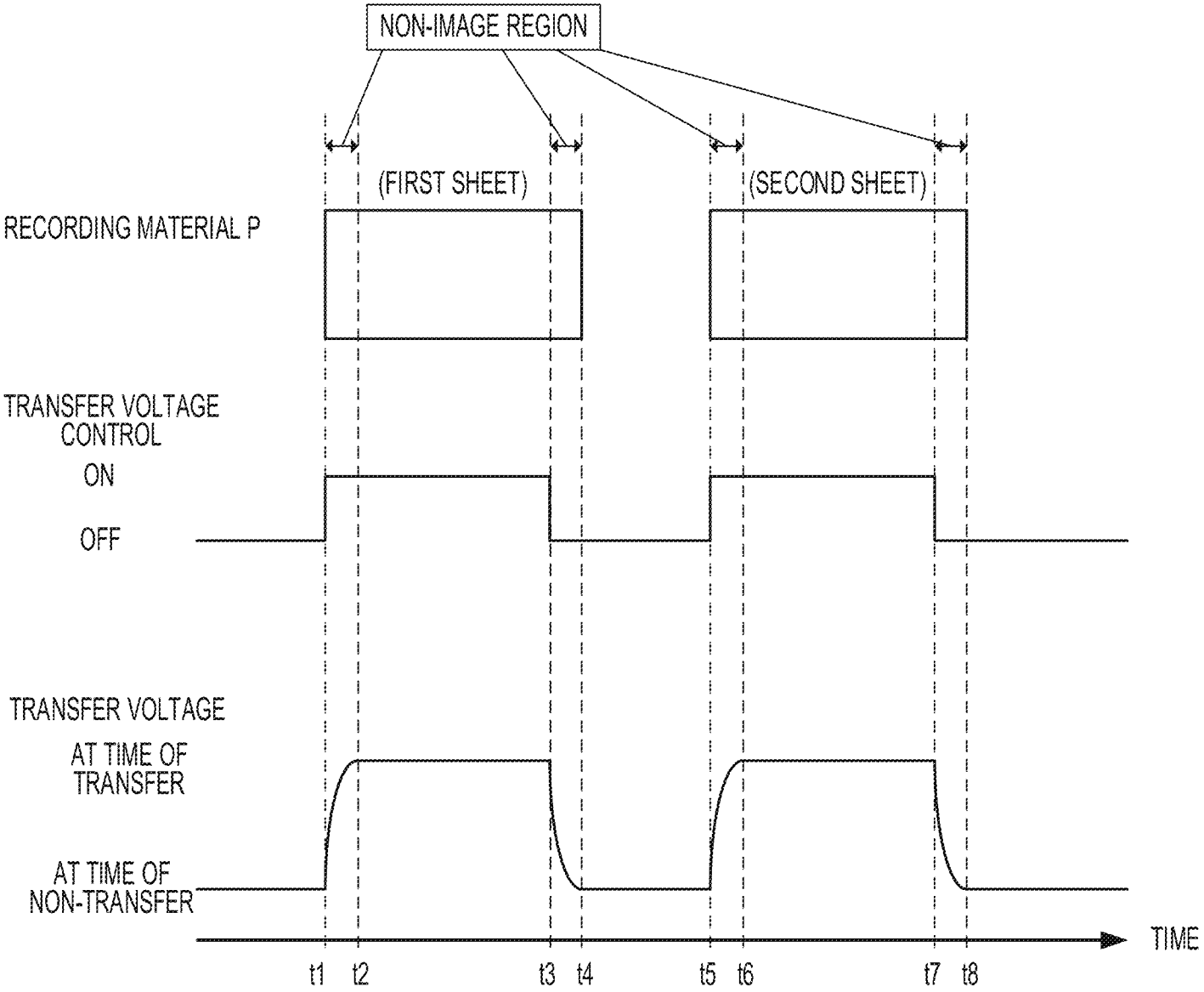
FIG. 4A, FIG. 4B, and FIG. 4C are timing charts for illustrating transfer voltage control in the first embodiment and the second embodiment.

FIG. 4A, FIG. 4B, and FIG. 4C are charts for illustrating a control sequence performed by the CPU 20 to control the transfer voltage of the transfer power supply device 50. FIG. 4A, FIG. 4B, and FIG. 4C are charts for illustrating a state of the transfer voltage to be output from the transfer power supply device 50 when the recording material P is conveyed to the transfer nip portion. FIG. 4A is a view for illustrating a state in which two recording materials P are conveyed to the transfer nip portion. In the first embodiment, a region from each of the leading edge and the trailing edge of the recording material P in the conveyance direction to a portion on the inner side by 5 mm is set as a mask region (non-image region) in which no image formation is performed, and a region on the inner side of the mask region is set as an image region in which the image formation is allowed. Similarly, also on end portion sides of the recording material P in a direction orthogonal to the conveyance direction of the recording material P, a region from each end portion to a portion on the inner side by 5 mm is set as a mask region (non-image region) in which no image formation is performed, and a region on the inner side of the mask region is set as an image region. FIG. 4B shows a period of transfer voltage control of controlling the transfer voltage to be output from the transfer power supply device 50. In FIG. 4B, "OFF" represents a period in which the CPU 20 does not perform the control of the output voltage of the transfer power supply device 50, and "ON" represents a period in which the CPU 20 outputs the drive signal to the FET 1 and the FET 2 of the transfer power supply device 50 so that the transfer voltage is applied to the transfer roller 12. As illustrated in FIG. 4B, the control is turned "ON" at the timing at which the leading edge of the recording material P reaches the transfer nip portion, and the control is turned "OFF" at the timing at which the trailing edge of the recording material P reaches the transfer nip portion. FIG. 4C is a chart for illustrating a voltage value of the transfer voltage to be output from the transfer power supply device 50. "AT TIME OF TRANSFER" represents a transfer voltage to be output during a period in which the toner image formed on the photosensitive drum 1 is transferred onto the recording material P, and "AT TIME OF NON-TRANSFER" represents a transfer voltage during a period in which the transfer of the toner image formed on the photosensitive drum 1 is not performed onto the recording material P. In FIG. 4A, FIG. 4B, and FIG. 4C, the horizontal axis represents time, and t1 to t8 represent time (timing).

In the first embodiment, the transfer voltage control is turned ON at the timing at which the leading edge of the recording material P reaches the transfer nip portion (times t1 and t5) (FIG. 4B). Then, the CPU 20 controls the transfer voltage to be output by the transfer power supply device 50 so that the transfer voltage rises to reach a voltage value at which the toner image formed on the photosensitive drum 1 can be transferred onto the recording material P by the time when the non-image region at the leading edge of the recording material P reaches the transfer nip portion (times t2 and t6) (FIG. 4C). Meanwhile, the transfer voltage control is turned OFF at the timing at which the portion on the inner side by 5 mm from the trailing edge of the recording material P reaches the transfer nip portion (times t3 and t7) (FIG. 4B). Then, the CPU 20 controls the transfer voltage to be output by the transfer power supply device 50 so that the transfer voltage falls to reach a transfer voltage value at which the above-mentioned "memory" is not caused by the time when the trailing edge of the recording material P exits from (passes through) the transfer nip portion (times t4 and t8) (FIG. 4C). In the image forming apparatus M of the first embodiment, the process speed is 250 mm/sec, and hence a time period required for the recording material P to be moved (conveyed) by 5 mm is about 20 msec. That is, the trailing edge of the recording material P exits from (passes through) the transfer nip portion after an elapse of 20 msec from when the transfer voltage control is turned OFF. Accordingly, in the first embodiment, within a period of 20 msec from when the transfer voltage control is turned OFF (from the timing at which the portion on the inner side by 5 mm from the trailing edge of the recording material P reaches the transfer nip portion), it is required to cause the transfer voltage to fall from the voltage at the time of transfer to the voltage at which no "positive memory" is caused. According to the investigation performed by the inventors, it is found that, in a case in which the image forming apparatus M of the first embodiment is used, no "positive memory" is caused as long as, when the trailing edge of the recording material P exits from the transfer nip portion, the transfer voltage has fallen to be equal to or lower than −100 V being the light section potential VL after the exposure. Further, it is found that the "negative memory" is caused in a case in which, when the trailing edge of the recording material P exits from the transfer nip portion, the transfer voltage is equal to or lower than −500 V being the dark section potential VD after the charging. Accordingly, it is preferred that the transfer voltage of the transfer power supply device 50 be controlled so that, when the trailing edge of the recording material P exits from the transfer nip portion, the transfer voltage is equal to or lower than the light section potential VL after the exposure (equal to or lower than a second transfer voltage) and also equal to or higher than the dark section potential VD (equal to or higher than a third transfer voltage).

[Evaluation Experiment of First Embodiment]

Next, an evaluation experiment of the first embodiment is described. In the evaluation experiment, the capacitances of the capacitors C1, C2, and C3 of the positive polarity power supply circuit of the transfer power supply device 50 in the first embodiment were set to 300 pF, 50 pF, and 50 pF, respectively. Further, as a first comparative example and a second comparative example, evaluation was performed also for the following combinations of capacitor capacitances different from that of the first embodiment. In the first comparative example, the capacitances of the capacitors C1, C2, and C3 were set to 300 pF, 300 pF, and 300 pF, respectively. Meanwhile, in the second comparative example, the capacitances of the capacitors C1, C2, and C3 were set to 50 pF, 50 pF, and 50 pF, respectively.

Further, in the evaluation experiment, the image forming apparatus M was installed under an environment having a temperature of 23° C. and a humidity of 50%, and the printing was performed on the recording material P at a process speed of 250 mm/sec. Further, as the recording material P, Vitality (produced by Xerox Corporation) having a letter (LTR) size and a basis weight of 75 g/m$^2$ was used. Under such an environment, an image having a density of 25% was printed successively on two recording materials P, and whether or not the image formed on the second recording material P had a "positive memory" due to the separation electric-discharge between the photosensitive drum 1 and the trailing edge of the first recording material P was checked. Similarly, at the same time, whether or not there was caused a "negative memory" to be caused when the negative polarity charges were excessively applied from the transfer roller 12 to the photosensitive drum 1 was checked. Further, the transfer voltage at the time when the image region of the recording material P (region on the inner side of the portions on the inner side by 5 mm from the leading edge of the recording material P, the trailing edge thereof, and the end portion of the recording material on the side in the direction orthogonal to the conveyance direction) passed through the transfer nip portion was controlled as follows. That is, the transfer power supply device 50 was controlled so that, in the transfer power supply device 50, the output voltage of the positive polarity power supply circuit was 3,000 V, the output voltage of the negative polarity power supply circuit was −1,000 V, and 2,000 V being a sum of the two voltages was output.

Table 1 is a table for showing experiment results of the evaluation experiment with the combinations of the capacitors C1, C2, and C3 in the first embodiment, the first comparative example, and the second comparative example described above. In Table 1, the experiment results of the first embodiment, the first comparative example, and the second comparative example are arranged in the vertical direction, and the following items are listed in the horizontal direction. That is, in the horizontal direction of Table 1, there are shown the capacitances (unit: pF) of the capacitors C1, C2, and C3, and the transfer voltage (unit: V) at the time when the first recording material P exits from (passes through) the transfer nip portion. Further, in the horizontal direction of Table 1, there are shown whether or not there is an image defect in a state of a lateral black streak accompanying the occurrence of the "positive memory," and whether or not there is an image defect of density unevenness accompanying the occurrence of the "negative memory." The "positive memory" and the "negative memory" were evaluated as x (bad) when the image defect was caused, and as o (good) when no image defect was caused.

TABLE 1

| | Electrostatic capacitance of capacitor [pF] | | | Transfer voltage [V] at time when first recording material exits from transfer | "Positive memory" lateral black | "Negative memory" density |
|---|---|---|---|---|---|---|
| | C1 | C2 | C3 | nip portion | streak | unevenness |
| First embodiment | 300 | 50 | 50 | −300 | ○ | ○ |
| First comparative example | 300 | 300 | 300 | 700 | x | ○ |

TABLE 1-continued

| | Electrostatic capacitance of capacitor [pF] | | | Transfer voltage [V] at time when first recording material exits from transfer | "Positive memory" lateral black | "Negative memory" density |
|---|---|---|---|---|---|---|
| | C1 | C2 | C3 | nip portion | streak | unevenness |
| Second comparative example | 50 | 50 | 50 | −700 | ○ | x |

Figure 5A:
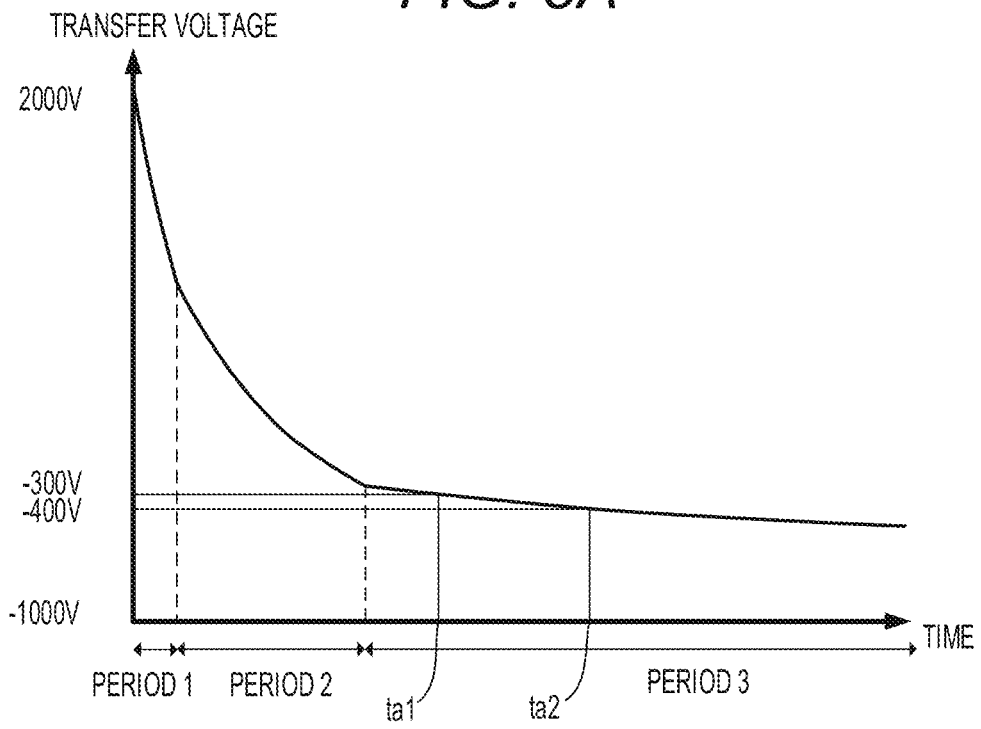
FIG. 5A, FIG. 5B, FIG. 5C, and FIG. 5D are charts for illustrating voltage waveforms at the time of a falling edge of a transfer voltage in the first embodiment and the second embodiment.
Figure 5B:
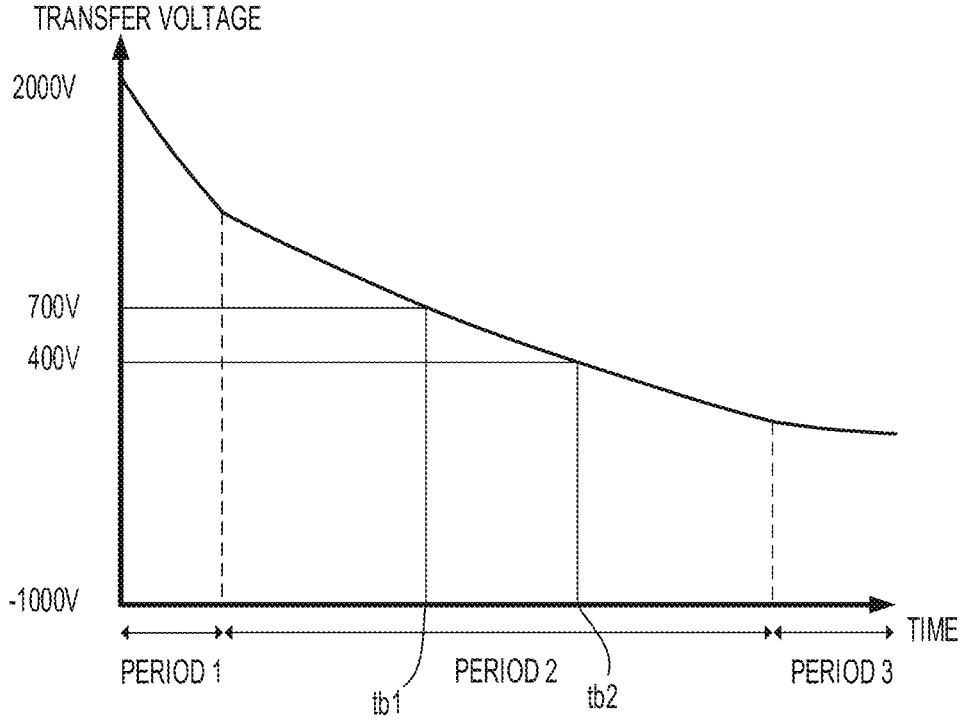
Figure 5C:
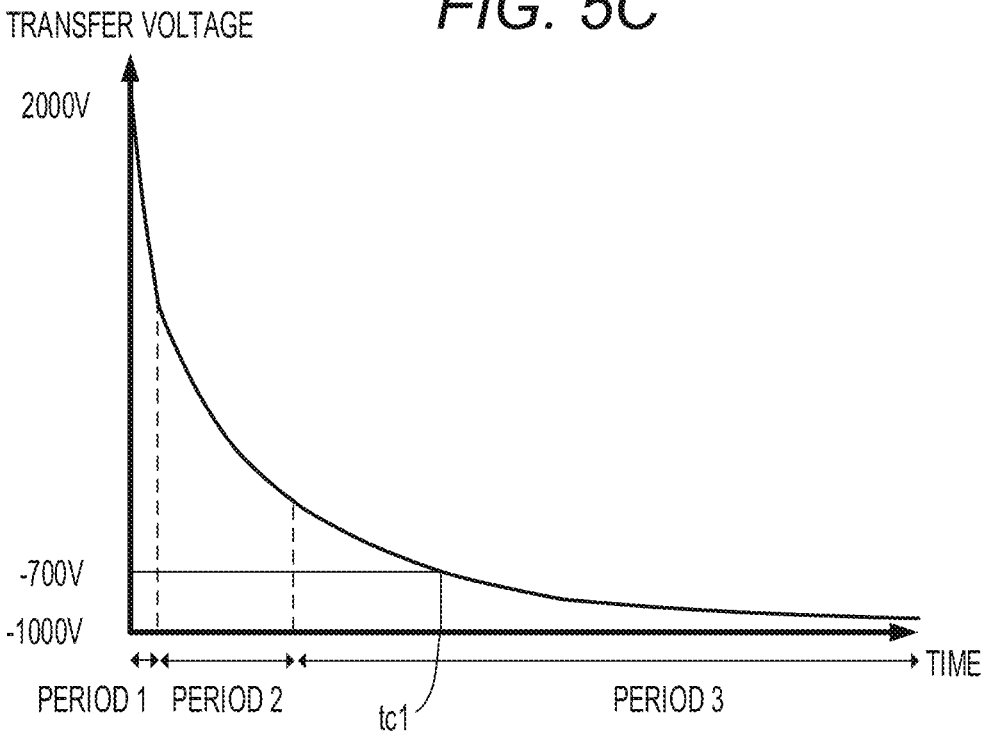
Figure 5D:
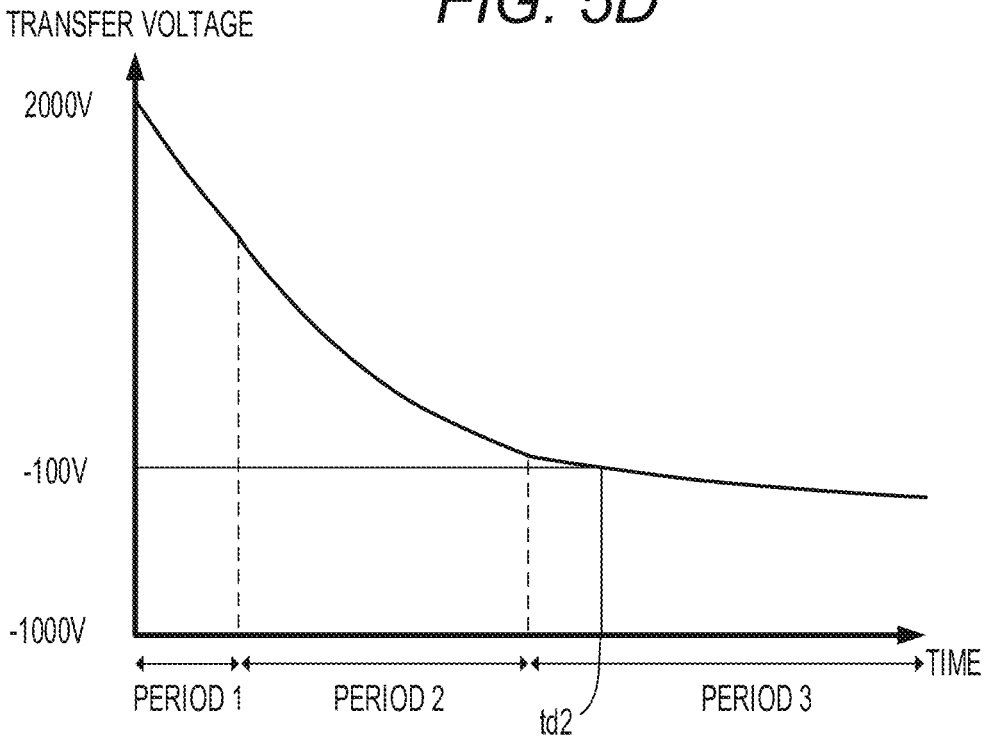

Further, FIG. 5A, FIG. 5B, FIG. 5C, and FIG. 5D are waveform charts for illustrating a falling state of the transfer voltage in a case in which the transfer voltage control is turned "OFF" while the above-mentioned evaluation experiment is performed. FIG. 5A shows the falling state of the transfer voltage in the first embodiment, FIG. 5B shows the falling state of the transfer voltage in the first comparative example, FIG. 5C shows the falling state of the transfer voltage in the second comparative example, and FIG. 5D shows the falling state of the transfer voltage in a second embodiment to be described later. In FIG. 5A, FIG. 5B, FIG. 5C, and FIG. 5D, the vertical axis represents voltage, the horizontal axis represents time, and ta1 and ta2 of FIG. 5A, tb1 and tb2 of FIG. 5B, tc1 of FIG. 5C, and td2 of FIG. 5D represent time (timing).

Further, in the horizontal axis of FIG. 5A, FIG. 5B, FIG. 5C, and FIG. 5D, a "period 1," a "period 2," and a "period 3" represent the following periods. That is, the "period 1" is a period from when the output of the transfer voltage from the transfer power supply device 50 is stopped so that the discharge of the capacitor is started to when the charged voltages of the capacitors C1 and C3 connected in series to each other become equal to the charged voltage of the capacitor C2. The "period 2" is a period from when the charged voltages of the capacitors C1 and C3 connected in series to each other become equal to the charged voltage of the capacitor C2 to when one of the capacitor C1 and the capacitor C3 is discharged so that the charged voltage becomes 0. The "period 3" is a period from when one of the capacitor C1 and the capacitor C3 is discharged so that the charged voltage becomes 0 to when the charged voltage of another one of the capacitor C1 and the capacitor C3 and the charged voltage of the capacitor C2 are discharged so that the charged voltages become 0. In the period 1, the discharge speed is determined based on the resistance value of the resistor R1 and the capacitances of the capacitor C1 and the capacitor C3 connected in series to each other. In the period 2, the capacitance of the capacitor C2 is added with respect to the period 1, and hence the discharge speed becomes somewhat lower than that of the period 1. In the period 3, the discharge of the capacitor C1 or the capacitor C3 is completed, and the capacitance related to discharge becomes a capacitance obtained when the capacitor C1 or the capacitor C3 and the capacitor C2 are connected in parallel to each other. Accordingly, the discharge speed becomes further lower than that of the period 2.

As shown in Table 1, in the combination of the capacitances of the capacitors C1, C2, and C3 in the first embodiment, no lateral black streak accompanying the occurrence of the "positive memory" was caused, and also no density unevenness accompanying the occurrence of the "negative memory" was caused. As shown in Table 1, the transfer voltage at the time when the first recording material P exited from (passed through) the transfer nip portion (time ta1 of FIG. 5A) was −300 V. In the first embodiment, the capacitances of the capacitors C1, C2, and C3 were set to 300 pF, 50 pF, and 50 pF, respectively. In this manner, the transfer voltage was able to rapidly fall (decrease) so that the transfer voltage at the time when the trailing edge of the recording material P exited from the transfer nip portion was equal to or lower than −100 V at which no "positive memory" was caused. Further, the transfer voltage at the time when the trailing edge of the recording material P exited from the transfer nip portion was able to be maintained to be equal to or higher than −500 V at which no "negative memory" was caused. In this manner, the occurrence of the "memory" was suppressed, and a satisfactory image was able to be obtained.

Further, the voltage waveform of the falling edge of the transfer voltage in the case of the first embodiment is as illustrated in FIG. 5A. In the first embodiment, in the rectifier circuit of the positive polarity power supply circuit of the transfer power supply device 50, the capacitances of the capacitors C2 and C3 to be charged by the double rectified voltage of the output voltage of the transformer T1 are decreased so that the discharge speeds in the period 1 and the period 2 are increased. In this manner, there is achieved the falling edge of the transfer voltage to a voltage at which no "positive memory" is caused by the time when the trailing edge of the recording material P exits from the transfer nip portion. Further, the capacitance of the capacitor C1 to be charged by the half-wave rectified voltage of the output voltage of the transformer T1 is increased so that the falling speed of the transfer voltage in the period 3 is decreased. In this manner, there is achieved maintaining the transfer voltage to a voltage at which no "negative memory" is caused.

Meanwhile, as shown in Table 1, in the combination of the capacitances of the capacitors C1, C2, and C3 in the first comparative example, no density unevenness accompanying the occurrence of the "negative memory" was caused, but the lateral black streak accompanying the occurrence of the "positive memory" was caused. As shown in Table 1, the transfer voltage at the time when the first recording material P exited from (passed through) the transfer nip portion (time tb1 of FIG. 5B) was 700 V. In the first comparative example, the capacitances of the capacitors C1, C2, and C3 are set to 300 pF, 300 pF, and 300 pF, respectively, and the capacitances of the capacitors C2 and C3 to be charged by the double rectified voltage of the output voltage of the transformer T1 are large. Thus, as illustrated in FIG. 5B, the discharge speeds of the transfer voltage in the period 1 and the period 2 are lower than those in the first embodiment illustrated in FIG. 5A. As a result, the transfer voltage was not able to fall to −100 V being the voltage at which no "positive memory" was caused by the time when the trailing edge of the recording material P exited from the transfer nip portion. Accordingly, although the occurrence of the "negative memory" was able to be suppressed, the occurrence of the "positive memory" was not able to be suppressed, and the lateral black streak was caused.

Next, in the second comparative example, no lateral black streak accompanying the "positive memory" was caused, but density unevenness accompanying the "negative memory" was caused. As shown in Table 1, the transfer voltage at the time when the first recording material exited from the transfer nip portion (time tc1 of FIG. 5C) was −700 V. In the second comparative example, the electrostatic capacitances of the capacitors C1, C2, and C3 are all 50 pF, and the capacitance of the capacitor C1 to be charged by the half-wave rectified voltage of the output voltage of the transformer T1 is smaller than that in each of the first embodiment and the first comparative example. Accordingly, as illustrated in FIG. 5C, the discharge speed of the capacitor in the period 3 was higher than that in the first embodiment, and the voltage was reduced to be lower than −500 V being a threshold value of the "negative memory." Accordingly, although the "positive memory" was able to be suppressed, the density unevenness accompanying the "negative memory" was caused.

As described above, according to the first embodiment, the control of the transfer power supply device 50 is performed so that, when the trailing edge of the recording material P exits from the transfer nip portion, the transfer voltage is equal to or lower than the light section potential VL after the exposure and also equal to or higher than the dark section potential VD. In this manner, the transfer voltage can be caused to quickly fall to suppress the occurrence of the "positive memory" of the photosensitive drum 1, and the occurrence of the "negative memory" due to an undershoot can also be suppressed. As a result, satisfactory image formation without image defects can be performed.

As described above, according to the first embodiment, occurrence of charging unevenness which is one type of image defects caused by the transfer step can be suppressed.

Other Embodiments

In the first embodiment, the voltage tripler rectifier circuit is used as the rectifier circuit of the positive polarity power supply circuit of the transfer power supply device 50, but the effects of the present disclosure are not limited thereto. For example, the present disclosure is also applicable to voltage quadrupler to voltage sextupler rectifier circuits, and effects similar to those in the voltage tripler rectifier circuit can be produced.

[Voltage Quadrupler Rectifier Circuit]

Figure 6:
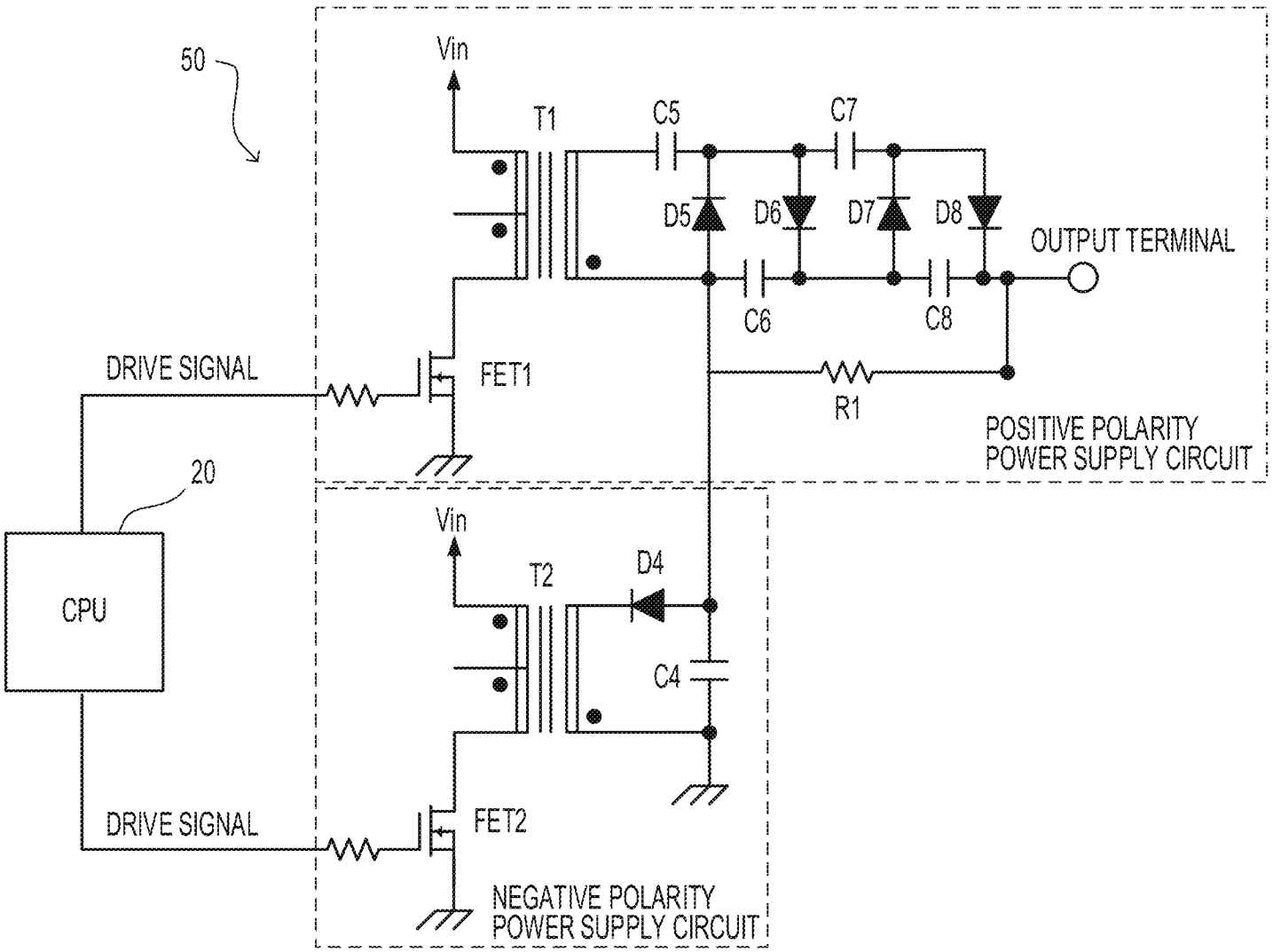
FIG. 6 is a schematic circuit diagram for illustrating a circuit configuration of a transfer power supply device in another embodiment.

FIG. 6 is a circuit diagram for illustrating a main circuit configuration of a transfer power supply device 50 including a voltage quadrupler rectifier circuit. The transfer power supply device 50 illustrated in FIG. 6 includes a positive polarity power supply circuit configured to generate a voltage having a positive polarity, and a negative polarity power supply circuit configured to generate a voltage having a negative polarity. In FIG. 6, the voltage quadrupler rectifier circuit which is provided on the secondary side of the transformer T1, and is configured to rectify a voltage induced on the secondary side of the transformer T1 includes diodes D5, D6, D7, and D8 and capacitors C5, C6, C7, and C8. In FIG. 6, the circuit configuration excluding the voltage quadrupler rectifier circuit is similar to the circuit configuration of the transfer power supply device 50 of FIG. 3A described above, and description thereof is omitted here.

In FIG. 6, one end of the secondary coil of the transformer T1 is connected to one end of the capacitor C5. Another end of the capacitor C5 is connected to a cathode terminal of the diode D5, an anode terminal of the diode D6, and one end of the capacitor C7. Further, another end of the capacitor C7 is connected to a cathode terminal of the diode D7 and an anode terminal of the diode D8. Another end of the secondary coil of the transformer T1 is connected to an anode terminal of the diode D5 and one end of the capacitor C6. Another end of the capacitor C6 is connected to a cathode terminal of the diode D6, an anode terminal of the diode D7, and one end of the capacitor C8. Another end of the capacitor C8 is connected to a cathode terminal of the diode D8 and the output terminal.

In FIG. 6, the capacitor C5 is charged by +Vo being the half-wave rectified voltage of the output voltage of the transformer T1, and the capacitors C6, C7, and C8 are each charged by +2Vo being the double rectified voltage of the output voltage of the transformer T1. In this manner, a voltage of +4Vo is output from the positive polarity power supply circuit. Further, capacitances of the capacitors C6, C7, and C8 to be charged by the double rectified voltage of the output voltage of the transformer T1 are each set to be smaller than a capacitance of the capacitor C5. In this manner, the transfer voltage can be caused to quickly fall, thereby being capable of suppressing the occurrence of the "positive memory" of the photosensitive drum 1. Further, the capacitance of the capacitor C5 to be charged by the half-wave rectified voltage of the output voltage of the transformer T1 is set to be larger than each of the capacitances of the capacitors C6, C7, and C8, thereby being capable of suppressing the occurrence of the "negative memory" due to an undershoot.

[Voltage Quintupler Rectifier Circuit]

Figure 7:
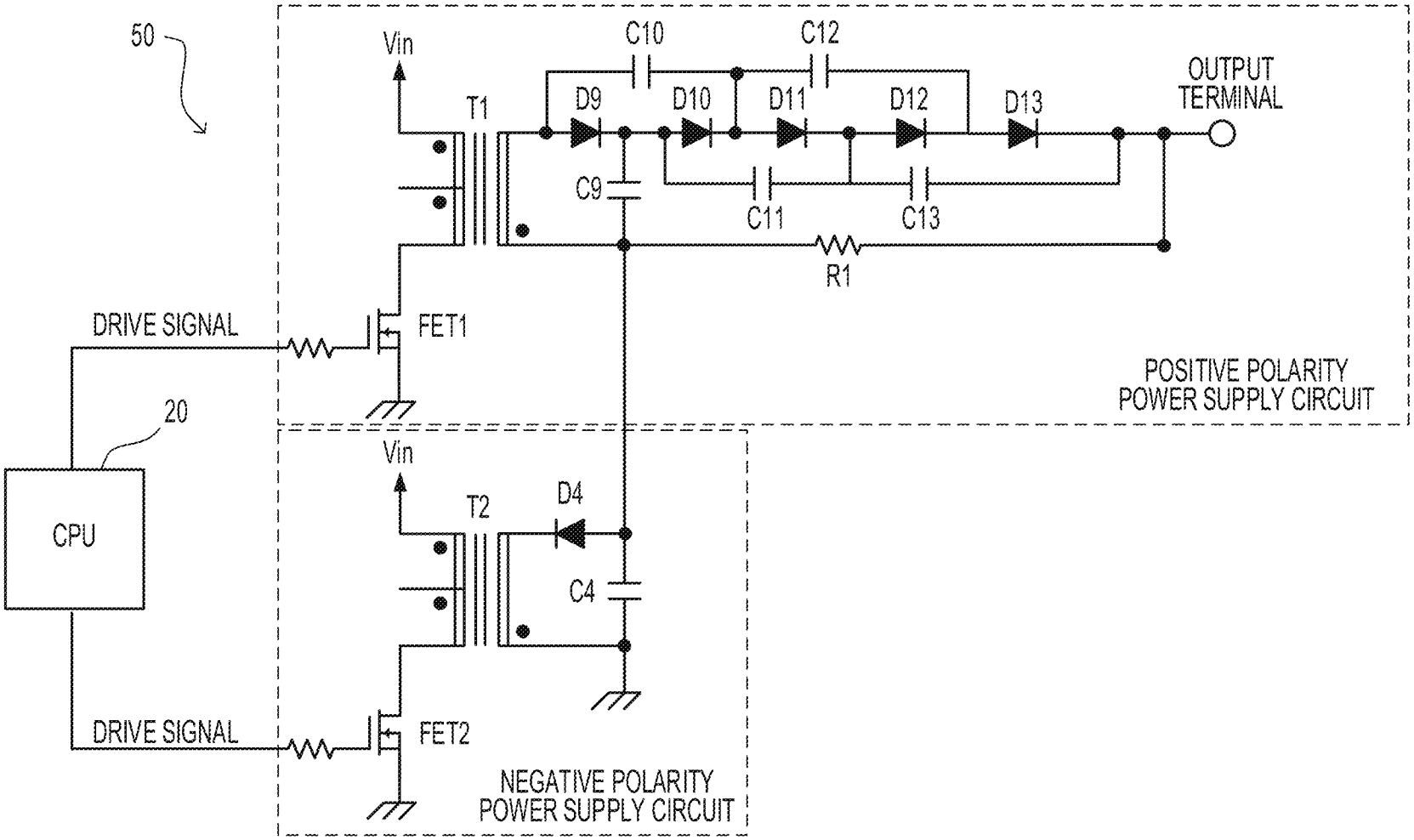
FIG. 7 is a schematic circuit diagram for illustrating a circuit configuration of a transfer power supply device in another embodiment.

FIG. 7 is a circuit diagram for illustrating a main circuit configuration of a transfer power supply device 50 including a voltage quintupler rectifier circuit. The transfer power supply device 50 illustrated in FIG. 7 includes a positive polarity power supply circuit configured to generate a voltage having a positive polarity, and a negative polarity power supply circuit configured to generate a voltage having a negative polarity. In FIG. 7, the voltage quintupler rectifier circuit which is provided on the secondary side of the transformer T1, and is configured to rectify a voltage induced on the secondary side of the transformer T1 includes diodes D9, D10, D11, D12, and D13 and capacitors C9, C10, C11, C12, and C13. In FIG. 7, the circuit configuration excluding the voltage quintupler rectifier circuit is similar to the circuit configuration of the transfer power supply device 50 of FIG. 3A described above, and description thereof is omitted here.

One end of the secondary coil of the transformer T1 is connected to an anode terminal of the diode D9 and one end of the capacitor C10. A cathode terminal of the diode D9 is connected to an anode terminal of the diode D10, one end of the capacitor C9, and one end of the capacitor C11. A cathode terminal of the diode D10 is connected to an anode terminal of the diode D11, another end of the capacitor C10, and one end of the capacitor C12. A cathode terminal of the diode D11 is connected to an anode terminal of the diode D12, another end of the capacitor C11, and one end of the capacitor C13. A cathode terminal of the diode D12 is connected to an anode terminal of the diode D13 and another end of the capacitor C12. A cathode terminal of the diode D13 is connected to another end of the capacitor C13 and the output terminal. Another end of the secondary coil of the transformer T1 is connected to another end of the capacitor C9.

In FIG. 7, the capacitor C9 is charged by +Vo being the half-wave rectified voltage of the output voltage of the transformer T1, and the capacitors C10, C11, C12, and C13 are each charged by +2Vo being the double rectified voltage of the output voltage of the transformer T1. In this manner, a voltage of +5Vo is output from the positive polarity power supply circuit. Further, capacitances of the capacitors C10, C11, C12, and C13 to be charged by the double rectified voltage of the output voltage of the transformer T1 are each set to be smaller than a capacitance of the capacitor C9. In this manner, the transfer voltage is caused to quickly fall, thereby being capable of suppressing the occurrence of the "positive memory" of the photosensitive drum 1. Further, the capacitance of the capacitor C9 to be charged by the half-wave rectified voltage of the output voltage of the transformer T1 is set to be larger than each of the capacitances of the capacitors C10, C11, C12, and C13, thereby being capable of suppressing the occurrence of the "negative memory" due to an undershoot.

[Voltage Sextupler Rectifier Circuit]

Figure 8:
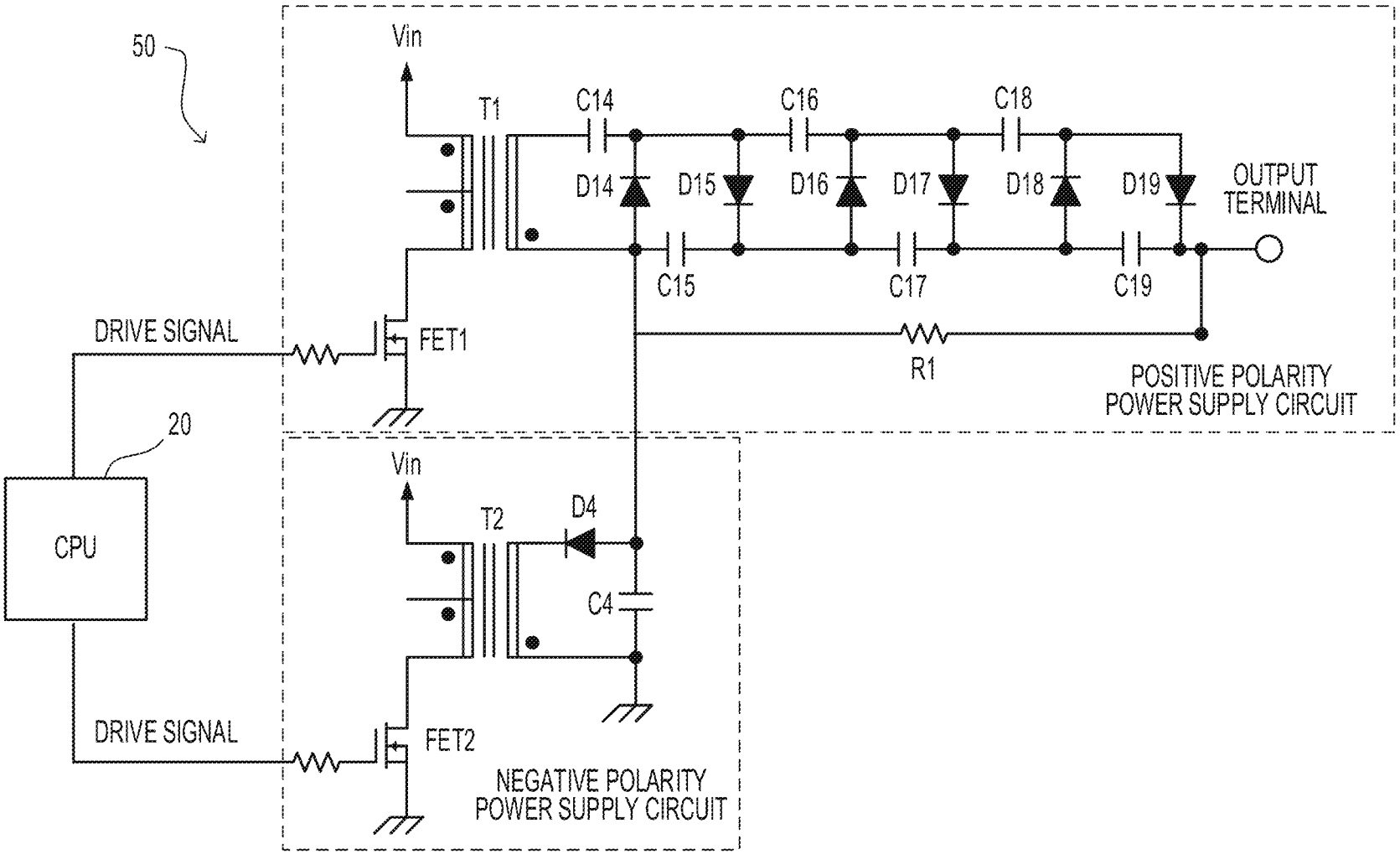
FIG. 8 is a schematic circuit diagram for illustrating a circuit configuration of a transfer power supply device in another embodiment.

FIG. 8 is a circuit diagram for illustrating a main circuit configuration of a transfer power supply device 50 including a voltage sextupler rectifier circuit. The transfer power supply device 50 illustrated in FIG. 8 includes a positive polarity power supply circuit configured to generate a voltage having a positive polarity, and a negative polarity power supply circuit configured to generate a voltage having a negative polarity. In FIG. 8, the voltage sextupler rectifier circuit which is provided on the secondary side of the transformer T1, and is configured to rectify a voltage induced on the secondary side of the transformer T1 includes diodes D14, D15, D16, D17, D18, and D19 and capacitors C14, C15, C16, C17, C18, and C19. In FIG. 8, the circuit configuration excluding the voltage sextupler rectifier circuit is similar to the circuit configuration of the transfer power supply device 50 of FIG. 3A described above, and description thereof is omitted here.

In FIG. 8, one end of the secondary coil of the transformer T1 is connected to one end of the capacitor C14. Another end of the capacitor C14 is connected to a cathode terminal of the diode D14, an anode terminal of the diode D15, and one end of the capacitor C16. Further, another end of the capacitor C16 is connected to a cathode terminal of the diode D16, an anode terminal of the diode D17, and one end of the capacitor C18. Further, another end of the capacitor C18 is connected to a cathode terminal of the diode D18 and an anode terminal of the diode D19.

Another end of the secondary coil of the transformer T1 is connected to an anode terminal of the diode D14 and one end of the capacitor C15. Another end of the capacitor C15 is connected to a cathode terminal of the diode D15, an anode terminal of the diode D16, and one end of the capacitor C17. Another end of the capacitor C17 is connected to a cathode terminal of the diode D17, an anode terminal of the diode D18, and one end of the capacitor C19. Another end of the capacitor C19 is connected to a cathode terminal of the diode D19 and the output terminal.

In FIG. 8, the capacitor C14 is charged by +Vo being the half-wave rectified voltage of the output voltage of the transformer T1, and the capacitors C15, C16, C17, C18, and C19 are each charged by +2Vo being the double rectified voltage of the output voltage of the transformer T1. In this manner, a voltage of +6Vo is output from the positive polarity power supply circuit. Further, capacitances of the capacitors C15, C16, C17, C18, and C19 to be charged by the double rectified voltage of the output voltage of the transformer T1 are each set to be smaller than a capacitance of the capacitor C14. In this manner, the transfer voltage is caused to quickly fall, thereby being capable of suppressing the occurrence of the "positive memory" of the photosensitive drum 1. Further, the capacitance of the capacitor C14 to be charged by the half-wave rectified voltage of the output voltage of the transformer T1 is set to be larger than each of the capacitances of the capacitors C15, C16, C17, C18, and C19, thereby being capable of suppressing the occurrence of the "negative memory" due to an undershoot.

As described above, the present disclosure is also applicable to voltage quadrupler to voltage sextupler rectifier circuits. Among capacitors forming a voltage multiplier rectifier circuit for outputting an "n"-time voltage, where "n" is 3 or more, a capacitor to be charged by the double rectified voltage of the output voltage of the transformer T1 is set to have a small capacitance, thereby being capable of suppressing the occurrence of the "positive memory" of the photosensitive drum 1. Further, among the capacitors forming the voltage multiplier rectifier circuit for outputting the "n"-time voltage, where "n" is 3 or more, a capacitor to be charged by the half-wave rectified voltage of the output voltage of the transformer T1 is set to have a large capacitance, thereby being capable of suppressing the occurrence of the "negative memory" due to an undershoot.

As described above, according to the other embodiments, occurrence of charging unevenness which is one type of image defects caused by the transfer step can be suppressed.

Second Embodiment

In the first embodiment, the configuration in which the electrostatic capacitance of the capacitor to be used in the transfer power supply circuit is decreased to cause the transfer voltage to fall fast has been described. When the capacitance of the capacitor used in the transfer power supply circuit is decreased, although the transfer voltage can be caused to fall fast, a ripple voltage of the transfer voltage is disadvantageously increased. When the ripple voltage of the transfer voltage is large, in some cases, a "blank area caused by poor transfer" or other image defects may be caused depending on, for example, an image pattern or environmental conditions such as temperature and humidity in which the image forming apparatus is to be used. In a second embodiment, a configuration in which the transfer voltage is caused to fall fast and the ripple voltage of the transfer voltage is reduced is described. Configurations of the image forming apparatus and the transfer power supply device in the second embodiment are similar to those in the first embodiment. Like devices and members are denoted by like reference symbols to omit detailed description thereof.

[Ripple Voltage of Transfer Voltage and Blank Area Caused by Poor Transfer]

Figure 9:
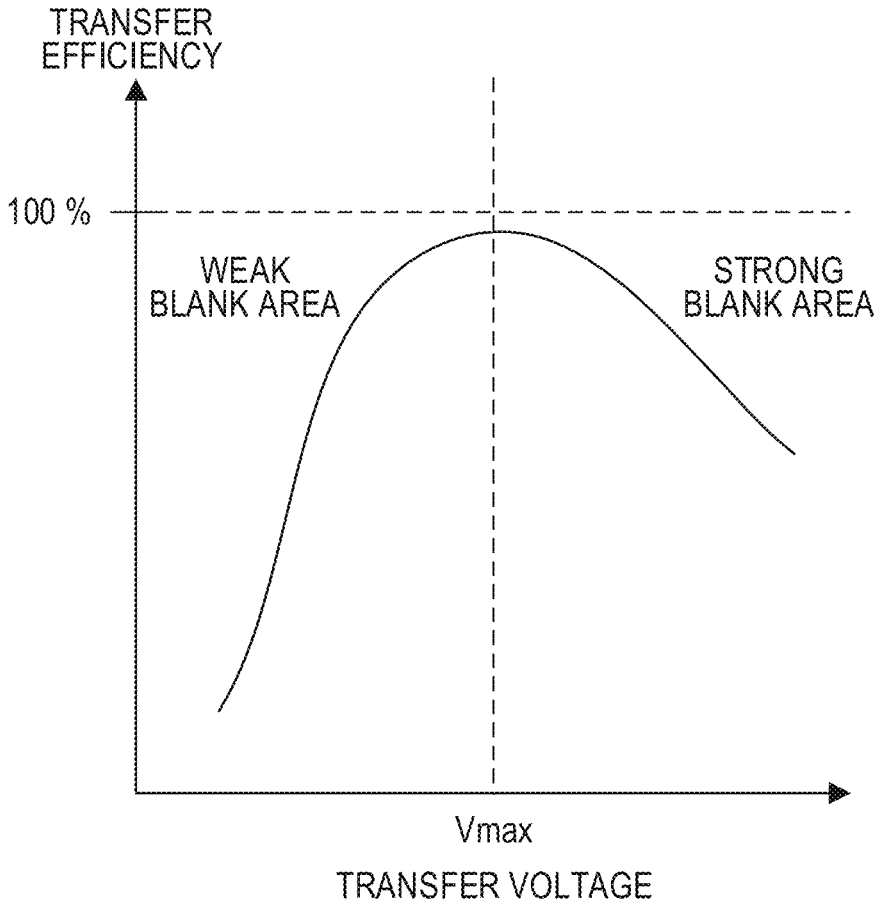
FIG. 9 is a graph for showing a correlation between the transfer voltage and transfer efficiency in the second embodiment.

As described above, in some cases, the ripple voltage of the transfer voltage to be applied to the transfer roller 12 may be increased depending on the capacitor capacitance of the rectifier circuit of the positive polarity power supply circuit of the transfer power supply device 50 illustrated in FIG. 3A. When the ripple voltage is large, in some cases, the transfer voltage to be applied to the transfer roller 12 may vary so as to be higher or lower than the appropriate transfer voltage (first transfer voltage), which may result in causing an image defect called a "blank area caused by poor transfer." FIG. 9 is a graph for showing a correlation between transfer efficiency and the transfer voltage to be applied from the transfer power supply device 50 to the transfer roller 12. The vertical axis represents transfer efficiency (unit: %), and the horizontal axis represents transfer voltage (unit: V). In this case, the transfer efficiency refers to an index which is based on a difference between the toner mass per unit area before the toner image formed on the photosensitive drum 1 is transferred onto the recording material P and the toner mass per unit area after the transfer, and is defined as (Expression 5) below.

Transfer efficiency=(1−"toner mass per unit area on photosensitive drum after transfer"/"toner mass per unit area on photosensitive drum before transfer")×100 (Expression 5)

As shown in FIG. 9, the transfer efficiency is maximum at the time of an appropriate transfer voltage (Vmax of FIG. 9). When the transfer voltage is lower than the transfer voltage Vmax at which the transfer efficiency is maximum, the transfer voltage required for transferring the toner image formed on the photosensitive drum 1 onto the recording material P is insufficient, and thus the toner that has not been able to be transferred onto the recording material P remains on the photosensitive drum 1. Accordingly, the transfer efficiency is reduced. Such a phenomenon that the insufficient transfer voltage causes reduction of the transfer efficiency is referred to as "weak blank area." Meanwhile, when the transfer voltage is higher than the transfer voltage Vmax at which the transfer efficiency is maximum, in some cases, the polarity of the toner transferred onto the recording material P at the transfer nip portion may be reversed from negative to positive so that the toner is re-transferred onto the negative polarity photosensitive drum 1. Also in this case, the re-transferred toner remains on the photosensitive drum 1 after the transfer, and thus the transfer efficiency is reduced. Such a phenomenon that the transfer voltage higher than the appropriate transfer voltage Vmax causes reduction of the transfer efficiency is referred to as "strong blank area." The "weak blank area" and the "strong blank area" described above are collectively referred to as "blank area caused by poor transfer." When the "blank area caused by poor transfer" is caused, image defects such as missing of a toner image on the recording material P and a density difference may be caused. According to the investigation performed by the inventors, it is found that, when the image forming apparatus M including the transfer power supply device 50 of the second embodiment is used, the occurrence of the "blank area caused by poor transfer" can be suppressed by reducing the ripple voltage so as to fall within a predetermined voltage range, that is, equal to or smaller than 30 V.

[Transfer Circuit in Second Embodiment]

Next, a ripple voltage in a case in which, in the positive polarity power supply circuit of the transfer power supply device 50 of FIG. 3A, the output voltage of the transformer T1 is a square wave as illustrated in FIG. 3B is described. First, in a period in which the output voltage of the transformer T1 is −Vo, the diodes D1 and D3 are in the non-conductive state, and only the diode D2 is in the conductive state. The diode D3 is not conductive, and hence the capacitance of the capacitor with respect to the output voltage of the positive polarity power supply circuit is a capacitance obtained when the capacitor C1 and the capacitor C3 are connected in series to each other. Accordingly, in the period in which the output voltage of the transformer T1 is −Vo, the transfer voltage being the output voltage is decreased at a discharge speed determined based on the capacitor capacitance in a case in which the capacitor C1 and the capacitor C3 are connected in series to each other, on the resistance value of the resistor R1, and on the resistance value of the transfer roller 12. Next, in a period in which the output voltage of the transformer T1 is +Vo, the diodes D1 and D3 are in the conductive state, and the diode D2 is in the non-conductive state. Accordingly, the capacitors C1 and C3 are charged, and the transfer voltage to be applied to the transfer roller 12 rises. Next, when the output voltage of the transformer T1 is changed to −Vo, the diodes D1 and D3 are brought into the non-conductive state, and the diode D2 is brought into the conductive state. Accordingly, the transfer voltage is decreased again. When such an operation is repeated, in the transfer voltage to be applied to the transfer roller 12, there is caused a ripple voltage being a voltage difference between the largest voltage and the smallest voltage of the transfer voltage, that is, a peak-to-peak voltage.

As described above, the ripple voltage of the output voltage (transfer voltage) in the positive polarity power supply circuit of FIG. 3A is determined based on the capacitor capacitance at the time when the capacitors C1 and C3 are connected in series to each other, and the capacitance of the capacitor C2 does not affect the ripple voltage. Accordingly, when the capacitance of the capacitor C2 is decreased, the falling time period of the transfer voltage at the time when the transfer voltage is caused to fall after the application of the transfer voltage to the transfer roller 12 is ended can be decreased without increasing the ripple voltage. Further, as described above, when the capacitance of the capacitor C1 to be charged by the half-wave rectified voltage of the output voltage of the transformer T1 is increased, the occurrence of the "negative memory" due to an undershoot can be suppressed. In view of the above, in the second embodiment, as the circuit configuration of the transfer power supply device 50, the capacitances of the capacitors C1, C2, and C3 are set to 300 pF, 50 pF, and 300 pF, respectively.

In this case, a set of capacitors C1 and C3 connected in series to each other without interposing a plurality of diodes between the transformer T1 and the output terminal of the transfer voltage is referred to as "first capacitor group." Further, a set of capacitors not included in the first capacitor group among the plurality of capacitors C1 to C3 is referred to as "second capacitor group." In the configuration of the second embodiment, the capacitor C1 to be charged by the half-wave rectified voltage of the output voltage of the transformer T1 is included in the first capacitor group. However, there are cases in which the capacitor to be charged by the half-wave rectified voltage of the output voltage of the transformer T1 is included in the second capacitor group depending on other circuit configurations to be described later.

However, in the configuration of the second embodiment, the falling time period of the transfer voltage is increased (extended) as compared to the configuration in which the capacitances of both of the capacitors C2 and C3 are decreased, which is the configuration described in the first embodiment. Accordingly, it is preferred that a configuration having an optimum capacitor capacitance be selected in view of the occurrence state of the "positive memory" and the "blank area caused by poor transfer."

For example, when the process speed of the image forming apparatus M is lower than that in the configuration described in the first embodiment (250 mm/sec), the occurrence of the "positive memory" can be suppressed even when the falling speed of the transfer voltage is lowered by this amount. As described above, when the process speed is lower than that in the case of the first embodiment, even with the circuit configuration of the second embodiment described above, the occurrence of the "positive memory"

can be suppressed, and the ripple voltage can be reduced to also suppress the occurrence of the "blank area caused by poor transfer."

Further, occurrence levels of the "positive memory" and the "blank area caused by poor transfer" vary depending on, for example, the thickness and the resistance value of the recording material P, and environmental conditions such as temperature and humidity in which the image forming apparatus M is to be used. For example, when, as the image defects, the occurrence level of the "positive memory" is slight but the occurrence level of the "blank area caused by poor transfer" is high, it is preferred that the circuit configuration of the second embodiment be used instead of the circuit configuration of the first embodiment.

Evaluation Experiment of Second Embodiment

Next, an evaluation experiment of the second embodiment is described. In the evaluation experiment, the capacitances of the capacitors C1, C2, and C3 of the positive polarity power supply circuit of the transfer power supply device 50 in the second embodiment were set to 300 pF, 50 pF, and 300 pF, respectively. Further, in order to compare with the second embodiment, the evaluation experiment was performed also for the combination of the first embodiment in which the capacitances of the capacitors C1, C2, and C3 were set to 300 pF, 50 pF, and 50 pF, respectively, and the combination of the first comparative example in which the capacitances of the capacitors C1, C2, and C3 were all set to 300 pF.

Further, in the evaluation experiment, the image forming apparatus M was installed under an environment having a temperature of 23° C. and a humidity of 50%, and the printing was performed on the recording material P at a process speed of 160 mm/sec. Further, as the recording material P, Vitality (produced by Xerox Corporation) having a letter (LTR) size and a basis weight of 75 g/m$^2$ was used. Under such an environment, an image having a density of 25% was printed successively on two recording materials P, and whether or not the image formed on the second recording material P had a "memory" (positive memory) due to the separation electric-discharge between the photosensitive drum 1 and the trailing edge of the first recording material P was checked. Similarly, whether or not there was caused a "blank area caused by poor transfer" due to the ripple voltage of the transfer voltage was checked. Further, the transfer voltage at the time when the image region of the recording material P (region on the inner side of the portions on the inner side by 5 mm from the leading edge of the recording material P, the trailing edge thereof, and the end portion of the recording material on the side in the direction orthogonal to the conveyance direction) passed through the transfer nip portion was controlled as follows. That is, the transfer power supply device 50 was controlled so that, in the transfer power supply device 50, the output voltage of the positive polarity power supply circuit was 3,000 V, the output voltage of the negative polarity power supply circuit was −1,000 V, and 2,000 V being a sum of the two voltages was output.

Table 2 is a table for showing experiment results of the evaluation experiment with the combinations of the capacitors C1, C2, and C3 in the second embodiment, the first embodiment, and the first comparative example described above. In Table 2, the experiment results of the second embodiment, the first embodiment, and the first comparative example are arranged in the vertical direction, and the following items are listed in the horizontal direction. That is, in the horizontal direction of Table 2, there are shown the capacitances (unit: pF) of the capacitors C1, C2, and C3, and the transfer voltage (unit: V) at the time when the first recording material P exits from (passes through) the transfer nip portion. Further, in the horizontal direction of Table 2, there are shown whether or not there is an image defect in a state of a lateral black streak accompanying the occurrence of the "memory," and whether or not there is the occurrence of the "blank area caused by poor transfer." The "memory" was evaluated as x (bad) when the image defect was caused, and as o (good) when no image defect was caused. Similarly, the "blank area caused by poor transfer" was evaluated as x (bad) when the "blank area caused by poor transfer" was caused, and as o (good) when no "blank area caused by poor transfer" was caused.

TABLE 2

| | Electrostatic capacitance of capacitor [pF] | | | Transfer voltage [V] at time when first recording material exits from transfer nip portion | "Memory" | "Blank area caused by poor transfer" |
|---|---|---|---|---|---|---|
| | C1 | C2 | C3 | | | |
| Second embodiment | 300 | 50 | 300 | −100 | o | o |
| First embodiment | 300 | 50 | 50 | −400 | o | x |
| First comparative example 1 | 300 | 300 | 300 | 400 | x | o |

Figure 10A:
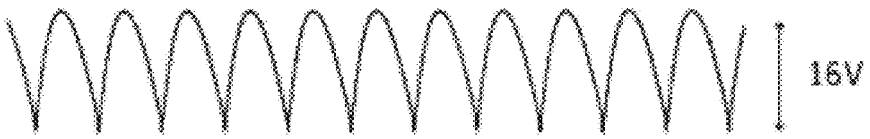
FIG. 10A is a chart for illustrating a ripple voltage of the transfer voltage in the second embodiment.
Figure 10B:
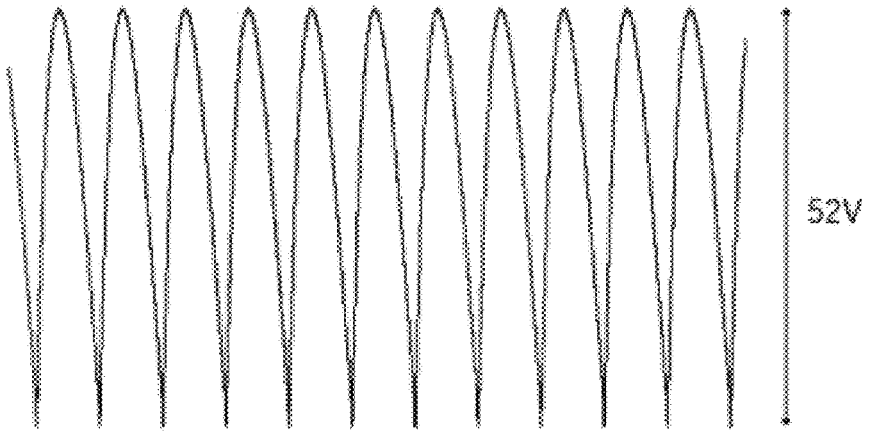
FIG. 10B is a chart for illustrating a ripple voltage of the transfer voltage in the first embodiment.
Figure 10C:
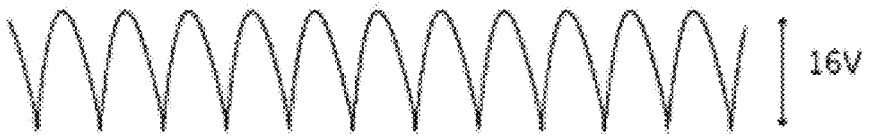
FIG. 10C is a chart for illustrating a ripple voltage of the transfer voltage in a first comparative example.

Further, FIG. 10A, FIG. 10B, and FIG. 10C are waveform charts for illustrating a state of the ripple voltage in the transfer voltage applied from the transfer power supply device 50 to the transfer roller 12 in the period in which the transfer voltage control is turned "ON" while the above-mentioned evaluation experiment is performed. FIG. 10A shows the state of the ripple voltage in the second embodiment, FIG. 10B shows the state of the ripple voltage in the first embodiment, and FIG. 10C shows the state of the ripple voltage in the first comparative example. In FIG. 10A, FIG. 10B, and FIG. 10C, the vertical direction represents voltage, and the horizontal direction represents time.

As shown in Table 2, in the combination of the capacitances of the capacitors C1, C2, and C3 in the second embodiment, no lateral black streak accompanying the occurrence of the "memory" was caused, and also no "blank area caused by poor transfer" due to the ripple voltage of the transfer voltage was caused. As shown in Table 2, the transfer voltage at the time when the first recording material P exited from (passed through) the transfer nip portion (time td2 of FIG. 5D) was −100 V. In the second embodiment, the capacitances of the capacitors C1, C2, and C3 were set to 300 pF, 50 pF, and 300 pF, respectively. In this manner, the transfer voltage was able to rapidly fall (decrease) so that the transfer voltage at the time when the trailing edge of the recording material P exited from the transfer nip portion was equal to or lower than −100 V at which no "memory" was caused. Further, the ripple voltage was reduced to be equal to or lower than 30 V at which no "blank area caused by poor transfer" was caused. In this manner, the occurrence of the blank area caused by poor transfer was able to be suppressed.

Further, the voltage waveform of the falling edge of the transfer voltage in the case of the second embodiment is as illustrated in FIG. 5D. In the second embodiment, the capacitance of the capacitor C3 in the positive polarity power supply circuit is larger than that in the configuration of the first embodiment, and hence, particularly in the period 1, the falling speed of the transfer voltage is lower than that in the case of the first embodiment. However, the image forming apparatus M of the second embodiment has a process speed of 160 mm/sec, which is lower than the process speed (250 mm/sec) in the first embodiment. Accordingly, the time period required until the trailing edge of the recording material P exits from the transfer nip portion is longer than that in the case of the first embodiment, and hence the transfer voltage can be caused to fall to a voltage at which no "positive memory" is caused. Further, the ripple voltage of the transfer voltage in the second embodiment is illustrated in FIG. 10A. In the second embodiment, the capacitance of the capacitor C3 is set to 300 pF, and hence the ripple voltage is reduced to 16 V as described above. Thus, there is achieved the suppression of the occurrence of the blank area caused by poor transfer.

Meanwhile, as shown in Table 2, in the combination of the capacitances of the capacitors C1, C2, and C3 in the first embodiment, no lateral black streak accompanying the occurrence of the "memory" was caused, but the "blank area caused by poor transfer" due to the ripple voltage of the transfer voltage was caused. In the transfer circuit configuration of the first embodiment, as shown in Table 2, the transfer voltage at the time when the trailing edge of the recording material P exited from the transfer nip portion (time ta2 of FIG. 5A) fell to −400 V, and hence, although no "memory" was caused, the "blank area caused by poor transfer" was caused. Further, the voltage waveform of the falling edge of the transfer voltage in the case of the first embodiment is as illustrated in FIG. 5A. The falling speed of the transfer voltage in the period 3 is decreased, and hence the transfer voltage at the time when the trailing edge of the recording material P exits from the transfer nip portion is maintained to a voltage at which no "negative memory" is caused. However, the capacitance of the capacitor C3 is set to 50 pF, and thus the ripple voltage of the transfer voltage is 52 V as illustrated in FIG. 10B. Thus, the "blank area caused by poor transfer" was caused.

Further, as shown in Table 2, in the combination of the capacitances of the capacitors C1, C2, and C3 in the first comparative example, no "blank area caused by poor transfer" due to the ripple voltage of the transfer voltage was caused, but the lateral black streak accompanying the occurrence of the "memory" (positive memory) was caused. In the first comparative example, the capacitances of the capacitors C1, C2, and C3 are all 300 pF, and all capacitor capacitances are the same and large. Accordingly, as shown in Table 2, the transfer voltage at the time when the trailing edge of the first recording material P exits from (passes through) the transfer nip portion (time tb2 of FIG. 5B) falls only to 400 V. As a result, the occurrence of the "memory" (positive memory) was not able to be suppressed. In the circuit configuration of the first comparative example, the capacitance of the capacitor C3 is 300 pF. Accordingly, as illustrated in FIG. 10C, the ripple voltage is reduced to 16 V. Thus, no "blank area caused by poor transfer" was caused. However, as illustrated in FIG. 5B, the falling edge curve of the transfer voltage is gentle, and hence the transfer voltage at the time when the trailing edge of the recording material P exits from the transfer nip portion does not sufficiently fall. Thus, the "memory" was caused.

As described above, according to the second embodiment, the transfer voltage is caused to fall fast while the ripple voltage of the transfer voltage is reduced, thereby being capable of suppressing the occurrence of the "memory" and the "blank area caused by poor transfer" and also suppressing the occurrence of the "negative memory" due to an undershoot. In this manner, a satisfactory image can be obtained.

In the above-mentioned second embodiment, the capacitances of the capacitors C1, C2, and C3 are set to 300 pF, 50 pF, and 300 pF, respectively, so that the capacitors C1 and C3 have the same capacitance, but the present disclosure is not limited thereto. The capacitance of the capacitor C3 may be set to be smaller than the capacitance of the capacitor C1. However, in order to reduce the ripple voltage, it is required to set the capacitance of the capacitor C3 to be larger than the capacitance of the capacitor C2. That is, there may be achieved a relationship in which the capacitance is decreased in the order of C1>C3>C2.

Other Embodiments

In the second embodiment, the voltage tripler rectifier circuit is used as the rectifier circuit of the positive polarity power supply circuit of the transfer power supply device 50, but the effects of the present disclosure are not limited thereto. For example, the present disclosure is also applicable to voltage quadrupler to voltage sextupler rectifier circuits, and effects similar to those in the voltage tripler rectifier circuit can be produced.

[Voltage Quadrupler Rectifier Circuit]

The capacitance of the capacitor with respect to the output voltage of the positive polarity power supply circuit of FIG. 6 is a capacitance obtained when the capacitor C6 and the capacitor C8 are connected in series to each other. The ripple voltage of the output voltage (transfer voltage) is determined based on the capacitor capacitance at the time when the capacitors C6 and C8 are connected in series to each other, and the capacitances of the capacitors C5 and C7 do not affect the ripple voltage. Accordingly, when the capacitances of the capacitors C5 and C7 are decreased, the falling time period of the transfer voltage at the time when the transfer voltage is caused to fall after the application of the transfer voltage to the transfer roller 12 is ended can be decreased without increasing the ripple voltage.

Further, as described above, in FIG. 6, when the capacitance of the capacitor C5 to be charged by the half-wave rectified voltage of the output voltage of the transformer T1 is set to be larger than each of the capacitances of the capacitors C6, C7, and C8, the occurrence of the "negative memory" due to an undershoot can be suppressed. Accordingly, the capacitance of the capacitor C7 among the capacitors C5 and C7 is set to be smaller than the capacitance of each of the capacitors C5, C6, and C8. In summary, there is achieved a relationship in which the capacitance is decreased in the order of C5>C6, C8>C7. The capacitances of the capacitors C6 and C8 may have any magnitude relationship. Further, as described in the voltage tripler rectifier circuit, the capacitor C5 and the capacitors C6 and C8 may be set to have the same capacitance.

As described above, the transfer voltage is caused to fall fast while the ripple voltage of the transfer voltage is reduced, thereby being capable of suppressing the occurrence of the "memory" and the "blank area caused by poor transfer" and also suppressing the occurrence of the "negative memory" due to an undershoot.

[Voltage Quintupler Rectifier Circuit]

The capacitance of the capacitor with respect to the output voltage of the positive polarity power supply circuit of FIG. 7 is a capacitance obtained when the capacitor C9, the capacitor C11, and the capacitor C13 are connected in series to each other. The ripple voltage of the output voltage (transfer voltage) is determined based on the capacitor capacitance at the time when the capacitors C9, C11, and C13 are connected in series to each other, and the capacitances of the capacitors C10 and C12 do not affect the ripple voltage. Accordingly, when the capacitances of the capacitors C10 and C12 are decreased, the falling time period of the transfer voltage at the time when the transfer voltage is caused to fall after the application of the transfer voltage to the transfer roller 12 is ended can be decreased without increasing the ripple voltage.

Further, as described above, in FIG. 7, when the capacitance of the capacitor C9 to be charged by the half-wave rectified voltage of the output voltage of the transformer T1 is set to be larger than the capacitance of each of the capacitors C10, C11, C12, and C13, the occurrence of the "negative memory" due to an undershoot can be suppressed. Further, the capacitance of each of the capacitors C10 and C12 is set to be smaller than the capacitance of each of the capacitors C9, C11, and C13. In summary, there is achieved a relationship in which the capacitance is decreased in the order of C9>C11, C13>C10, C12. The capacitances of the capacitors C11 and C13 may have any magnitude relationship, and the capacitances of the capacitors C10 and C12 may have any magnitude relationship. Further, as described in the voltage tripler rectifier circuit, the capacitor C9 and the capacitors C11 and C13 may be set to have the same capacitance.

As described above, the transfer voltage is caused to fall fast while the ripple voltage of the transfer voltage is reduced, thereby being capable of suppressing the occurrence of the "memory" and the "blank area caused by poor transfer" and also suppressing the occurrence of the "negative memory" due to an undershoot.

[Voltage Sextupler Rectifier Circuit]

The capacitance of the capacitor with respect to the output voltage of the positive polarity power supply circuit of FIG. 8 is a capacitance obtained when the capacitor C15, the capacitor C17, and the capacitor C19 are connected in series to each other. The ripple voltage of the output voltage (transfer voltage) is determined based on the capacitor capacitance at the time when the capacitors C15, C17, and C19 are connected in series to each other, and the capacitances of the capacitors C14, C16, and C18 do not affect the ripple voltage. Accordingly, when the capacitances of the capacitors C14, C16, and C18 are decreased, the falling time period of the transfer voltage at the time when the transfer voltage is caused to fall after the application of the transfer voltage to the transfer roller 12 is ended can be decreased without increasing the ripple voltage.

Further, as described above, in FIG. 8, when the capacitance of the capacitor C14 to be charged by the half-wave rectified voltage of the output voltage of the transformer T1 is set to be larger than the capacitance of each of the capacitors C15, C16, C17, C18, and C19, the occurrence of the "negative memory" due to an undershoot can be suppressed. Accordingly, the capacitance of each of the capacitors C16 and C18 among the capacitors C14, C16, and C18 is set to be smaller than the capacitance of each of the capacitors C14, C15, C17, and C19. In summary, there is achieved a relationship in which the capacitance is decreased in the order of C14>C15, C17, C19>C16, C18. The capacitances of the capacitors C15, C17, and C19 may have any magnitude relationship, and the capacitances of the capacitors C16 and C18 may have any magnitude relationship. Further, as described in the voltage tripler rectifier circuit, the capacitor C14 and the capacitors C15, C17, and C19 may be set to have the same capacitance.

As described above, the transfer voltage is caused to fall fast while the ripple voltage of the transfer voltage is reduced, thereby being capable of suppressing the occurrence of the "memory" and the "blank area caused by poor transfer" and also suppressing the occurrence of the "negative memory" due to an undershoot.

As described above, according to other embodiments, the transfer voltage is caused to fall fast while the ripple voltage of the transfer voltage is reduced, thereby being capable of suppressing the occurrence of the "memory" and the "blank area caused by poor transfer" and also suppressing the occurrence of the "negative memory" due to an undershoot. In this manner, a satisfactory image can be obtained.

In the first and second embodiments described above, the configuration in which the CPU 20 for controlling the image forming apparatus M controls the transfer power supply device 50 has been described. For example, the transfer power supply device 50 may include a dedicated CPU for controlling the transfer power supply device 50, and the dedicated CPU may be configured to perform transfer voltage output control based on the instruction from the CPU 20 of the image forming apparatus M.

As described above, according to the second embodiment, occurrence of charging unevenness which is one type of image defects caused by the transfer step can be suppressed.

Third Embodiment

In a third embodiment, a circuit configuration for preventing the ripple voltage of the transfer voltage from increasing is described. When the ripple voltage of the transfer voltage is large, in some cases, a "blank area caused by poor transfer" in which the toner image formed on the photosensitive drum remains on the photosensitive drum at the time of transfer or other image defects may be caused depending on, for example, an image pattern or environmental conditions such as temperature and humidity in which the image forming apparatus is to be used. The configuration of the image forming apparatus, the image forming operation of the image forming apparatus, and the like are basically the same as those in the first embodiment, and hence description thereof is omitted. Further, reference symbols common to the reference symbols used in the above-mentioned first and second embodiments indicate the same members.

In the third embodiment, a transfer power supply device 60 to be described later is used in place of the transfer power supply device 50 described in the first and second embodiments. As described later, the transfer power supply device 60 does not include the negative polarity power supply circuit illustrated in FIG. 3A. Accordingly, it is assumed that, in the third embodiment, a charging power supply device (not shown) for generating a charging voltage is separately provided.

[Configuration of Transfer Power Supply Device]

Figure 11A:
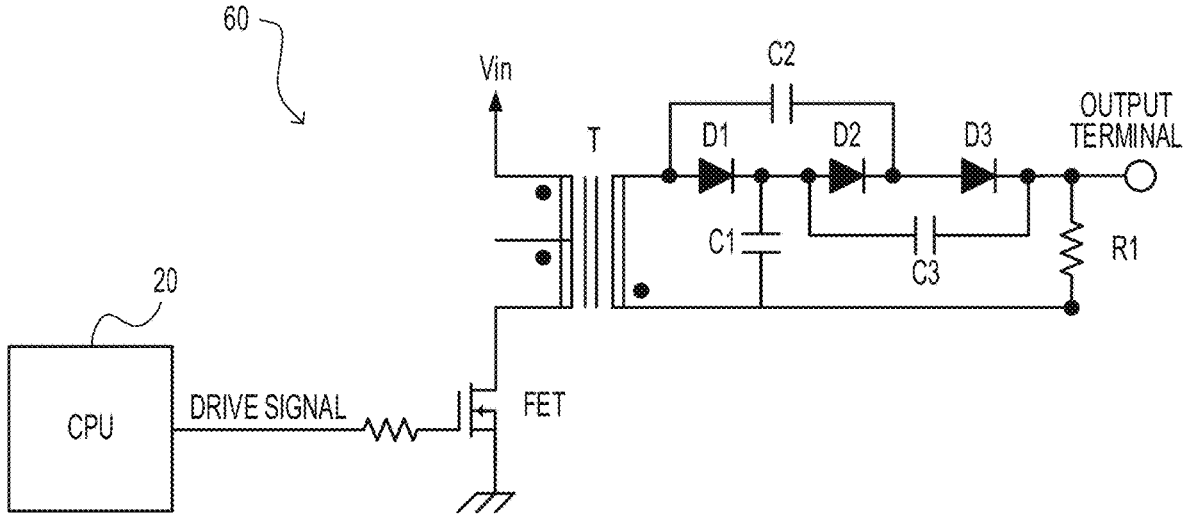
FIG. 11A is a schematic circuit diagram for illustrating a circuit configuration of a transfer power supply device in a third embodiment.

Next, the transfer power supply device 60 configured to supply the transfer voltage to the transfer roller 12 is described. FIG. 11A is a circuit diagram for illustrating a main circuit configuration of the transfer power supply device 60 in the third embodiment. In FIG. 11A, the transfer power supply device 60 includes a transformer T and a field effect transistor (hereinafter referred to as "FET"). The transformer T includes a primary coil and a secondary coil. The FET corresponds to a switching portion to be switched in response to a drive signal output from the CPU 20. Further, the transfer power supply device 60 includes, on a secondary side of the transformer T, a rectifier circuit (rectifier circuit portion) configured to rectify a voltage induced on the secondary side of the transformer T. The rectifier circuit includes a plurality of diodes D1, D2, and D3, a plurality of capacitors C1, C2, and C3, and a resistor R1. One end of the secondary coil of the transformer T is connected to an anode terminal of the diode D1 (first diode) and one end of the capacitor C2 (second capacitor). A cathode terminal of the diode D1 is connected to an anode terminal of the diode D2 (second diode) and one end of each of the capacitors C1 and C3. A cathode terminal of the diode D2 is connected to an anode terminal of the diode D3 (third diode) and another end of the capacitor C2. A cathode terminal of the diode D3 is connected to another end of the capacitor C3 (third capacitor), one end of the resistor R1, and an output terminal. Further, another end of the secondary coil of the transformer T is connected to another end of the capacitor C1 (first capacitor) and another end of the resistor R1.

In the transfer power supply device 60, the FET repeats a switching operation in response to the drive signal output from the CPU 20 so that the transformer T is driven. Thus, a DC voltage having a positive polarity is generated by the rectifier circuit provided on the secondary side of the transformer T. In this case, the rectifier circuit provided on the secondary side of the transformer T is a voltage tripler rectifier circuit configured to multiply (amplify) the voltage induced on the secondary side. In general, when a high voltage is attempted to be output through use of one rectifier circuit, in order to prevent discharge and leakage inside of the transformer, covering the transformer and its surrounding with a resin having a high withstanding voltage or other measures are required to be performed, which may greatly increase the cost. Accordingly, using a voltage multiplier rectifier circuit as in the third embodiment provides more advantages in terms of cost.

[Operation at Time of Output of Transfer Voltage]

Figure 11B:
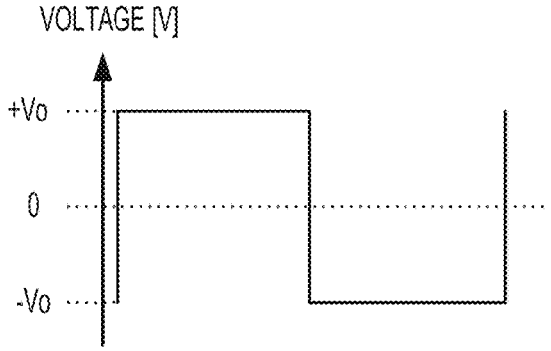
FIG. 11B is a chart for illustrating an output waveform of a transformer in the third embodiment.

Next, an operation of the transfer power supply device 60 when the transfer voltage is applied to the transfer roller 12 at the time of image formation is described. FIG. 11B is a chart for illustrating a voltage waveform of an AC voltage induced on the secondary side of the transformer T when, in the transfer power supply device 60, the FET is repeatedly turned on and off in response to the drive signal output from the CPU 20 so that the transformer T is driven. FIG. 11B shows a voltage waveform of one period caused on a secondary coil side of the transformer T of FIG. 11A on which no black dot indicating the start of winding is marked, and shows a square wave voltage waveform of voltages +Vo and −Vo. In FIG. 11B, the vertical axis represents voltage (unit: V), and the horizontal axis represents time.

In FIG. 11B, when the voltage is +Vo, the diodes D1 and D3 are in the conductive state, and the diode D2 is in the non-conductive state. Thus, the capacitors C1 and C3 are charged. At this time, the capacitor C1 is charged by +Vo being a half-wave rectified voltage of the transformer output, and the capacitor C3 is charged by +2Vo being a double rectified voltage of the transformer output. In this manner, a voltage of +3Vo is output to the output terminal of the transfer power supply device 60. Meanwhile, when the voltage is −Vo, the diode D2 is in the conductive state, and the diodes D1 and D3 are in the non-conductive state. At this time, the capacitor C2 is charged by +2Vo being the double rectified voltage of the transformer output.

The operation of the power supply circuit illustrated in FIG. 11A is summarized. As described above, an AC voltage shown in FIG. 11B is induced on the secondary side of the transformer T. Thus, voltages of +Vo, +2Vo, and +2Vo are applied to the capacitor C1, the capacitor C2, and the capacitor C3, respectively, so that the capacitors C1 to C3 are charged. Under this state, when a voltage of +Vo is generated on the secondary coil side of the transformer T on which no black dot is marked, the output voltage +Vo of the transformer T and the voltage of +2Vo caused by the charges charged in the capacitor C2 are added so that +3Vo is output to the output terminal. Meanwhile, when a voltage of −Vo is generated on the secondary coil side of the transformer T on which no black dot is marked, +3Vo is maintained at the output terminal due to the voltage of +Vo caused by the charges charged in the capacitor C1 and the voltage corresponding to +2Vo caused by the charges charged in the capacitor C3.

[Operation at Time of Stop of Output of Transfer Voltage]

Next, a behavior of the transfer power supply device 60 at the time when application of the transfer voltage to the transfer roller 12 is stopped so that the transfer voltage is caused to fall is described. First, when the drive signal output from the CPU 20 is stopped so that the FET is turned off, no voltage is induced on the secondary side of the transformer T, and discharge of charges charged in the capacitors C1, C2, and C3 starts. Immediately after the discharge starts, a charged voltage of the capacitor C2 is smaller than a sum of the charged voltages of the capacitor C1 and the capacitor C3, and hence the diode D3 is not brought into a conductive state. Accordingly, the capacitor C2 is hardly discharged, and a discharge speed of the transfer voltage being the output voltage of the transfer power supply device 60 is determined based on capacitances of the capacitors C1 and C3 connected in series to each other, and on a resistance value of the resistor R1.

As the discharge proceeds and the sum of the charged voltages of the capacitor C1 and the capacitor C3 becomes smaller than the charged voltage of the capacitor C2, the diode D3 is brought into the conductive state, and the capacitor C2 starts to discharge. Accordingly, a capacitance value of a capacitor related to the discharge speed of the output voltage is increased by an amount of the capacitance of the capacitor C2 in addition to the capacitances of the capacitors C1 and C3. Thus, the discharge speed is decreased as compared to that before the discharge of the capacitor C2 is started, and the speed of lowering the transfer voltage is decreased.

As the discharge further proceeds and the charged voltage of the capacitor C2 becomes the same as the sum of the charged voltages of the capacitor C1 and the capacitor C3, the discharge speed of the capacitor C2 becomes equal to the discharge speed of the capacitors C1 and C3, and hence the discharge of the capacitor C1 or the capacitor C3 is completed earlier. After the discharge of the capacitor C1 or the capacitor C3 is completed, the capacitance of the capacitor related to the discharge speed of the transfer voltage is changed from the capacitance obtained when the capacitor C1 and the capacitor C3 are connected in series to each other to a capacitance obtained when the capacitance of the capacitor C2 is added to the capacitance of the capacitor C1 or the capacitor C3. As a result, the capacitance of the capacitor related to the discharge speed of the transfer voltage is increased. Accordingly, the discharge speed of the capacitor is further decreased, and the speed of lowering the transfer voltage is also further decreased. Which of the capacitor C1 and the capacitor C3 completes the discharge earlier is determined based on the capacitance value of each capacitor.

As described above, in the transfer power supply device 60 in the third embodiment, when the transfer voltage is caused to fall after the application of the transfer voltage to the transfer roller 12 is ended, the discharge speed of the capacitor is changed two times due to the charged voltages of the capacitors C1, C2, and C3 of the rectifier circuit. A length of time before the discharge speed of the capacitor is changed and a voltage at the time when the discharge speed of the capacitor is changed can be changed by means of the capacitance value of each capacitor and the resistance value of the resistor R1.

[Ripple Voltage at Time of Output of Transfer Voltage]

Next, the ripple voltage in a case in which, in the transfer power supply device 60 of FIG. 11A, the output voltage of the transformer T is a square wave as illustrated in FIG. 11B is described. First, in the period in which the output voltage of the transformer T is −Vo, the diodes D1 and D3 are in the non-conductive state, and only the diode D2 is in the conductive state. The diode D3 is not conductive, and hence the capacitance value of the capacitor with respect to the output voltage of the transfer power supply device 60 is a capacitance value obtained when the capacitor C1 and the capacitor C3 are connected in series to each other. Accordingly, in the period in which the output voltage of the transformer T is −Vo, the transfer voltage being the output voltage is decreased at a discharge speed determined based on the capacitor capacitance value in a case in which the capacitor C1 and the capacitor C3 are connected in series to each other, on the resistance value of the resistor R1, and on the resistance value of the transfer roller 12. Next, in the period in which the output voltage of the transformer T is +Vo, the diodes D1 and D3 are in the conductive state, and the diode D2 is in the non-conductive state. Accordingly, the capacitors C1 and C3 are charged, and the transfer voltage to be applied to the transfer roller 12 rises. Next, when the output voltage of the transformer T is changed to −Vo, the diodes D1 and D3 are brought into the non-conductive state, and the diode D2 is brought into the conductive state. Accordingly, the transfer voltage is decreased again. When such an operation is repeated, in the transfer voltage to be applied to the transfer roller 12, there is caused a ripple voltage being a voltage difference between the largest voltage and the smallest voltage of the transfer voltage, that is, a peak-to-peak voltage.

As described above, the ripple voltage of the output voltage (transfer voltage) in the transfer power supply device 60 of FIG. 11A is determined based on the capacitor capacitances of the capacitors C1 and C3 connected in series to each other without interposing a plurality of diodes between the transformer T and the output terminal of the transfer voltage. A set of capacitors connected in series to each other as described above is referred to as "first capacitor group." That is, in the third embodiment, the first capacitor group includes the capacitors C1 and C3. Meanwhile, the capacitance of the capacitor C2 does not affect the ripple voltage. Accordingly, when the capacitance of the capacitor C2 is decreased, the falling time period of the transfer voltage at the time when the transfer voltage is caused to fall after the application of the transfer voltage to the transfer roller 12 is ended can be decreased without increasing the ripple voltage. As described above, a set of capacitors not included in the first capacitor group among the plurality of capacitors C1 to C3 is referred to as "second capacitor group." That is, in the third embodiment, the second capacitor group includes the capacitor C2. In view of the above, in the third embodiment, as the circuit configuration of the transfer power supply device 60, the capacitances of the capacitors C1, C2, and C3 are set to 300 pF, 50 pF, and 300 pF, respectively.

[Blank Area Caused by Poor Transfer]

Figure 12:
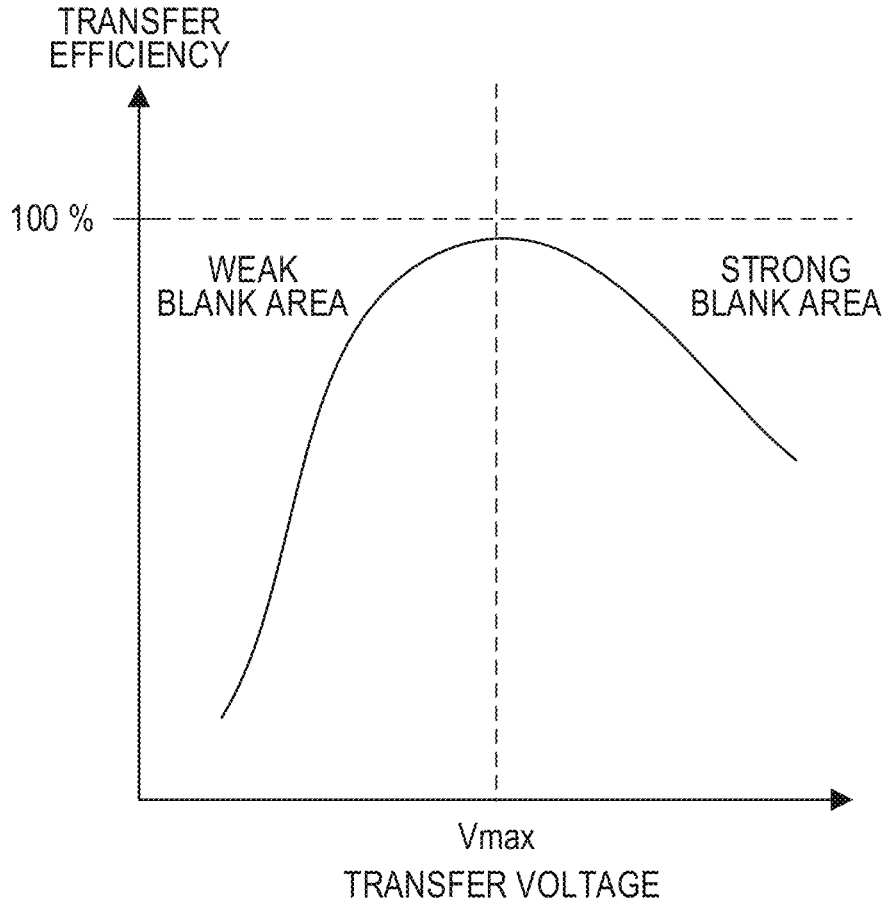
FIG. 12 is a graph for showing a correlation between a transfer voltage and transfer efficiency in the third embodiment.

As described above, in some cases, the ripple voltage of the transfer voltage to be applied to the transfer roller 12 may be increased to exceed a predetermined voltage range depending on the capacitor capacitance of the rectifier circuit of the transfer power supply device 60. When the ripple voltage is large, in some cases, the transfer voltage to be applied to the transfer roller 12 may vary so as to be higher or lower than the appropriate transfer voltage (first transfer voltage), which may result in causing an image defect called a "blank area caused by poor transfer." FIG. 12 is a graph for showing a correlation between transfer efficiency and the transfer voltage to be applied from the transfer power supply device 60 to the transfer roller 12. The vertical axis represents transfer efficiency (unit: %), and the horizontal axis represents transfer voltage (unit: V). In this case, the transfer efficiency refers to an index which is based on a difference between the toner mass per unit area before the toner image formed on the photosensitive drum 1 is transferred onto the recording material P and the toner mass per unit area after the transfer, and is defined as (Expression 5) below.

Transfer efficiency=(1−"toner mass per unit area on photosensitive drum after transfer"/"toner mass per unit area on photosensitive drum before transfer")×100 (Expression 5)

As shown in FIG. 12, the transfer efficiency is maximum at the time of an appropriate transfer voltage (Vmax of FIG. 12). When the transfer voltage is lower than the transfer voltage Vmax at which the transfer efficiency is maximum, the transfer voltage required for transferring the toner image formed on the photosensitive drum 1 onto the recording material P is insufficient, and thus the toner that has not been able to be transferred onto the recording material P remains on the photosensitive drum 1. Accordingly, the transfer efficiency is reduced. Such a phenomenon that the insufficient transfer voltage causes reduction of the transfer efficiency is referred to as "weak blank area." Meanwhile, when the transfer voltage is higher than the transfer voltage Vmax at which the transfer efficiency is maximum, in some cases, the polarity of the toner transferred onto the recording material P at the transfer nip portion may be reversed from negative to positive so that the toner is re-transferred onto the negative polarity photosensitive drum 1. Also in this case, the re-transferred toner remains on the photosensitive drum 1 after the transfer, and thus the transfer efficiency is reduced. Such a phenomenon that the transfer voltage higher than the appropriate transfer voltage Vmax causes reduction of the transfer efficiency is referred to as "strong blank area." The "weak blank area" and the "strong blank area" described above are collectively referred to as "blank area caused by poor transfer." When the "blank area caused by poor transfer" is caused, image defects such as missing of a toner image on the recording material P and a density difference may be caused. According to the studies conducted by the inventors, it is found that, when the image forming apparatus M including the transfer power supply device 60 of the third embodiment is used, the occurrence of the "blank area caused by poor transfer" can be suppressed by reducing the ripple voltage so as to fall within a predetermined voltage range, that is, equal to or smaller than 30 V.

[Control of Transfer Voltage]

Next, control of the transfer voltage in the transfer power supply device 60 in the third embodiment is described. The CPU 20 calculates the timing at which a leading edge and a trailing edge of the recording material P in the conveyance direction reach the transfer nip portion, based on the conveyance speed of the recording material P and on the timing at which the top sensor 10 arranged on the upstream of the transfer nip portion detects the leading edge and the trailing edge of the conveyed recording material P. In the third embodiment, the photosensitive drum 1 is driven to rotate at a circumferential speed of 250 mm/sec, and the recording material P is conveyed at roughly the same conveyance speed. In view of the above, the CPU 20 calculates a time period required until the leading edge of the recording material P reaches the transfer nip portion, based on the timing at which the top sensor 10 detects the leading edge of the recording material P, on the conveyance speed of the recording material P, and on a distance from the top sensor 10 to the transfer nip portion. Similarly, the CPU 20 calculates a time period required until the trailing edge of the recording material P reaches the transfer nip portion from the timing at which the top sensor 10 detects the trailing edge of the recording material P. The CPU 20 drives the transfer power supply device 60 based on the thus-calculated timing at which the leading edge and the trailing edge of the recording material P reach the transfer nip portion, to thereby control the transfer voltage.

Figures 13A, 13B, 13C:
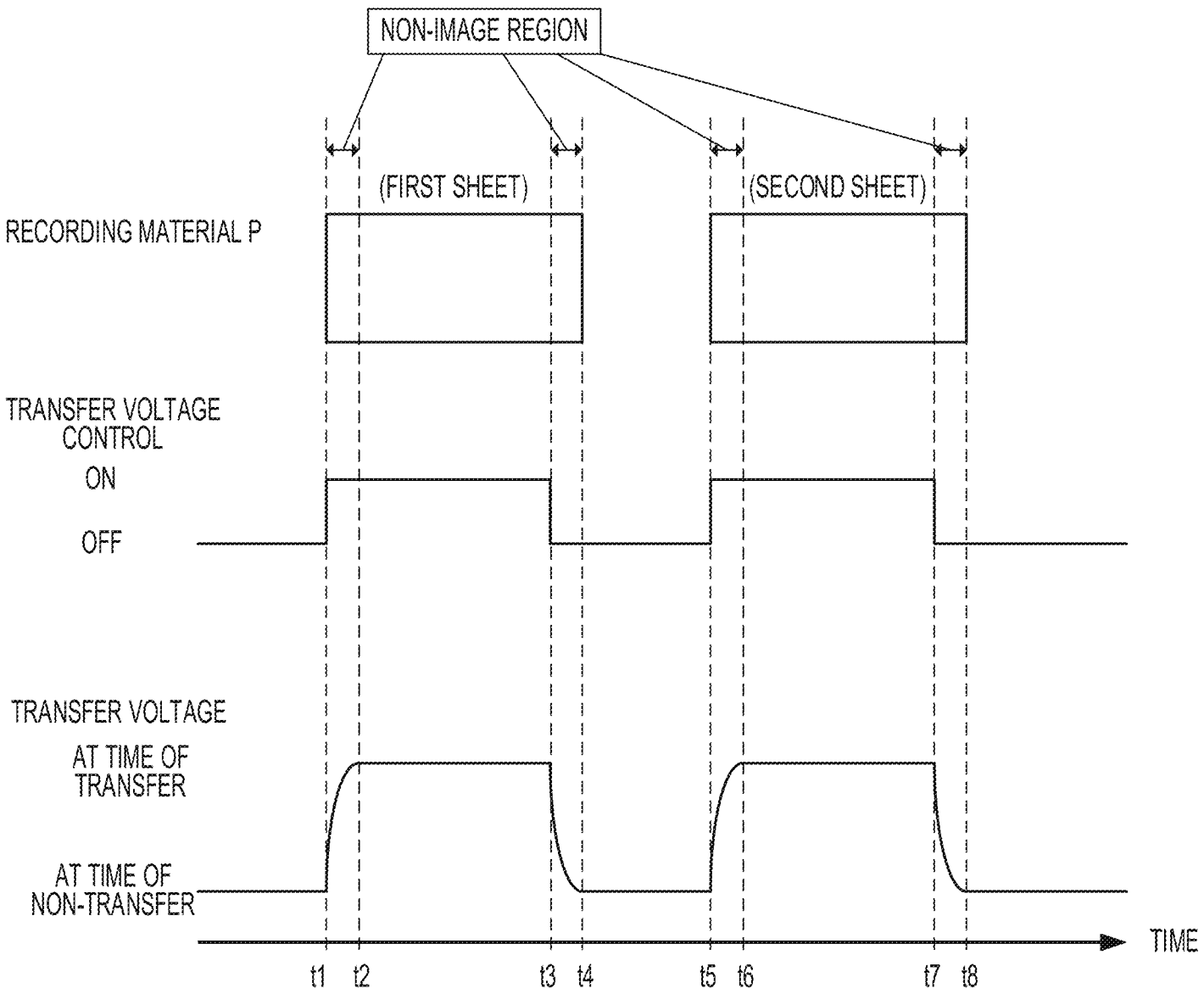
FIG. 13A, FIG. 13B, and FIG. 13C are timing charts for illustrating transfer voltage control in the third embodiment.

FIG. 13A, FIG. 13B, and FIG. 13C are charts for illustrating a control sequence performed by the CPU 20 to control the transfer voltage of the transfer power supply device 60. FIG. 13A, FIG. 13B, and FIG. 13C are charts for illustrating a state of the transfer voltage to be output from the transfer power supply device 60 when the recording material P is conveyed to the transfer nip portion. FIG. 13A is a view for illustrating a state in which two recording materials P are conveyed to the transfer nip portion. In the third embodiment, a region from each of the leading edge and the trailing edge of the recording material P in the conveyance direction to a portion on the inner side by 5 mm is set as a mask region (non-image region) in which no image formation is performed, and a region on the inner side of the mask region is set as an image region in which the image formation is allowed. Similarly, also on an end portion side of the recording material P in the direction orthogonal to the conveyance direction of the recording material P, a region from each end portion to a portion on the inner side by 5 mm is set as a mask region (non-image region) in which no image formation is performed, and a region on the inner side of the mask region is set as an image region in which the image formation is allowed. FIG. 13B shows a period of transfer voltage control of controlling the transfer voltage to be output from the transfer power supply device 60. In FIG. 13B, "OFF" represents a period in which the CPU 20 does not perform the control of the output voltage of the transfer power supply device 60, and "ON" represents a period in which the CPU 20 outputs the drive signal to the FET 1 of the transfer power supply device 60 so that the transfer voltage is applied to the transfer roller 12. As illustrated in FIG. 13B, the control is turned "ON" at the timing at which the leading edge of the recording material P reaches the transfer nip portion, and the control is turned "OFF" at the timing at which the trailing edge of the recording material P reaches the transfer nip portion. FIG. 13C is a chart for illustrating a voltage value of the transfer voltage to be output from the transfer power supply device 60. "AT TIME OF TRANSFER" represents a transfer voltage to be output during a period in which the toner image formed on the photosensitive drum 1 is transferred onto the recording material P, and "AT TIME OF NON-TRANSFER" represents a transfer voltage during a period in which the transfer of the toner image formed on the photosensitive drum 1 is not performed onto the recording material P. In FIG. 13A, FIG. 13B, and FIG. 13C, the horizontal axis represents time, and t1 to t8 represent time (timing).

In the third embodiment, the transfer voltage control is turned ON at the timing at which the leading edge of the recording material P reaches the transfer nip portion (times t1 and t5) (FIG. 13B). Then, the CPU 20 controls the transfer voltage to be output by the transfer power supply device 60 so that the transfer voltage rises to reach a voltage value at which the toner image formed on the photosensitive drum 1 can be transferred onto the recording material P by the time when the non-image region at the leading edge of the recording material P reaches the transfer nip portion (times t2 and t6) (FIG. 13C). Meanwhile, the transfer voltage control is turned OFF at the timing at which the portion on the inner side by 5 mm from the trailing edge of the recording material P reaches the transfer nip portion (times t3 and t7) (FIG. 13B). Then, the CPU 20 controls the transfer voltage to be output by the transfer power supply device 60 so that the transfer voltage falls to reach a transfer voltage value at which the above-mentioned "memory" is not caused by the time when the trailing edge of the recording material P exits from (passes through) the transfer nip portion (times t4 and t8) (FIG. 13C). In the image forming apparatus M of the third embodiment, the process speed is 250 mm/sec, and hence a time period required for the recording material P to be moved (conveyed) by 5 mm is about 20 msec. That is, the trailing edge of the recording material P exits from (passes through) the transfer nip portion after an elapse of 20 msec from when the transfer voltage control is turned OFF. Accordingly, in the third embodiment, within a period of 20 msec from when the transfer voltage control is turned OFF (from the timing at which the portion on the inner side by 5 mm from the trailing edge of the recording material P reaches the transfer nip portion), it is required to cause the transfer voltage to fall from the voltage at the time of transfer to the voltage at which no "memory" is caused. According to the studies conducted by the inventors, it is found that, in a case in which the image forming apparatus M of the third embodiment is used, no "memory" is caused as long as, when the trailing edge of the recording material P exits from the transfer nip portion, the transfer voltage has fallen to be equal to or lower than about 150 V (second transfer voltage).

[Evaluation Experiment of Third Embodiment]

Next, an evaluation experiment of the third embodiment is described. In the evaluation experiment, in addition to the above-mentioned combination of the capacitances of the capacitors C1, C2, and C3, as a third comparative example and a fourth comparative example, evaluation was also performed for the following combinations of capacitor capacitances different from that of the third embodiment. In the third comparative example, the capacitances of the capacitors C1, C2, and C3 were set to 300 pF, 300 pF, and 300 pF, respectively. Meanwhile, in the fourth comparative example, the capacitances of the capacitors C1, C2, and C3 were set to 300 pF, 300 pF, and 50 pF, respectively.

Further, in the evaluation experiment, the image forming apparatus M was installed under an environment having a temperature of 23° C. and a humidity of 50%. Further, as the recording material P, Vitality (produced by Xerox Corporation) having a letter (LTR) size and a basis weight of 75 g/m$^2$ was used. Under such an environment, an image having a density of 40% was printed successively on two recording materials P, and whether or not the image formed on the second recording material P had a "memory" due to the separation electric-discharge between the photosensitive drum 1 and the trailing edge of the first recording material P was checked. Further, the transfer power supply device 60 was controlled so that the transfer voltage at the time when the image region of the recording material P (region on the inner side of the portions on the inner side by 5 mm from the leading edge of the recording material P, the trailing edge thereof, and the end portion of the recording material on the side in the direction orthogonal to the conveyance direction) passed through the transfer nip portion was 2,000 V.

Table 3 is a table for showing experiment results of the evaluation experiment with the combinations of the capacitors C1, C2, and C3 in the first embodiment, the third comparative example, and the fourth comparative example described above. In Table 3, the experiment results of the third embodiment, the third comparative example, and the fourth comparative example are arranged in the vertical direction, and the following items are listed in the horizontal direction. That is, in the horizontal direction of Table 3, there are shown the capacitances (unit: pF) of the capacitors C1, C2, and C3, the ripple voltage (unit: V) in the transfer voltage, and the transfer voltage (unit: V) at the time when the first recording material P exits from (passes through) the transfer nip portion. Further, in the horizontal direction of Table 3, there are shown whether or not there is an image defect in a state of a lateral black streak accompanying the occurrence of the "memory," and whether or not there is a blank area caused by poor transfer to be caused due to the ripple voltage of the transfer voltage. The "memory" was evaluated as x (bad) when the image defect was caused, and as o (good) when no image defect was caused. Similarly, the "blank area caused by poor transfer" was evaluated as x (bad) when the "blank area caused by poor transfer" was caused, and as o (good) when no "blank area caused by poor transfer" was caused.

TABLE 3

| | Electrostatic capacitance of capacitor [pF] | | | Ripple voltage | Transfer voltage [V] at time when first recording material exits from transfer | | "Blank area caused by poor |
|---|---|---|---|---|---|---|---|
| | C1 | C2 | C3 | [V] | nip portion | "Memory" | transfer" |
| Third embodiment | 300 | 50 | 300 | 11 | 100 | o | o |
| Third comparative example | 300 | 300 | 300 | 11 | 400 | x | o |
| Fourth comparative example | 300 | 300 | 50 | 35 | 100 | o | x |

Figure 14A:
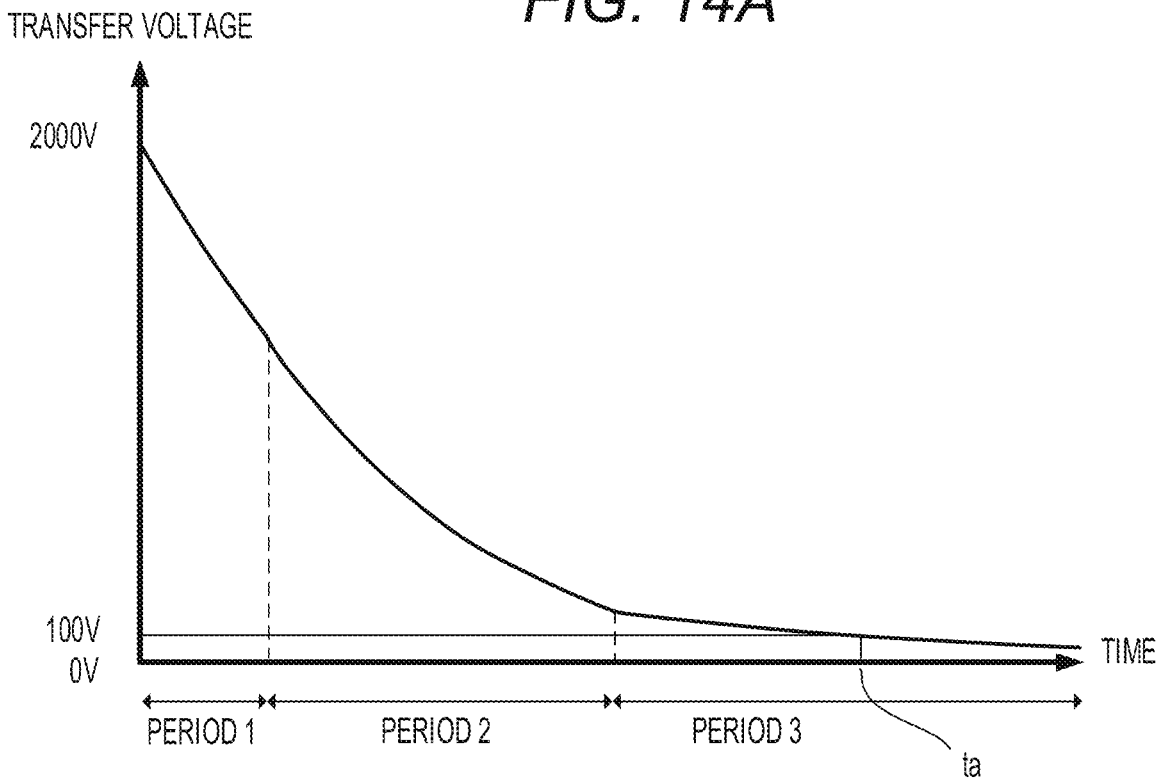
FIG. 14A, FIG. 14B, and FIG. 14C are charts for illustrating voltage waveforms at the time of a falling edge of the transfer voltage in the third embodiment.
Figure 14B:
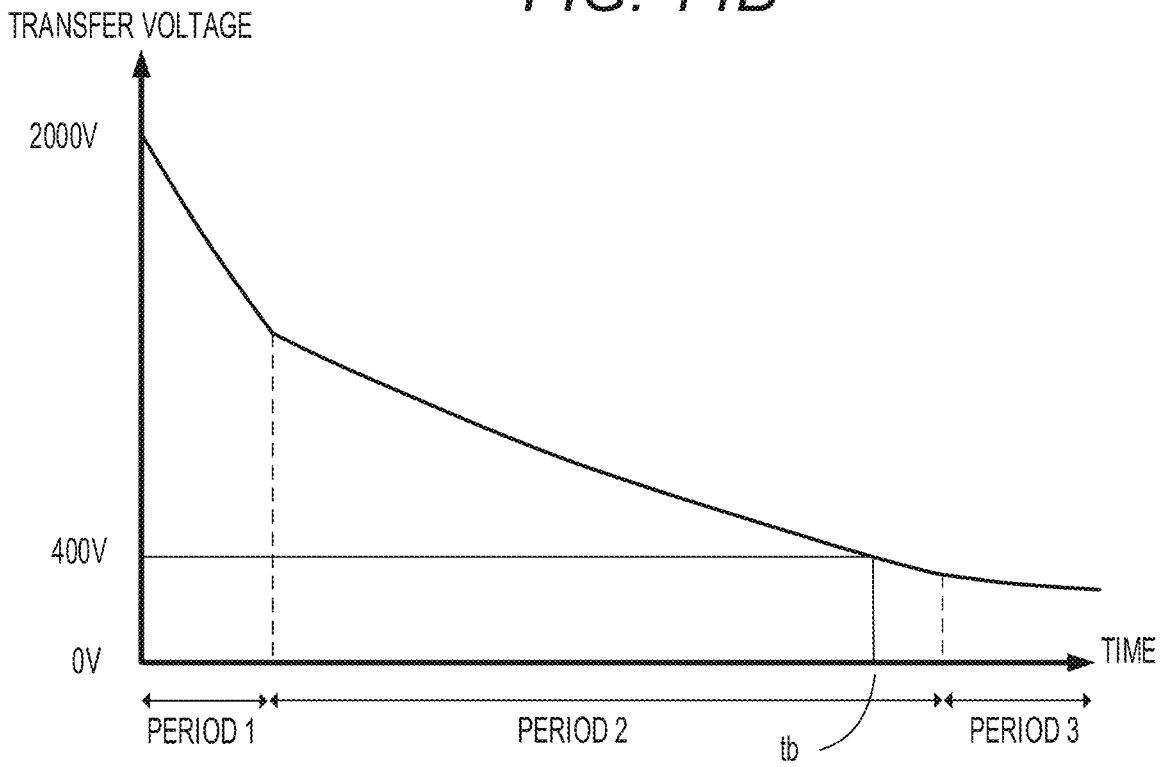
Figure 14C:
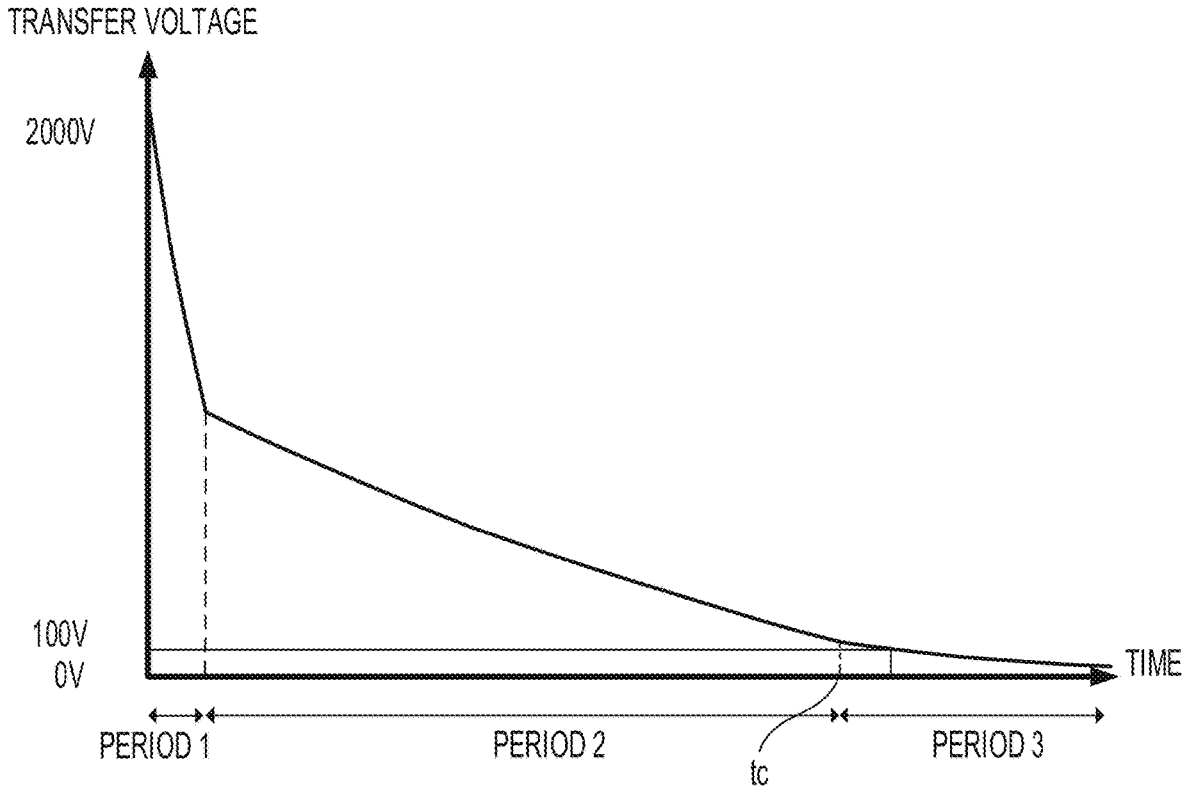

Further, FIG. 14A, FIG. 14B, and FIG. 14C are waveform charts for illustrating a falling state of the transfer voltage in a case in which the transfer voltage control is turned "OFF" while the above-mentioned evaluation experiment is performed. FIG. 14A shows the falling state of the transfer voltage in the third embodiment, FIG. 14B shows the falling state of the transfer voltage in the third comparative example, and FIG. 14C shows the falling state of the transfer voltage in the fourth comparative example 4. In FIG. 14A, FIG. 14B, and FIG. 14C, the vertical axis represents voltage, the horizontal axis represents time, and "ta" of FIG. 14A, "tb" of FIG. 14B, and "tc" of FIG. 14C represent time (timing). Further, in the horizontal axis of FIG. 14A, FIG. 14B, and FIG. 14C, a "period 1," a "period 2," and a "period 3" represent the following periods. That is, the "period 1" is a period from when the output of the transfer voltage from the transfer power supply device 60 is stopped so that the discharge of the capacitor is started to when the charged voltages of the capacitors C1 and C3 connected in series to each other become equal to the charged voltage of the capacitor C2. The "period 2" is a period from when the charged voltages of the capacitors C1 and C3 connected in series to each other become equal to the charged voltage of the capacitor C2 to when one of the capacitor C1 and the capacitor C3 is discharged so that the charged voltage becomes 0. The "period 3" is a period from when one of the capacitor C1 and the capacitor C3 is discharged so that the charged voltage becomes 0 to when the charged voltage of another one of the capacitor C1 and the capacitor C3 and the charged voltage of the capacitor C2 are discharged so that the charged voltages become 0.

Figure 15A:
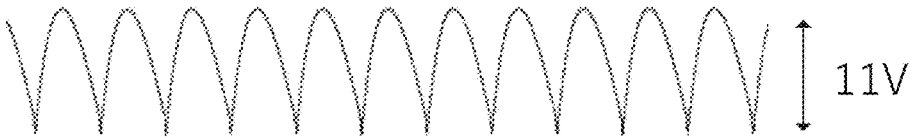
FIG. 15A is a chart for illustrating a ripple voltage of the transfer voltage in the third embodiment.
Figure 15B:
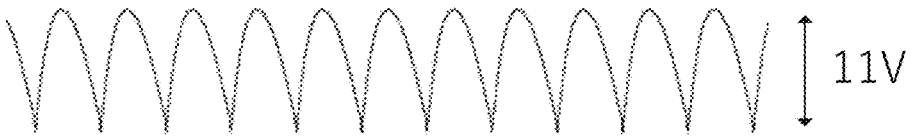
FIG. 15B is a chart for illustrating a ripple voltage of the transfer voltage in a third comparative example.
Figure 15C:
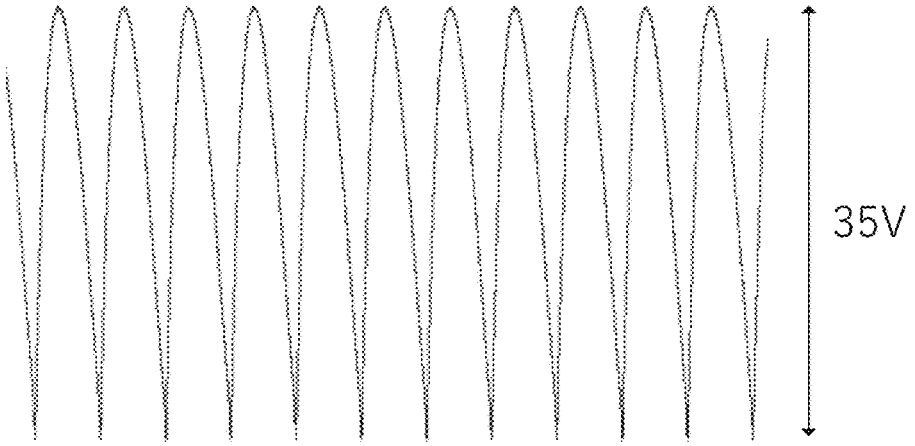
FIG. 15C is a chart for illustrating a ripple voltage of the transfer voltage in a fourth comparative example.

FIG. 15A is a waveform chart for illustrating a state of the ripple voltage in the transfer voltage applied from the transfer power supply device 60 to the transfer roller 12 in the period in which the transfer voltage control is turned "ON" while the above-mentioned evaluation experiment is performed. FIG. 15A shows the state of the ripple voltage in the third embodiment, FIG. 15B shows the state of the ripple voltage in the third comparative example, and FIG. 15C shows the state of the ripple voltage in the fourth comparative example. In FIG. 15A, FIG. 15B, and FIG. 15C, the vertical direction represents voltage, and the horizontal direction represents time.

As shown in Table 3, in the combination of the capacitances of the capacitors C1, C2, and C3 in the third embodiment, no lateral black streak accompanying the occurrence of the "memory" was caused, and also no "blank area caused by poor transfer" due to the ripple voltage of the transfer voltage was caused. As shown in Table 3, the transfer voltage at the time when the first recording material P exited from (passed through) the transfer nip portion was 100 V, and the ripple voltage at the time when the transfer voltage was applied to the transfer roller 12 was 11 V. In the third embodiment, the capacitances of the capacitors C1, C2, and C3 were set to 300 pF, 50 pF, and 300 pF, respectively. In this manner, the transfer voltage was able to rapidly fall (decrease) so that the transfer voltage at the time when the trailing edge of the recording material P exited from the transfer nip portion was equal to or lower than 150 V at which no "memory" was caused. Further, the ripple voltage was reduced to be equal to or lower than 30 V at which no "blank area caused by poor transfer" was caused. In this manner, the occurrence of the blank area caused by poor transfer was able to be suppressed.

Further, the voltage waveform of the falling edge of the transfer voltage in the case of the third embodiment is as illustrated in FIG. 14A. In the third embodiment, in the rectifier circuit of the transfer power supply device 60, the capacitance of the capacitor C2 to be charged by the double rectified voltage is set to be smaller than the capacitance of each of the capacitors C1 and C3. In this manner, in the period 2, the discharge speed of the capacitor C2 is increased as compared to the third comparative example and the fourth comparative example. In this manner, the transfer voltage at the time "ta" at which the trailing edge of the recording material P exits from the transfer nip portion becomes 100 V, and thus there is achieved the falling edge of the transfer voltage to a voltage at which no "memory" is caused by the time when the trailing edge of the recording material P exits from the transfer nip portion. Further, as illustrated in FIG. 15A, the ripple voltage of the transfer voltage in the third embodiment is reduced to 11 V because the capacitance of the capacitor C3 is set to 300 pF. As described above, when the ripple voltage is reduced to be equal to or lower than 30 V, there is achieved the suppression of the occurrence of the "blank area caused by poor transfer."

Meanwhile, as shown in Table 3, in the combination of the capacitances of the capacitors C1, C2, and C3 in the third comparative example, no "blank area caused by poor transfer" due to the ripple voltage of the transfer voltage was caused, but the lateral black streak accompanying the occurrence of the "memory" was caused. As shown in Table 3, the transfer voltage at the time when the first recording material P exited from (passed through) the transfer nip portion was 400 V, and the ripple voltage at the time when the transfer voltage was applied to the transfer roller 12 was 11 V. In the third comparative example, the capacitances of the capacitors C1, C2, and C3 are all 300 pF, and all capacitor capacitances are the same and large. Accordingly, as shown in Table 3, the transfer voltage at the time when the first recording material P exits from (passes through) the transfer nip portion falls only to 400 V. The voltage waveform of the falling edge of the transfer voltage in the case of the third comparative example is as illustrated in FIG. 14B. As illustrated in FIG. 14B, the falling edge curve of the transfer voltage is gentler as compared to the third embodiment. Accordingly, the transfer voltage at the time "tb" at which the trailing edge of the recording material P exits from the transfer nip portion is 400 V, and the transfer voltage does not fall to be equal to or lower than the voltage 150 V at which no "memory" is caused by the time when the trailing edge of the recording material P exits from the transfer nip portion. Thus, the occurrence of the "memory" was not able to be suppressed. Meanwhile, as illustrated in FIG. 15B, the ripple voltage of the transfer voltage in the third comparative example is reduced to 11 V because the capacitance of the capacitor C3 is set to 300 pF. Thus, the occurrence of the "blank area caused by poor transfer" was suppressed.

Further, as shown in Table 3, in the combination of the capacitances of the capacitors C1, C2, and C3 in the fourth comparative example, no lateral black streak accompanying the occurrence of the "memory" was caused, but the "blank area caused by poor transfer" due to the ripple voltage of the transfer voltage was caused. As shown in Table 3, the transfer voltage at the time when the first recording material P exited from (passed through) the transfer nip portion was 100 V, and the ripple voltage at the time when the transfer voltage was applied to the transfer roller 12 was 35 V. The voltage waveform of the falling edge of the transfer voltage in the case of the fourth comparative example is as illustrated in FIG. 14C. As illustrated in FIG. 14C, in the fourth comparative example, in the rectifier circuit of the transfer power supply device 60, the capacitance of the capacitor C3 to be charged by the double rectified voltage is decreased so that the discharge speed of the capacitor in the period 1 is increased. In this manner, the transfer voltage at the time "tc" at which the trailing edge of the recording material P exits from the transfer nip portion becomes 100 V, and there is achieved the falling edge of the transfer voltage to be equal to or lower than the voltage 150 V at which no "memory" is caused by the time when the trailing edge of the recording material P exits from the transfer nip portion. Meanwhile, as illustrated in FIG. 15C, the ripple voltage of the transfer voltage in the fourth comparative example is 35 V because the capacitance of the capacitor C3 is set to 50 pF. Thus, the "blank area caused by poor transfer" was caused.

As described above, according to the third embodiment, the transfer voltage is caused to fall fast so that the occurrence of the "memory" can be suppressed, and the ripple voltage of the transfer voltage is reduced so that the occurrence of the "blank area caused by poor transfer" can be suppressed. In this manner, image defects such as the blank area caused by poor transfer and the density unevenness can be suppressed, and satisfactory image formation without image defects can be performed.

In the third embodiment, the configuration in which the CPU 20 for controlling the image forming apparatus M controls the transfer power supply device 60 has been described. For example, the transfer power supply device 60 may include a dedicated CPU for controlling the transfer power supply device 60, and the dedicated CPU may be configured to perform transfer voltage output control based on the instruction from the CPU 20 of the image forming apparatus M.

As described above, according to the third embodiment, image defects caused by charging unevenness of the photosensitive drum due to the transfer step and remaining of the toner image on the photosensitive drum can be suppressed.

Other Embodiments

In the third embodiment described above, the voltage tripler rectifier circuit is used as the rectifier circuit of the positive polarity power supply circuit of the transfer power supply device 60, but the effects of the present disclosure are not limited thereto. For example, the present disclosure is also applicable to voltage quadrupler to voltage sextupler rectifier circuits, and effects similar to those in the voltage tripler rectifier circuit can be produced.

[Voltage Quadrupler Rectifier Circuit]

Figure 16:
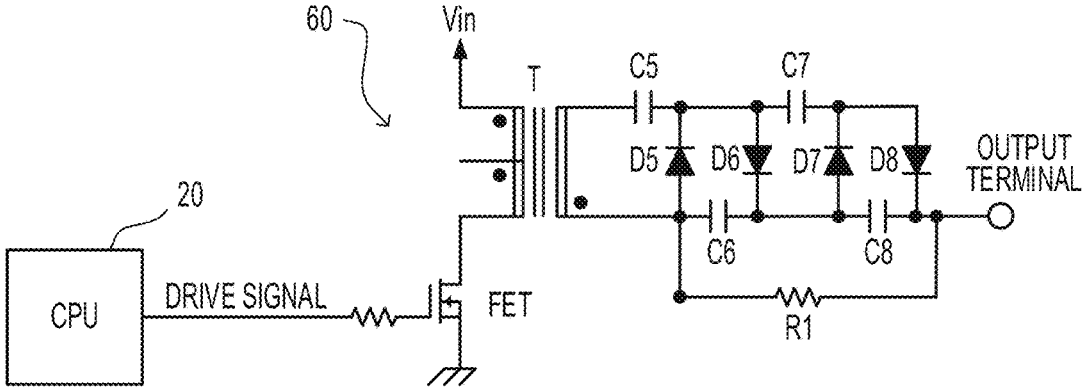
FIG. 16 is a schematic circuit diagram for illustrating a circuit configuration of a transfer power supply device in another embodiment.

FIG. 16 is a circuit diagram for illustrating a main circuit configuration of a transfer power supply device 60 including a voltage quadrupler rectifier circuit. The transfer power supply device 60 illustrated in FIG. 16 includes a transformer T and an FET. The transformer T includes a primary coil and a secondary coil. The FET is to be switched in response to a drive signal output from the CPU 20. Further, the transfer power supply device 60 includes, on a secondary side of the transformer T, the voltage quadrupler rectifier circuit configured to rectify a voltage induced on the secondary side of the transformer T. The voltage quadrupler rectifier circuit includes diodes D5, D6, D7, and D8 and capacitors C5, C6, C7, and C8. In FIG. 16, the circuit configuration excluding the voltage quadrupler rectifier circuit is similar to the circuit configuration of the transfer power supply device 60 of FIG. 11A described above, and description thereof is omitted here.

In FIG. 16, one end of the secondary coil of the transformer T1 is connected to one end of the capacitor C5. Another end of the capacitor C5 is connected to a cathode terminal of the diode D5, an anode terminal of the diode D6, and one end of the capacitor C7. Further, another end of the capacitor C7 is connected to a cathode terminal of the diode D7 and an anode terminal of the diode D8. Another end of the secondary coil of the transformer T is connected to an anode terminal of the diode D5 and one end of the capacitor C6. Another end of the capacitor C6 is connected to a cathode terminal of the diode D6, an anode terminal of the diode D7, and one end of the capacitor C8. Another end of the capacitor C8 is connected to a cathode terminal of the diode D8 and the output terminal.

In FIG. 16, the capacitor C5 is charged by +Vo being the half-wave rectified voltage of the output voltage of the transformer T, and the capacitors C6, C7, and C8 are each charged by +2Vo being the double rectified voltage of the output voltage of the transformer T. In this manner, a voltage of +4Vo is output from the transfer power supply device 60.

The ripple voltage of the output voltage (transfer voltage) in the transfer power supply device 60 of FIG. 16 is determined based on the capacitor capacitances of the capacitors C6 and C8 connected in series to each other, and the capacitances of the capacitors C5 and C7 do not affect the ripple voltage. Accordingly, when the capacitances of the capacitors C5 and C7 are decreased, the falling time period of the transfer voltage at the time when the transfer voltage is caused to fall after the application of the transfer voltage to the transfer roller 12 is ended can be decreased without increasing the ripple voltage, and the occurrence of the "memory" can be suppressed. Further, when the capacitor capacitances of the capacitors C6 and C8 connected in series to each other are set to capacitances with which a ripple voltage falls within a predetermined voltage range, the occurrence of the "blank area caused by poor transfer" can be suppressed.

[Voltage Quintupler Rectifier Circuit]

Figure 17:
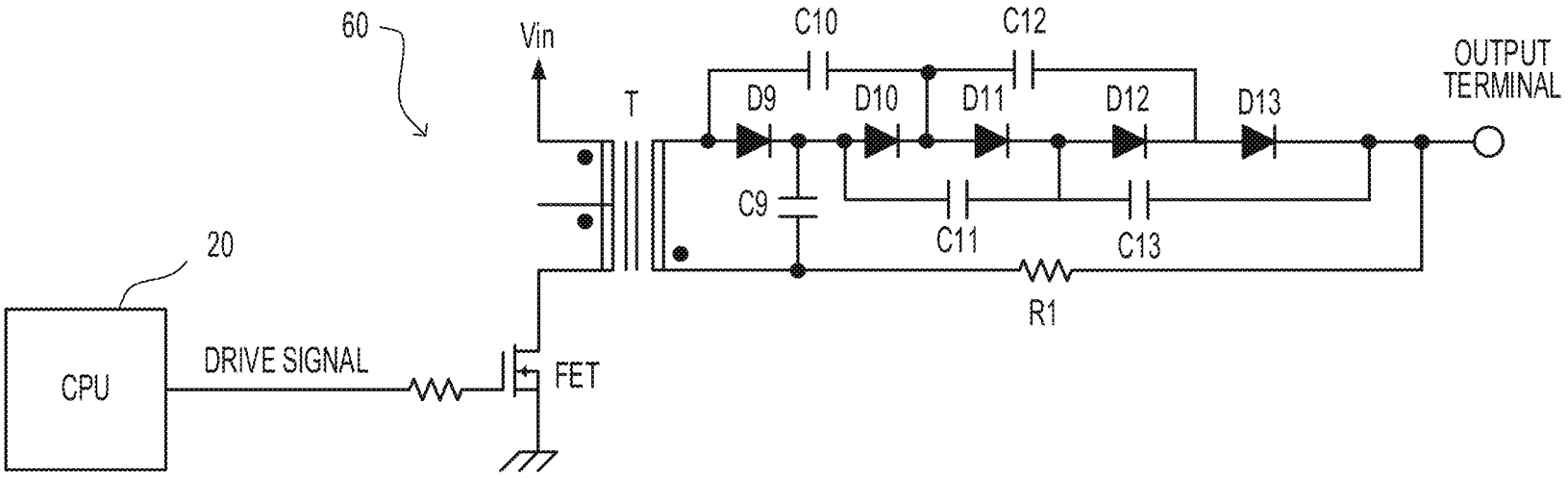
FIG. 17 is a schematic circuit diagram for illustrating a circuit configuration of a transfer power supply device in another embodiment.

FIG. 17 is a circuit diagram for illustrating a main circuit configuration of a transfer power supply device 60 including a voltage quintupler rectifier circuit. The transfer power supply device 60 illustrated in FIG. 17 includes a transformer T and an FET. The transformer T includes a primary coil and a secondary coil. The FET is to be switched in response to a drive signal output from the CPU 20. Further, the transfer power supply device 60 includes, on a secondary side of the transformer T, the voltage quintupler rectifier circuit configured to rectify a voltage induced on the secondary side of the transformer T. The voltage quintupler rectifier circuit includes diodes D9, D10, D11, D12, and D13 and capacitors C9, C10, C11, C12, and C13. In FIG. 17, the circuit configuration excluding the voltage quintupler rectifier circuit is similar to the circuit configuration of the transfer power supply device 60 of FIG. 11A described above, and description thereof is omitted here.

One end of the secondary coil of the transformer T is connected to an anode terminal of the diode D9 and one end of the capacitor C1. A cathode terminal of the diode D9 is connected to an anode terminal of the diode D10, one end of the capacitor C9, and one end of the capacitor C11. A cathode terminal of the diode D10 is connected to an anode terminal of the diode D11, another end of the capacitor C10, and one end of the capacitor C12. A cathode terminal of the diode D11 is connected to an anode terminal of the diode D12, another end of the capacitor C11, and one end of the capacitor C13. A cathode terminal of the diode D12 is connected to an anode terminal of the diode D13 and another end of the capacitor C12. A cathode terminal of the diode D13 is connected to another end of the capacitor C13 and the output terminal. Another end of the secondary coil of the transformer T is connected to another end of the capacitor C9.

In FIG. 17, the capacitor C9 is charged by +Vo being the half-wave rectified voltage of the output voltage of the transformer T, and the capacitors C10, C11, C12, and C13 are each charged by +2Vo being the double rectified voltage of the output voltage of the transformer T. In this manner, a voltage of +5Vo is output from the positive polarity power supply circuit.

The ripple voltage of the output voltage (transfer voltage) in the transfer power supply device 60 of FIG. 17 is determined based on the capacitor capacitances of the capacitors C9, C11, and C13 connected in series to each other, and the capacitances of the capacitors C10 and C12 do not affect the ripple voltage. Accordingly, when the capacitances of the capacitors C10 and C12 are decreased, the falling time period of the transfer voltage at the time when the transfer voltage is caused to fall after the application of the transfer voltage to the transfer roller 12 is ended can be decreased without increasing the ripple voltage, and the occurrence of the "memory" can be suppressed. Further, when the capacitor capacitances of the capacitors C9, C11, and C13 connected in series to each other are set to capacitances with which the ripple voltage falls within a predetermined voltage range, the occurrence of the "blank area caused by poor transfer" can be suppressed.

[Voltage Sextupler Rectifier Circuit]

Figure 18:
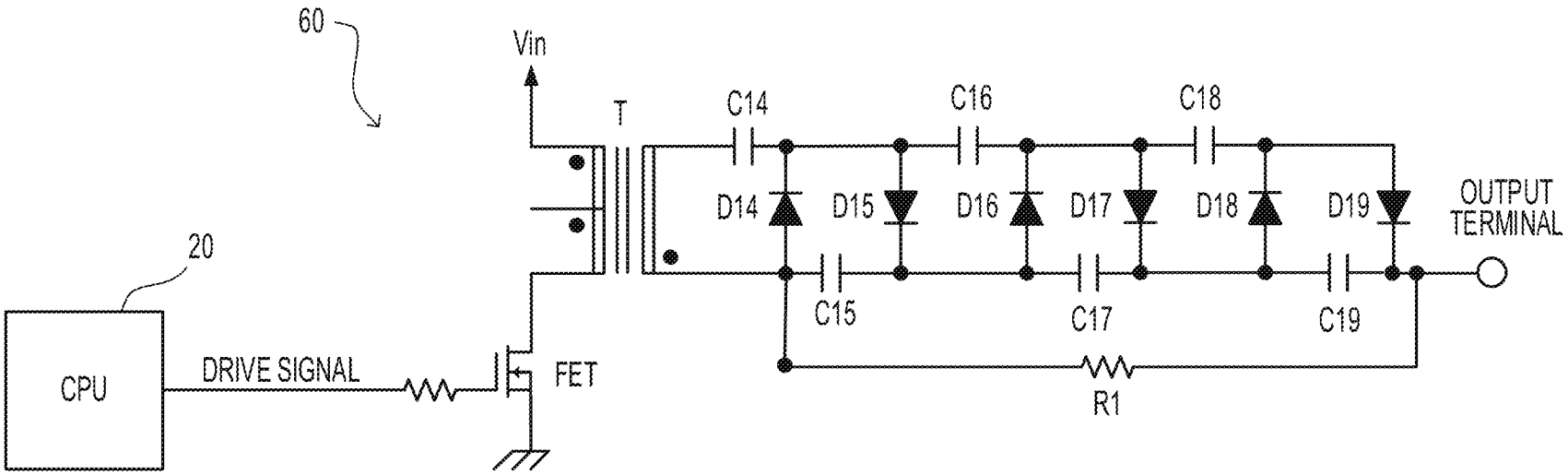
FIG. 18 is a schematic circuit diagram for illustrating a circuit configuration of a transfer power supply device in another embodiment.

FIG. 18 is a circuit diagram for illustrating a main circuit configuration of a transfer power supply device 60 including a voltage sextupler rectifier circuit. The transfer power supply device 60 illustrated in FIG. 18 includes a transformer T and an FET. The transformer T includes a primary coil and a secondary coil. The FET is to be switched in response to a drive signal output from the CPU 20. Further, the transfer power supply device 60 includes, on a secondary side of the transformer T, the voltage sextupler rectifier circuit configured to rectify a voltage induced on the secondary side of the transformer T. The voltage sextupler rectifier circuit includes diodes D14, D15, D16, D17, D18, and D19 and capacitors C14, C15, C16, C17, C18, and C19. In FIG. 18, the circuit configuration excluding the voltage sextupler rectifier circuit is similar to the circuit configuration of the transfer power supply device 60 of FIG. 11A described above, and description thereof is omitted here.

In FIG. 18, one end of the secondary coil of the transformer T is connected to one end of the capacitor C14. Another end of the capacitor C14 is connected to a cathode terminal of the diode D14, an anode terminal of the diode D15, and one end of the capacitor C16. Further, another end of the capacitor C16 is connected to a cathode terminal of the diode D16, an anode terminal of the diode D17, and one end of the capacitor C18. Further, another end of the capacitor C18 is connected to a cathode terminal of the diode D18 and an anode terminal of the diode D19.

Another end of the secondary coil of the transformer T is connected to an anode terminal of the diode D14 and one end of the capacitor C15. Another end of the capacitor C15 is connected to a cathode terminal of the diode D15, an anode terminal of the diode D16, and one end of the capacitor C17. Another end of the capacitor C17 is connected to a cathode terminal of the diode D17, an anode terminal of the diode D18, and one end of the capacitor C19. Another end of the capacitor C19 is connected to a cathode terminal of the diode D19 and the output terminal.

In FIG. 18, the capacitor C14 is charged by +Vo being the half-wave rectified voltage of the output voltage of the transformer T, and the capacitors C15, C16, C17, C18, and C19 are each charged by +2Vo being the double rectified voltage of the output voltage of the transformer T. In this manner, a voltage of +6Vo is output from the positive polarity power supply circuit.

The ripple voltage of the output voltage (transfer voltage) in the transfer power supply device 60 of FIG. 18 is determined based on the capacitor capacitances of the capacitors C15, C17, and C19 connected in series to each other, and the capacitances of the capacitors C14, C16, and C18 do not affect the ripple voltage. Accordingly, when the capacitances of the capacitors C14, C16, and C18 are decreased, the falling time period of the transfer voltage at the time when the transfer voltage is caused to fall after the application of the transfer voltage to the transfer roller 12 is ended can be decreased without increasing the ripple voltage. In this manner, the occurrence of the "memory" can be suppressed. Further, when the capacitor capacitances of the capacitors C15, C17, and C19 connected in series to each other are set to capacitances with which the ripple voltage falls within a predetermined voltage range, the occurrence of the "blank area caused by poor transfer" can be suppressed.

As described above, the present disclosure is also applicable to voltage quadrupler to voltage sextupler rectifier circuits. Among capacitors forming a voltage multiplier rectifier circuit for outputting an "n"-time voltage, where "n" is 3 or more, a capacitor excluding capacitors connected in series to each other without interposing diodes between the transformer T and the output terminal of the transfer power supply device 60 is set to have a small capacitance, thereby being capable of suppressing the occurrence of the "memory." Further, the capacitors connected in series to each other without interposing diodes between the transformer T and the output terminal of the transfer power supply device 60 are set to have capacitances with which the ripple voltage falls within a predetermined voltage range, thereby being capable of suppressing the occurrence of the "blank area caused by poor transfer."

As described above, according to other embodiments, image defects caused by charging unevenness of the photosensitive drum due to the transfer step and remaining of the toner image on the photosensitive drum can be suppressed.

In the above-mentioned first to third embodiments, the monochrome image forming apparatus M configured to transfer the toner image onto the recording material P from the photosensitive drum 1 being an image bearing member has been described as an example. However, the present disclosure is not limited thereto. The present disclosure may be applied to a so-called tandem color image forming apparatus including photosensitive drums corresponding to toners of four colors of yellow, magenta, cyan, and black, and an intermediate transfer belt. In the case of this configuration, toner images of respective colors are sequentially transferred onto the intermediate transfer belt from the photosensitive drums corresponding to the respective colors. The color toner images formed as described above are transferred from the intermediate transfer belt onto the recording material P so that color toner images are formed on the recording material P. The intermediate transfer belt being an image bearing member forms a nip portion together with a secondary transfer roller, and the toner images are transferred when the secondary transfer roller is applied with a transfer voltage. The above-mentioned transfer power supply device 50 or transfer power supply device 60 can be applied as a device for outputting the transfer voltage to this secondary transfer roller.

While example embodiments have been described in the present disclosure, it is to be understood that the invention is not limited to the disclosed example embodiments. The scope of the following claims is to be accorded the broadest interpretation so as to encompass all such modifications and equivalent structures and functions.

This application claims the benefit of Japanese Patent Application No. 2020-209702, filed Dec. 17, 2020, and Japanese Patent Application No. 2020-209700, filed Dec. 17, 2020, which are hereby incorporated by reference herein in their entirety.

What is claimed is:

1. An image forming apparatus, comprising:

an image bearing member;

a transfer portion which forms a nip portion together with the image bearing member, and is configured to transfer a toner image formed on the image bearing member onto a recording material;

a transfer power supply portion configured to output a transfer voltage to the transfer portion so as to transfer the toner image onto the recording material, the transfer power supply portion including:

a first power supply portion configured to output a voltage having a positive polarity, the first power supply portion including:

a first transformer including a primary coil and a secondary coil;

a first switching portion configured to perform a switching operation of a current flowing through the primary coil based on a drive signal; and a first rectifier circuit portion configured to rectify and amplify an AC voltage generated in the secondary coil of the first transformer by the switching operation of the first switching portion, and to output an amplified voltage; and a second power supply portion configured to output a voltage having a negative polarity, wherein the transfer power supply portion is configured to superimpose the voltage output from the first power supply portion and the voltage output from the second power supply portion so as to output a superimposed voltage to the transfer portion as the transfer voltage; and a controller configured to control the transfer power supply portion by outputting the drive signal to the first switching portion, wherein the first rectifier circuit portion includes a plurality of diodes and a plurality of capacitors, wherein the plurality of capacitors include a predetermined capacitor to be charged by a half-wave rectified voltage of the AC voltage generated in the secondary coil of the first transformer and a capacitor to be charged by a voltage higher than the half-wave rectified voltage, and wherein a capacitance of the predetermined capacitor is larger than a capacitance of the capacitor to be charged by the voltage higher than the half-wave rectified voltage.

2. The image forming apparatus according to claim 1, wherein the controller is configured to control the transfer power supply portion by outputting the drive signal to the first switching portion, so that a first transfer voltage is output from the transfer power supply portion when a leading edge of the recording material reaches the nip portion and a second transfer voltage lower than the first transfer voltage is output from the transfer power supply portion when a trailing edge of the recording material reaches the nip portion.

3. The image forming apparatus according to claim 1, wherein the first rectifier circuit portion is a voltage tripler rectifier circuit in which the plurality of diodes include a first diode, a second diode, and a third diode, and the plurality of capacitors include a first capacitor, a second capacitor, and a third capacitor, wherein an anode terminal of the first diode is connected to one end of the secondary coil of the first transformer, and a cathode terminal of the first diode is connected to an anode terminal of the second diode and one end of each of the first capacitor and the third capacitor, wherein a cathode terminal of the second diode is connected to an anode terminal of the third diode and one end of the second capacitor, wherein a cathode terminal of the third diode is connected to another end of the third capacitor and an output terminal configured to output the voltage to the transfer portion, wherein another end of the second capacitor is connected to the one end of the secondary coil of the first transformer, wherein another end of the first capacitor is connected to another end of the secondary coil of the first transformer, and wherein a capacitance of the first capacitor is larger than a capacitance of each of the second capacitor and the third capacitor.

4. The image forming apparatus according to claim 1, wherein the first rectifier circuit portion is a voltage quadrupler rectifier circuit in which the plurality of diodes include a first diode, a second diode, a third diode, and a fourth diode, and the plurality of capacitors include a first capacitor, a second capacitor, a third capacitor, and a fourth capacitor, wherein one end of the first capacitor is connected to one end of the secondary coil of the first transformer, and another end of the first capacitor is connected to a cathode terminal of the first diode, an anode terminal of the second diode, and one end of the third capacitor, wherein another end of the third capacitor is connected to a cathode terminal of the third diode and an anode terminal of the fourth diode, wherein an anode terminal of the first diode and one end of the second capacitor are connected to another end of the secondary coil of the first transformer, wherein another end of the second capacitor is connected to a cathode terminal of the second diode, an anode terminal of the third diode, and one end of the fourth capacitor, wherein another end of the fourth capacitor is connected to a cathode terminal of the fourth diode and an output terminal configured to output the voltage to the transfer portion, and wherein a capacitance of the first capacitor is larger than a capacitance of each of the second capacitor, the third capacitor, and the fourth capacitor.

5. The image forming apparatus according to claim 1, wherein the first rectifier circuit portion is a voltage quintupler rectifier circuit in which the plurality of diodes include a first diode, a second diode, a third diode, a fourth diode, and a fifth diode, and the plurality of capacitors include a first capacitor, a second capacitor, a third capacitor, a fourth capacitor, and a fifth capacitor, wherein an anode terminal of the first diode and one end of the second capacitor are connected to one end of the secondary coil of the first transformer, wherein another end of the second capacitor is connected to a cathode terminal of the second diode, an anode terminal of the third diode, and one end of the fourth capacitor, wherein another end of the fourth capacitor is connected to a cathode terminal of the fourth diode and an anode terminal of the fifth diode, wherein a cathode terminal of the first diode is connected to one end of the first capacitor, one end of the third capacitor, and an anode terminal of the second diode, wherein another end of the third capacitor is connected to a cathode terminal of the third diode, an anode terminal of the fourth diode, and one end of the fifth capacitor, wherein a cathode terminal of the fifth diode is connected to another end of the fifth capacitor and an output terminal configured to output the voltage to the transfer portion, wherein another end of the first capacitor is connected to another end of the secondary coil of the first transformer, and wherein a capacitance of the first capacitor is larger than a capacitance of each of the second capacitor, the third capacitor, the fourth capacitor, and the fifth capacitor.

6. The image forming apparatus according to claim 1, wherein the first rectifier circuit portion is a voltage sextupler rectifier circuit in which the plurality of diodes include a first diode, a second diode, a third diode, a fourth diode, a fifth diode, and a sixth diode, and the plurality of capacitors include a first capacitor, a second capacitor, a third capacitor, a fourth capacitor, a fifth capacitor, and a sixth capacitor, wherein one end of the first capacitor is connected to one end of the secondary coil of the first transformer, and another end of the first capacitor is connected to a cathode terminal of the first diode, an anode terminal of the second diode, and one end of the third capacitor, wherein another end of the third capacitor is connected to a cathode terminal of the third diode, an anode terminal of the fourth diode, and one end of the fifth capacitor, wherein another end of the fifth capacitor is connected to a cathode terminal of the fifth diode and an anode terminal of the sixth diode, wherein an anode terminal of the first diode and one end of the second capacitor are connected to another end of the secondary coil of the first transformer, wherein another end of the second capacitor is connected to a cathode terminal of the second diode, an anode terminal of the third diode, and one end of the fourth capacitor, wherein another end of the fourth capacitor is connected to a cathode terminal of the fourth diode, an anode terminal of the fifth diode, and one end of the sixth capacitor, wherein a cathode terminal of the sixth diode is connected to another end of the sixth capacitor and an output terminal configured to output the voltage to the transfer portion, and wherein a capacitance of the first capacitor is larger than a capacitance of each of the second capacitor, the third capacitor, the fourth capacitor, the fifth capacitor, and the sixth capacitor.

7. The image forming apparatus according to claim 1, wherein the second power supply portion includes:

a second transformer including a primary coil and a secondary coil;

a second switching portion configured to perform a switching operation of a current flowing through the primary coil based on a drive signal; and a second rectifier circuit portion configured to rectify an AC voltage generated in the secondary coil of the second transformer by the switching operation of the second switching portion, and to output a rectified voltage.

8. The image forming apparatus according to claim 7, wherein the second rectifier circuit portion includes a seventh diode and a seventh capacitor, wherein a cathode terminal of the seventh diode is connected to one end of the secondary coil of the second transformer, and an anode terminal of the seventh diode is connected to one end of the seventh capacitor and the first rectifier circuit portion, and wherein another end of the seventh capacitor is connected to another end of the secondary coil of the second transformer and a ground.

9. The image forming apparatus according to claim 8, further comprising a detector which is provided upstream of the transfer portion and in a conveyance path of the recording material, and is configured to detect the recording material being conveyed, wherein in a case in which the detector detects a leading edge of the recording material, the controller outputs the drive signal to the first switching portion and the second switching portion at a timing at which the leading edge of the recording material reaches the nip portion, so that a first transfer voltage is output from the transfer power supply portion by a time an image region of the recording material to which the toner image formed on the image bearing member is to be transferred reaches the nip portion, and wherein in a case in which the detector detects a trailing edge of the recording material, the controller stops an output of the drive signal to the first switching portion at a timing at which the trailing edge of the recording material reaches the nip portion, so that the first transfer voltage output from the transfer power supply portion is decreased to a second transfer voltage lower than the first transfer voltage by a time the trailing edge of the recording material passes through the nip portion.

10. The image forming apparatus according to claim 9, wherein the controller does not stop an output of the drive signal to the second switching portion at the timing at which the trailing edge of the recording material reaches the nip portion, and the controller stops the output of the drive signal to the second switching portion at a timing at which the trailing edge of the recording material passes through the nip portion.

11. The image forming apparatus according to claim 10, further comprising a charger including a charging roller configured to charge a surface of the image bearing member to a uniform potential, wherein the image bearing member is to be charged to a third transfer voltage by the charging roller.

12. The image forming apparatus according to claim 11, further comprising an exposure portion configured to irradiate the surface of the image bearing member with a light beam so as to form an electrostatic latent image on the surface of the image bearing member, wherein the second transfer voltage is a voltage of the surface of the image bearing member irradiated with the light beam by the exposure portion.

13. The image forming apparatus according to claim 12, wherein the second power supply portion applies a voltage, for charging the image bearing member, to the charging roller.

14. The image forming apparatus according to claim 13, wherein the transfer portion includes a transfer roller, which is brought into abutment against the image bearing member to form the nip portion, and to which the transfer voltage is applied to transfer the toner image formed on the image bearing member onto the recording material, and wherein the transfer roller has a volume resistance value of from $1.0\times10^{6}\Omega$ to $5.0\times10^{9}\Omega$.

15. An image forming apparatus, comprising:

an image bearing member;

a transfer portion which forms a nip portion together with the image bearing member, and is configured to transfer a toner image formed on the image bearing member onto a recording material;

a transfer power supply portion configured to output a transfer voltage to the transfer portion so as to transfer the toner image onto the recording material, the transfer power supply portion including:

a first power supply portion configured to output a voltage having a positive polarity, the first power supply portion including:

a first transformer including a primary coil and a secondary coil;

a first switching portion configured to perform a switching operation of a current flowing through the primary coil based on a drive signal; and a first rectifier circuit portion configured to rectify and amplify an AC voltage generated in the secondary coil of the first transformer by the switching operation of the first switching portion, and to output an amplified voltage; and a second power supply portion configured to output a voltage having a negative polarity, wherein the transfer power supply portion is configured to superimpose the voltage output from the first power supply portion and the voltage output from the second power supply portion so as to output a superimposed voltage to the transfer portion as the transfer voltage; and a controller configured to control the transfer power supply portion by outputting the drive signal to the first switching portion, wherein the first rectifier circuit portion includes a plurality of diodes and a plurality of capacitors, wherein the plurality of capacitors include a first capacitor group establishing series connection without interposing the plurality of diodes between the first transformer and an output terminal of the first rectifier circuit portion and a second capacitor group excluding the first capacitor group among the plurality of capacitors, and wherein a capacitance of a predetermined capacitor to be charged by a half-wave rectified voltage of the AC voltage generated in the secondary coil of the first transformer is larger than a capacitance of a capacitor included in the second capacitor group, which is different from the predetermined capacitor.

16. The image forming apparatus according to claim 15, wherein the controller is configured to control the transfer power supply portion by outputting the drive signal to the first switching portion, so that a first transfer voltage is output from the transfer power supply portion when a leading edge of the recording material reaches the nip portion and a second transfer voltage lower than the first transfer voltage is output from the transfer power supply portion when a trailing edge of the recording material reaches the nip portion.

17. The image forming apparatus according to claim 15, wherein, in a case in which the first rectifier circuit portion outputs a voltage which is an odd multiple of the half-wave rectified voltage generated in the secondary coil of the first transformer, the first capacitor group includes the predetermined capacitor, and the capacitance of the capacitor included in the second capacitor group is smaller than a capacitance of a capacitor included in the first capacitor group.

18. The image forming apparatus according to claim 17, wherein a capacitance of a capacitor other than the predetermined capacitor among capacitors included in the first capacitor group is equal to or smaller than the capacitance of the predetermined capacitor.

19. The image forming apparatus according to claim 15, wherein, in a case in which the first rectifier circuit portion outputs a voltage which is an even multiple of the half-wave rectified voltage generated in the secondary coil of the first transformer, the second capacitor group includes the predetermined capacitor, and the capacitance of the capacitor included in the second capacitor group, which is different from the predetermined capacitor, is smaller than a capacitance of a capacitor included in the first capacitor group.

20. The image forming apparatus according to claim 19, wherein the capacitance of the capacitor included in the first capacitor group is equal to or smaller than the capacitance of the predetermined capacitor.

21. The image forming apparatus according to claim 15, wherein the second power supply portion includes:

a second transformer including a primary coil and a secondary coil;

a second switching portion configured to perform a switching operation of a current flowing through the primary coil based on a drive signal; and a second rectifier circuit portion configured to rectify an AC voltage generated in the secondary coil of the second transformer by the switching operation of the second switching portion, and to output a rectified voltage.

22. An image forming apparatus, comprising:

an image bearing member;

a transfer portion which forms a nip portion together with the image bearing member, and is configured to transfer a toner image formed on the image bearing member onto a recording material;

a transfer power supply portion configured to output a transfer voltage to the transfer portion so as to transfer the toner image onto the recording material, the transfer power supply portion including:

a transformer including a primary coil and a secondary coil;

a switching portion configured to perform a switching operation of a current flowing through the primary coil based on a drive signal; and a rectifier circuit portion configured to rectify and amplify an AC voltage generated in the secondary coil of the transformer by the switching operation of the switching portion, and to output an amplified voltage to the transfer portion; and a controller configured to control the transfer power supply portion by outputting the drive signal to the switching portion, wherein the rectifier circuit portion includes a plurality of diodes and a plurality of capacitors, wherein the plurality of capacitors include a first capacitor group establishing series connection without interposing the plurality of diodes between the transformer and an output terminal configured to output the voltage to the transfer portion and a second capacitor group excluding the first capacitor group among the plurality of capacitors, and wherein a capacitance of a capacitor included in the second capacitor group is smaller than a capacitance of a capacitor included in the first capacitor group.

23. The image forming apparatus according to claim 22, wherein the controller is configured to control the transfer power supply portion by outputting the drive signal to the switching portion, so that a first transfer voltage is output from the transfer power supply portion when a leading edge of the recording material reaches the nip portion and a second transfer voltage lower than the first transfer voltage is output from the transfer power supply portion when a trailing edge of the recording material reaches the nip portion.

24. The image forming apparatus according to claim 22, wherein the rectifier circuit portion is a voltage tripler rectifier circuit in which the plurality of diodes include a first diode, a second diode, and a third diode, and the plurality of capacitors include a first capacitor, a second capacitor, and a third capacitor, wherein an anode terminal of the first diode is connected to one end of the secondary coil of the transformer, and a cathode terminal of the first diode is connected to an anode terminal of the second diode and one end of each of the first capacitor and the third capacitor, wherein a cathode terminal of the second diode is connected to an anode terminal of the third diode and one end of the second capacitor, wherein a cathode terminal of the third diode is connected to another end of the third capacitor and an output terminal configured to output the voltage to the transfer portion, wherein another end of the second capacitor is connected to the one end of the secondary coil of the transformer, wherein another end of the first capacitor is connected to another end of the secondary coil of the transformer, and wherein a capacitance of the second capacitor is smaller than a capacitance of each of the first capacitor and the third capacitor.

25. The image forming apparatus according to claim 22, wherein the rectifier circuit portion is a voltage quadrupler rectifier circuit in which the plurality of diodes include a first diode, a second diode, a third diode, and a fourth diode, and the plurality of capacitors include a first capacitor, a second capacitor, a third capacitor, and a fourth capacitor, wherein one end of the first capacitor is connected to one end of the secondary coil of the transformer, and another end of the first capacitor is connected to a cathode terminal of the first diode, an anode terminal of the second diode, and one end of the third capacitor, wherein another end of the third capacitor is connected to a cathode terminal of the third diode and an anode terminal of the fourth diode, wherein an anode terminal of the first diode and one end of the second capacitor are connected to another end of the secondary coil of the transformer, wherein another end of the second capacitor is connected to a cathode terminal of the second diode, an anode terminal of the third diode, and one end of the fourth capacitor, wherein another end of the fourth capacitor is connected to a cathode terminal of the fourth diode and an output terminal configured to output the voltage to the transfer portion, and wherein a capacitance of each of the first capacitor and the third capacitor is smaller than a capacitance of each of the second capacitor and the fourth capacitor.

26. The image forming apparatus according to claim 22, wherein the rectifier circuit portion is a voltage quintupler rectifier circuit in which the plurality of diodes include a first diode, a second diode, a third diode, a fourth diode, and a fifth diode, and the plurality of capacitors include a first capacitor, a second capacitor, a third capacitor, a fourth capacitor, and a fifth capacitor, wherein an anode terminal of the first diode and one end of the second capacitor are connected to one end of the secondary coil of the transformer, wherein another end of the second capacitor is connected to a cathode terminal of the second diode, an anode terminal of the third diode, and one end of the fourth capacitor, wherein another end of the fourth capacitor is connected to a cathode terminal of the fourth diode and an anode terminal of the fifth diode, wherein a cathode terminal of the first diode is connected to one end of the first capacitor, one end of the third capacitor, and an anode terminal of the second diode, wherein another end of the third capacitor is connected to a cathode terminal of the third diode, an anode terminal of the fourth diode, and one end of the fifth capacitor, wherein a cathode terminal of the fifth diode is connected to another end of the fifth capacitor and an output terminal configured to output the voltage to the transfer portion, wherein another end of the first capacitor is connected to another end of the secondary coil of the transformer, and wherein a capacitance of each of the second capacitor and the fourth capacitor is smaller than a capacitance of each of the first capacitor, the third capacitor, and the fifth capacitor.

27. The image forming apparatus according to claim 22, wherein the rectifier circuit portion is a voltage sextupler rectifier circuit in which the plurality of diodes include a first diode, a second diode, a third diode, a fourth diode, a fifth diode, and a sixth diode, and the plurality of capacitors include a first capacitor, a second capacitor, a third capacitor, a fourth capacitor, a fifth capacitor, and a sixth capacitor, wherein one end of the first capacitor is connected to one end of the secondary coil of the transformer, and another end of the first capacitor is connected to a cathode terminal of the first diode, an anode terminal of the second diode, and one end of the third capacitor, wherein another end of the third capacitor is connected to a cathode terminal of the third diode, an anode terminal of the fourth diode, and one end of the fifth capacitor, wherein another end of the fifth capacitor is connected to a cathode terminal of the fifth diode and an anode terminal of the sixth diode, wherein an anode terminal of the first diode and one end of the second capacitor are connected to another end of the secondary coil of the transformer, wherein another end of the second capacitor is connected to a cathode terminal of the second diode, an anode terminal of the third diode, and one end of the fourth capacitor, wherein another end of the fourth capacitor is connected to a cathode terminal of the fourth diode, an anode terminal of the fifth diode, and one end of the sixth capacitor, wherein a cathode terminal of the sixth diode is connected to another end of the sixth capacitor and an output terminal configured to output the voltage to the transfer portion, and wherein a capacitance of each of the first capacitor, the third capacitor, and the fifth capacitor is smaller than a capacitance of each of the second capacitor, the fourth capacitor, and the sixth capacitor.

28. The image forming apparatus according to claim 22, further comprising a detector which is provided upstream of the transfer portion and in a conveyance path of the recording material, and is configured to detect the recording material being conveyed, wherein in a case in which the detector detects a leading edge of the recording material, the controller outputs the drive signal to the switching portion at a timing at which the leading edge of the recording material reaches the nip portion, so that a first transfer voltage is output from the rectifier circuit portion by a time an image region of the recording material to which the toner image formed on the image bearing member is to be transferred reaches the nip portion, and wherein in a case in which the detector detects a trailing edge of the recording material, the controller stops an output of the drive signal at timing at which the trailing edge of the recording material reaches the nip portion, so that the first transfer voltage output from the rectifier circuit portion is decreased to a second transfer voltage lower than the first transfer voltage by a time the trailing edge of the recording material passes through the nip portion.

29. The image forming apparatus according to claim 28, wherein a ripple voltage of the transfer voltage is determined based on capacitances of a plurality of capacitors establishing the series connection, and wherein the capacitances of the plurality of capacitors are set to capacitances with which the ripple voltage at time when the first transfer voltage is output from the rectifier circuit portion falls within a predetermined voltage range in which no blank area is caused by poor transfer.

30. The image forming apparatus according to claim 29, wherein the transfer portion includes a transfer roller, which is brought into abutment against the image bearing member to form the nip portion, and to which the transfer voltage is applied to transfer the toner image formed on the image bearing member onto the recording material, and wherein in a case in which the ripple voltage larger than the predetermined voltage range is applied to the transfer roller, the toner image formed on the image bearing member is not transferred onto the recording material or the blank area is caused by poor transfer in which the toner image transferred onto the recording material is re-transferred onto the image bearing member.

31. The image forming apparatus according to claim 30, wherein the second transfer voltage is a voltage at which a surface of the image bearing member is not charged to a same polarity as a polarity of the transfer voltage by separation electric-discharge caused when the trailing edge of the recording material passes through the nip portion.

32. The image forming apparatus according to claim 31, wherein the transfer roller has a volume resistance value of from $1.0\times10^{6}\Omega$ to $5.0\times10^{9}\Omega$.

* * * * *